US011408698B2

(12) United States Patent
Lamarche

(10) Patent No.: US 11,408,698 B2
(45) Date of Patent: Aug. 9, 2022

(54) AMMUNITIONS MAGAZINE LOADER BULLETS RETAINER

(71) Applicant: COMBAT READY INC., Ottawa (CA)

(72) Inventor: Francois Lamarche, Ottawa (CA)

(73) Assignee: AMMUNITION MANAGEMENT TECHNOLOGIES INC., Ottawa (CA)

( * ) Notice: Subject to any disclaimer, the term of this patent is extended or adjusted under 35 U.S.C. 154(b) by 0 days.

(21) Appl. No.: 17/098,347

(22) Filed: Nov. 14, 2020

(65) Prior Publication Data

US 2021/0254915 A1 Aug. 19, 2021

Related U.S. Application Data

(63) Continuation of application No. 15/883,236, filed on Jan. 30, 2018, now Pat. No. 10,866,046.

(60) Provisional application No. 62/451,919, filed on Jan. 30, 2017.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84; F41A 9/66; F41A 9/67
USPC ..... 42/87, 88
See application file for complete search history.

(56) References Cited

U.S. PATENT DOCUMENTS

| | | | |
|---|---|---|---|
| 1,786,537 | A | 12/1930 | Holek |
| 3,747,469 | A | 7/1973 | Ashley |
| 4,574,511 | A | 3/1986 | Csongor |
| 4,600,120 | A | 7/1986 | Sabo |
| 4,632,257 | A | 12/1986 | Negishi |
| 4,706,402 | A | 11/1987 | Csongor |
| 4,739,572 | A | 4/1988 | Brandenburg |
| 4,823,983 | A | 4/1989 | Groover |
| 4,939,862 | A | 7/1990 | Brandenburg |
| 4,984,710 | A | 1/1991 | Oike |
| 7,059,077 | B2 | 6/2006 | Tal |
| 8,453,366 | B2 | 6/2013 | Gray |
| 8,931,199 | B1 | 1/2015 | Cauley, Jr. |
| 9,003,687 | B2 | 4/2015 | Cauley, Jr. |
| 9,335,108 | B2 | 5/2016 | Cauley, Jr. |
| 9,574,836 | B1 | 2/2017 | Cauley, Jr. |

(Continued)

FOREIGN PATENT DOCUMENTS

| | | |
|---|---|---|
| DE | 9302545 | 6/1993 |
| GB | 379179 | 8/1932 |

(Continued)

*Primary Examiner* — Jonathan C Weber
(74) *Attorney, Agent, or Firm* — Benoit & Cote Inc.; Mathieu Audet

(57) ABSTRACT

A magazine loader for loading bullets in a magazine is presented, the magazine loader comprising a body including a first opening for inserting bullets in the magazine loader and a second opening for loading bullets in a magazine, when the magazine loader is used in conjunction with the magazine, a plurality of vertical channels inside the body for receiving bullets therein, a dented member including a series of raised portions sized and designed for selectively locating and aligning the bullets of the lower row of bullets in a loadable row of bullets by preventing the bullets in the loadable row of bullets to move upon vertical pressure of additional bullets located in the plurality of channels and an actuator for moving the loadable row of bullets out of the magazine loader through a magazine receptacle.

16 Claims, 64 Drawing Sheets

(56) References Cited

U.S. PATENT DOCUMENTS

| | | | |
|---|---|---|---|
| 9,995,548 | B1 | 6/2018 | Zhou |
| 10,132,582 | B1 | 11/2018 | Zhou |
| 2005/0081421 | A1 | 4/2005 | Tal |
| 2013/0067788 | A1 | 3/2013 | Gray |
| 2014/0033592 | A1 | 2/2014 | Fiorucci |
| 2014/0317985 | A1 | 10/2014 | Cauley, Jr. |
| 2015/0219415 | A1 | 8/2015 | Cauley, Jr. |

FOREIGN PATENT DOCUMENTS

| | | | |
|---|---|---|---|
| GB | 443103 | | 2/1936 |
| WO | WO2014152848 | A1 | 9/2014 |
| WO | WO2014152848 | A4 | 9/2014 |

AMMUNITIONS MAGAZINE LOADER BULLETS RETAINER

CROSS-REFERENCE

The present United States Patent Application is a continuation of and claims priority under 35 U.S.C. § 120 to U.S. patent application Ser. No. 15/883,236, filed Jan. 30, 2018, which '236 Application is a non-provisional patent application that relates to and claims priority under 35 U.S.C. 119(e) to U.S. Provisional Patent Application No. 62/451,919, filed Jan. 30, 2017. Both documents are incorporated herein by reference in their entireties.

FIELD OF THE INVENTION

This invention generally relates to an ammunitions magazine loader. More precisely, the invention relates to an ammunition magazine loader with mechanisms for filling magazines with ammunitions, in batch, and adaptors for moving ammunitions from ammunitions containers to the ammunition magazine loader.

BACKGROUND OF THE INVENTION

Ammunitions are packaged in strips thereof, boxes thereof or ammunitions containers. Rounds are individually loaded in each magazine. Manual magazines loading is time consuming and can be difficult to load.

The transport of ammunitions has not significantly evolved since the invention of the bullets for firearms. The majority of combat rifles currently in service around the world use thirty ammunitions (rounds) magazines. When not loaded in a magazine, ammunitions are conserved and carried in boxes. The process of loading individual ammunitions into a magazine is slow and requires the user to have fine motor skills and sufficient strength. The user needs to be concentrated and undisturbed to be efficient during the process. In a combat environment where the user is under intense pressure the reloading process of the magazine becomes longer, slower and is subjected to interruption. Further, speed in readying a weapon in a combat environment is important; the slowness of the reloading process delays the readiness of a firearm. In a training environment, or in civilian use, reloading the magazines remains a time-consuming process and a waste of time. Past attempts to facilitate the magazines reloading do not allow to quickly and efficiently reload a regular combat magazine.

Therefore, there exists a need in the art for an improved ammunitions magazine loader over the existing art. There is a need in the art for a magazine loader that is fast and reliable to use. A need has also been felt in the art for a magazine loader that reduces the complexity of magazines ammunitions loading. There is also a need for such a magazine loader that can be easily and economically manufactured.

SUMMARY OF THE INVENTION

It is one aspect of the present invention to alleviate one or more of the drawbacks of the background art by addressing one or more of the existing needs in the art.

Accordingly, embodiments of this invention are concerned with an ammunitions magazine loader.

An aspect of one or more embodiments of the invention provides a magazine loader that can rapidly and efficiently load ammunitions in magazines.

An aspect of one or more embodiments of the invention provides a magazine loader that simultaneously load a plurality of ammunitions in a magazine.

An aspect of one or more embodiments of the invention provides a magazine loader that simultaneously load a magazine at once.

An aspect of one or more embodiments of the invention provides a magazine loader adapted to be carried and used in combat zones.

An aspect of one or more embodiments of the invention provides a magazine loader containing more than two full magazines of any type of ammunitions with the ability to fully load a magazine.

An aspect of one or more embodiments of the invention provides a gravity fed system with the ability to stabilize the movement of the ammunition within the magazine loader apparatus.

An aspect of one or more embodiments of the invention provides a resupply box with the ability to load the magazine loader with one motion.

An aspect of one or more embodiments of the invention provides a method to separate ammunitions for filling a full magazine from its bullets container to a loading compartment with a linear motion.

An aspect of one or more embodiments of the invention provides a plurality of bullet-shape holes to proper direct the ammunitions into the magazine loader.

An aspect of one or more embodiments of the invention provides a method to disperse compact ammunitions into the magazine loader.

An aspect of one or more embodiments of the invention provides a magazine loader that can receive an ammunitions container thereon to transfer ammunitions from the container to the magazine loader.

An aspect of one or more embodiments of the invention provides an adaptor configured to adapt ammunitions containers of different configurations to the magazine loader.

An aspect of one or more embodiment of the invention provides an adaptor that can be manufactured with different dimensions to accommodate ammunitions containers of different sizes.

An aspect of one or more embodiment of the invention provides an adaptor that can be manufactured with different dimensions and characteristics to accommodate different calibers of ammunitions.

An aspect of one or more embodiments of the invention provides a magazine loader that can be manufactured with different dimensions to accommodate different calibers of ammunitions An aspect of one or more embodiments of the invention provides a magazine loader including a plurality of internal bullets-receiving channels.

An aspect of one or more embodiments of the invention provides a magazine loader that can be filled with ammunitions by gravity.

An aspect of one or more embodiments of the invention provides a magazine loader including an air gap between adjacent bullets-receiving channels.

An aspect of one or more embodiments of the invention provides a magazine loader including a bullet riser portion.

An aspect of one or more embodiments of the invention provides a magazine loader for loading bullets in a magazine is presented, the magazine loader comprising a body including a first opening for inserting bullets in the magazine loader and a second opening for loading bullets in a magazine, when the magazine loader is used in conjunction with the magazine, a plurality of channels inside the body for receiving therein bullets, when the magazine loader is used in conjunction with a plurality of bullets, the lower bullets in the channels forming a row of bullets and an actuator for moving the row of bullets out of the magazine loader through a magazine receptacle.

Another aspect of one or more embodiments of the invention provides a method of loading bullets in a magazine, the method comprising inserting a plurality of bullets in a magazine loader, the magazine loader including a plurality of channels therein for receiving the bullets, aligning a succession of bullets in the magazine loader, securing a magazine in a position adapted to receive therein the succession of bullets and pushing the succession of bullets in the magazine.

Other embodiments and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Additional and/or alternative advantages and salient features of the invention will become apparent from the following detailed description, which, taken in conjunction with the annexed drawings, disclose preferred embodiments of the invention.

BRIEF DESCRIPTION OF THE DRAWINGS

Referring now to the drawings which form a part of this original disclosure.

DETAILED DESCRIPTION OF PREFERRED EMBODIMENTS

A preferred embodiment of the present invention is described below with reference to the drawings.

Figure 1:
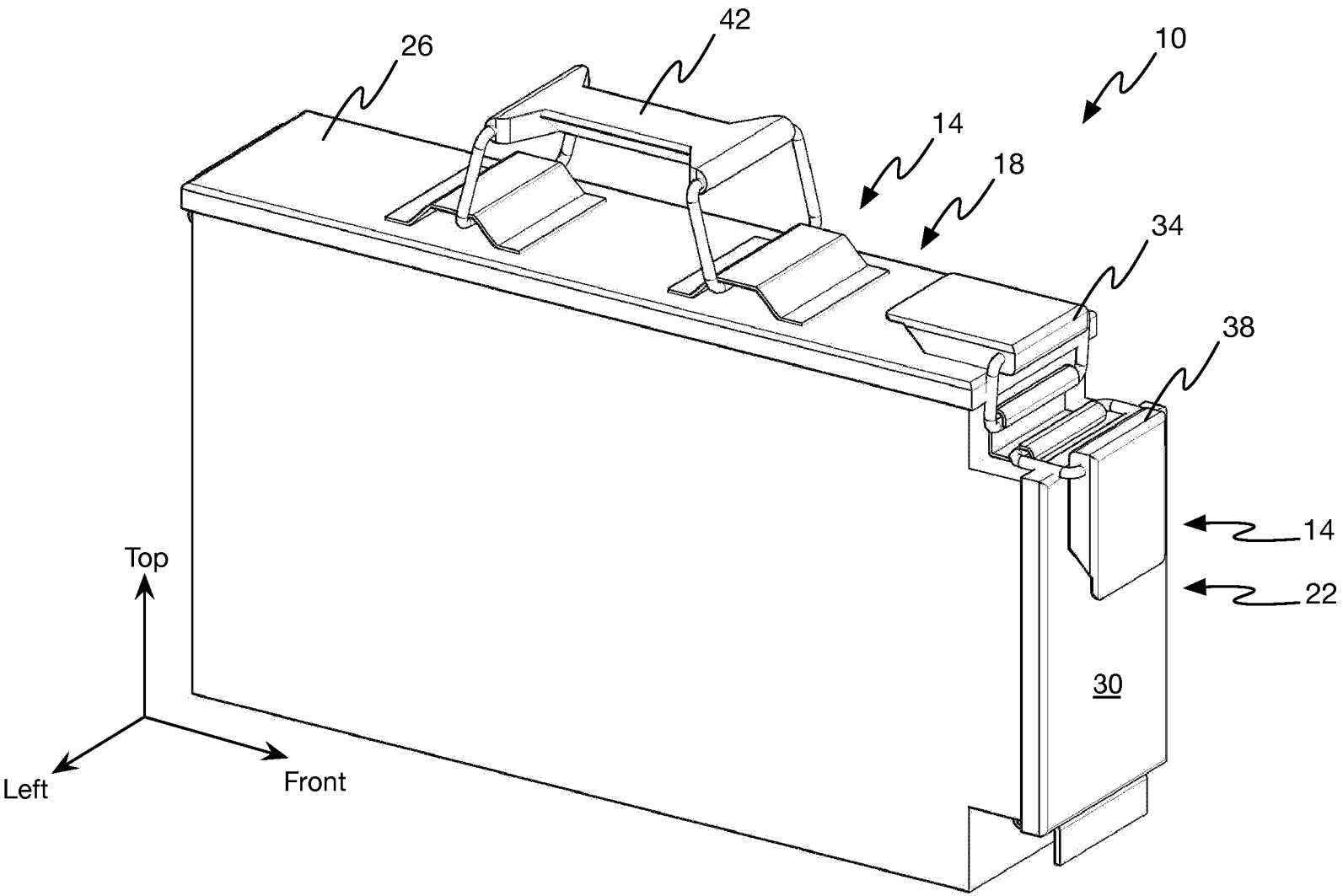
FIG. 1 is an isometric view of a magazine loader, in accordance with at least one embodiment thereof.
Figure 4:
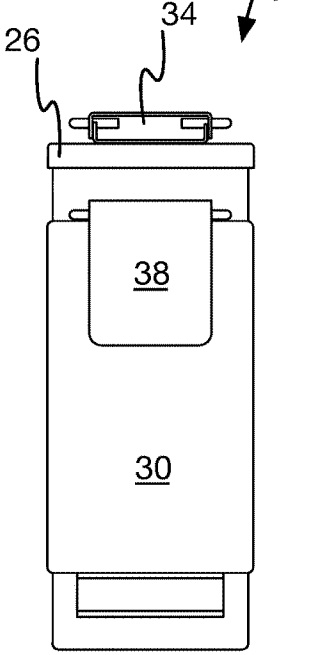
FIG. 4 is a front elevational view of the magazine loader of FIG. 1, in accordance with at least one embodiment thereof.
Figure 2:
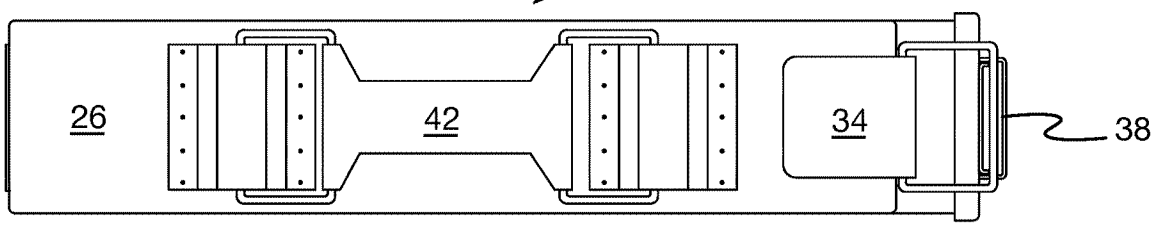
FIG. 2 is a top plan view the magazine loader of FIG. 1, in accordance with at least one embodiment thereof.
Figure 3:
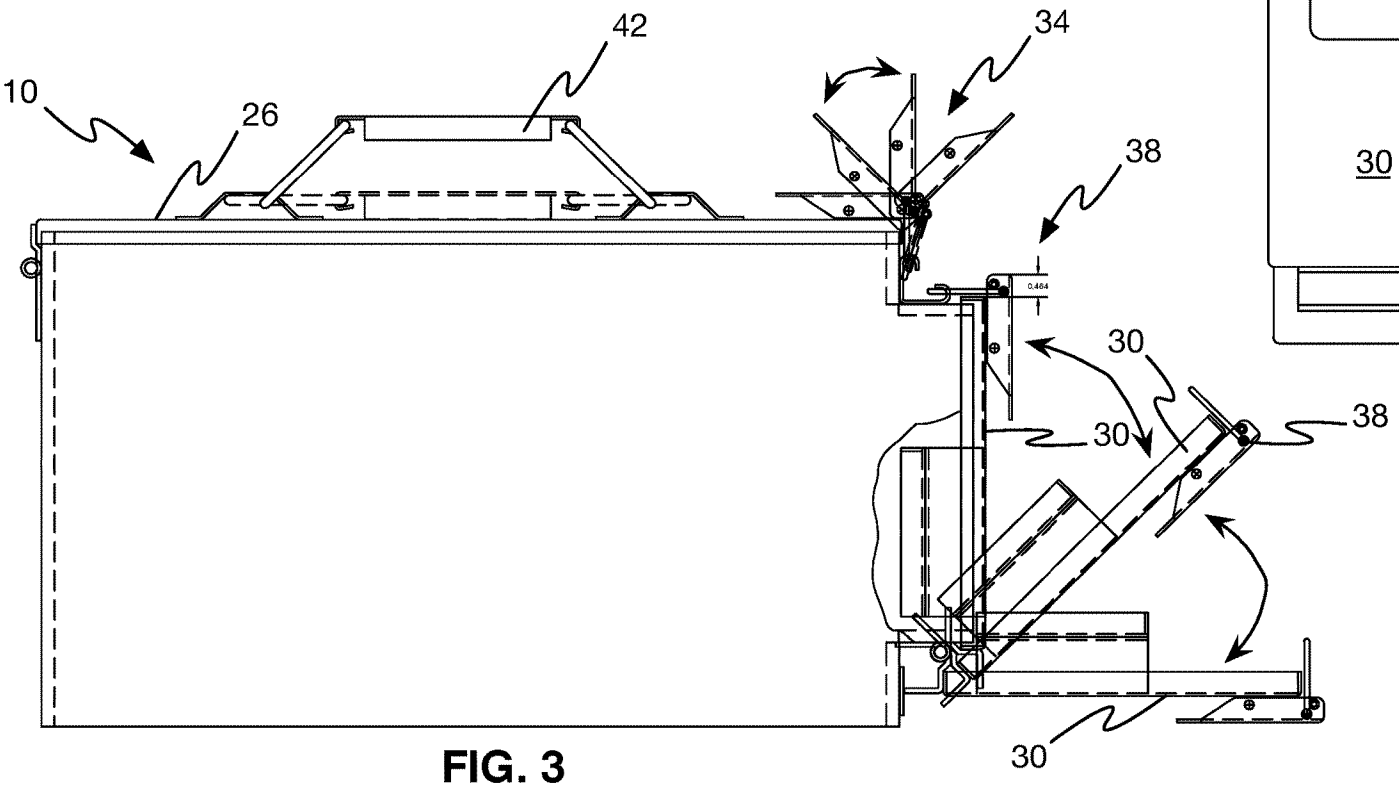
FIG. 3 is a side elevational view of the magazine loader of FIG. 1, in accordance with at least one embodiment thereof.

A magazine loader 10 in accordance with an embodiment of the invention is exemplified in FIG. 1 throughout FIG. 4. The magazine loader 10 is generally used to receive therein a plurality of bullets 74 and is equipped with a mechanism adapted to load a magazine 230 with the bullets 74. The magazine loader 10 is generally made of strong material, such as steel, and is equipped with at least one opening 14 thereof. The illustrated embodiment includes a top opening 18 and a front opening 22 that are selectively closed with a hingedly connected top cover 26 and a hingedly connected front cover 30. The top cover 26 and the front cover 30 are respectively secured in a closed position thereof in FIG. 1 with a top locking mechanism 34 and a front locking mechanism 38. The magazine loader 10 includes an optional handle 42 disposed on the top cover 26, as embodied. It can be appreciated the exact shape, size and configuration of the magazine loader 10 can vary without departing from the scope of the invention. The magazine loader 10 is going to be discussed in greater details below.

Figure 7:
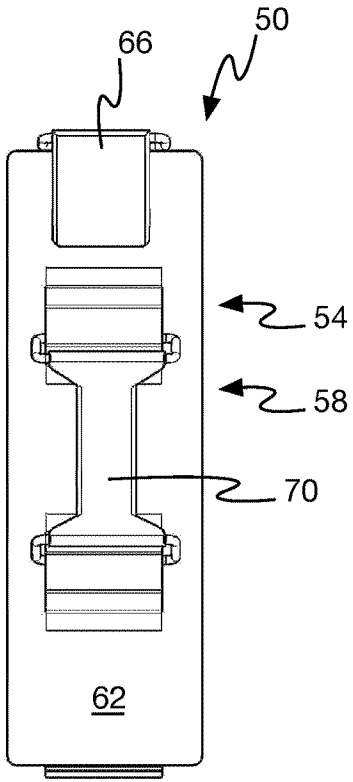
FIG. 7 is a top plan view of the bullets container of FIG. 5, in accordance with at least one embodiment thereof.
Figure 5:
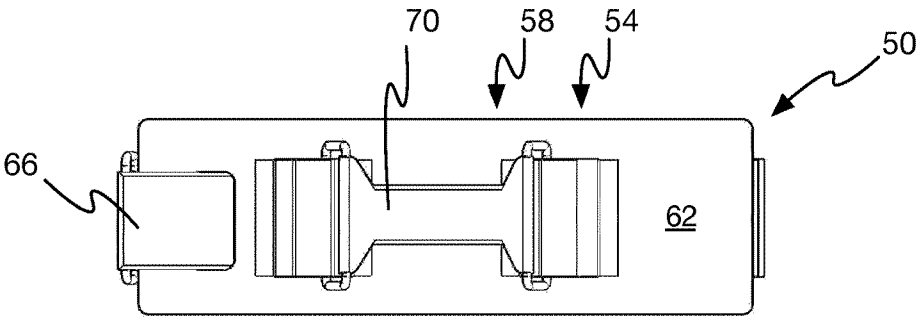
FIG. 5 is a top plan view of a bullets container, in accordance with at least one embodiment thereof.
Figure 6:
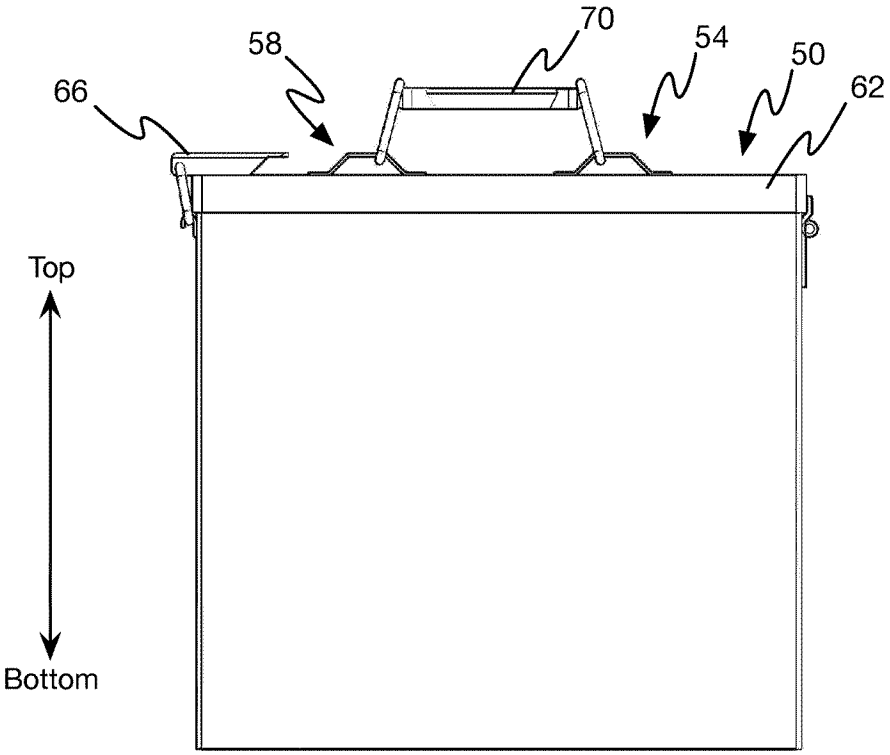
FIG. 6 is a side elevational view of the bullets container of FIG. 5, in accordance with at least one embodiment thereof.

A bullets container 50 in accordance with an embodiment of the invention is exemplified in FIG. 5 throughout FIG. 7. The bullets container 50 is generally used to house and transport a plurality of bullets 74. The bullets container 50 is generally made of strong material, such as steel, and is equipped with at least one opening 54. The illustrated embodiment includes a top opening 58 selectively closed with a hingedly connected top cover 62. The top cover 62 is secured in a closed position thereof with a locking mechanism 66 to prevent bullets 74 to exit the bullets container 50. The bullets container 50 includes an optional handle 70 disposed on the top cover 62, as embodied. The bullets container 50 has generally a standardized format used to store and transport bullets 74 therein. The exact shape, size and configuration of the bullets container 50 can vary without departing from the scope of the invention. Other types of bullets containers can be used in conjunction with the present invention without departing therefrom.

Figure 8:
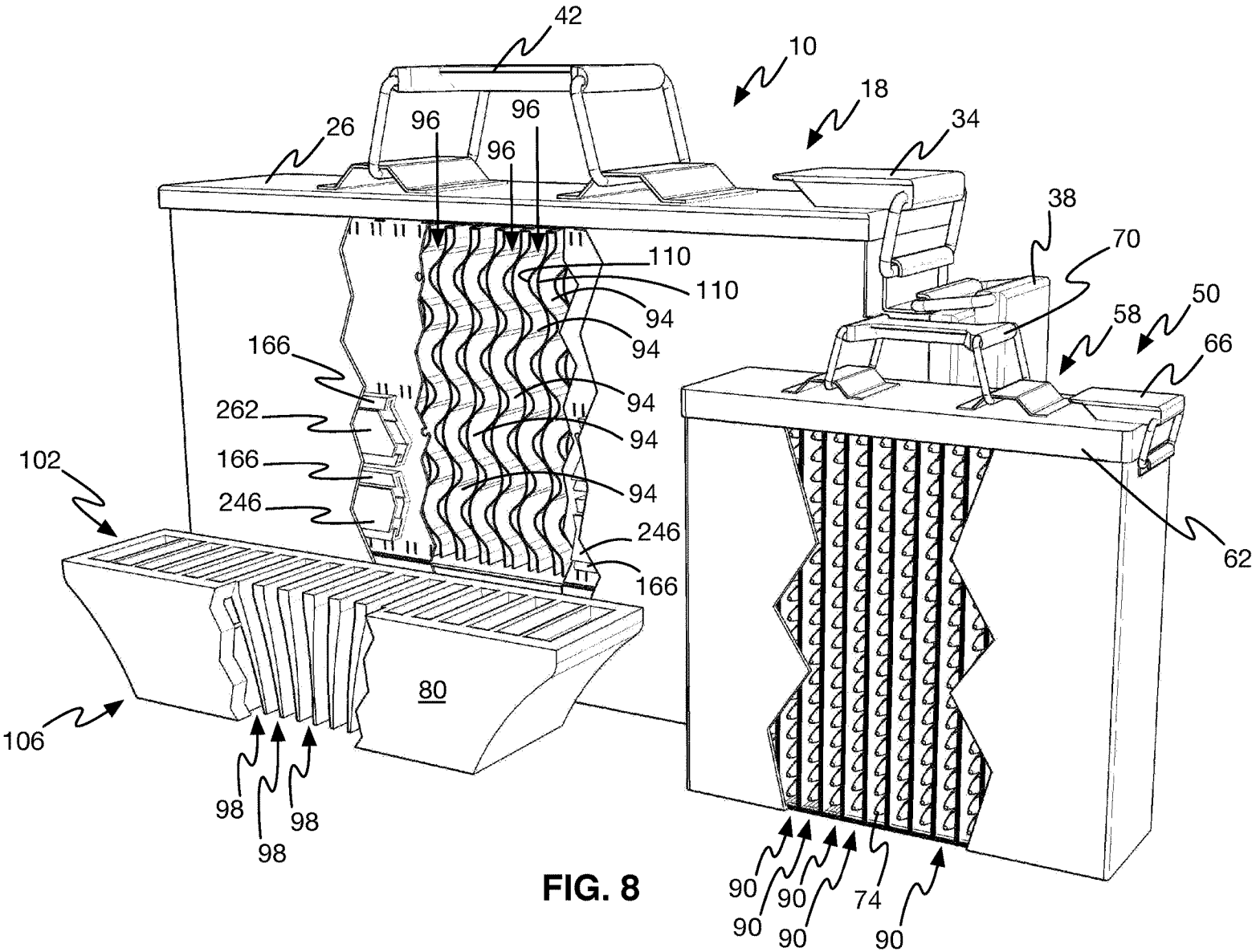
FIG. 8 is an isometric view of a magazine loader, a bullets container and an adaptor, in accordance with at least one embodiment thereof.
Figure 9:
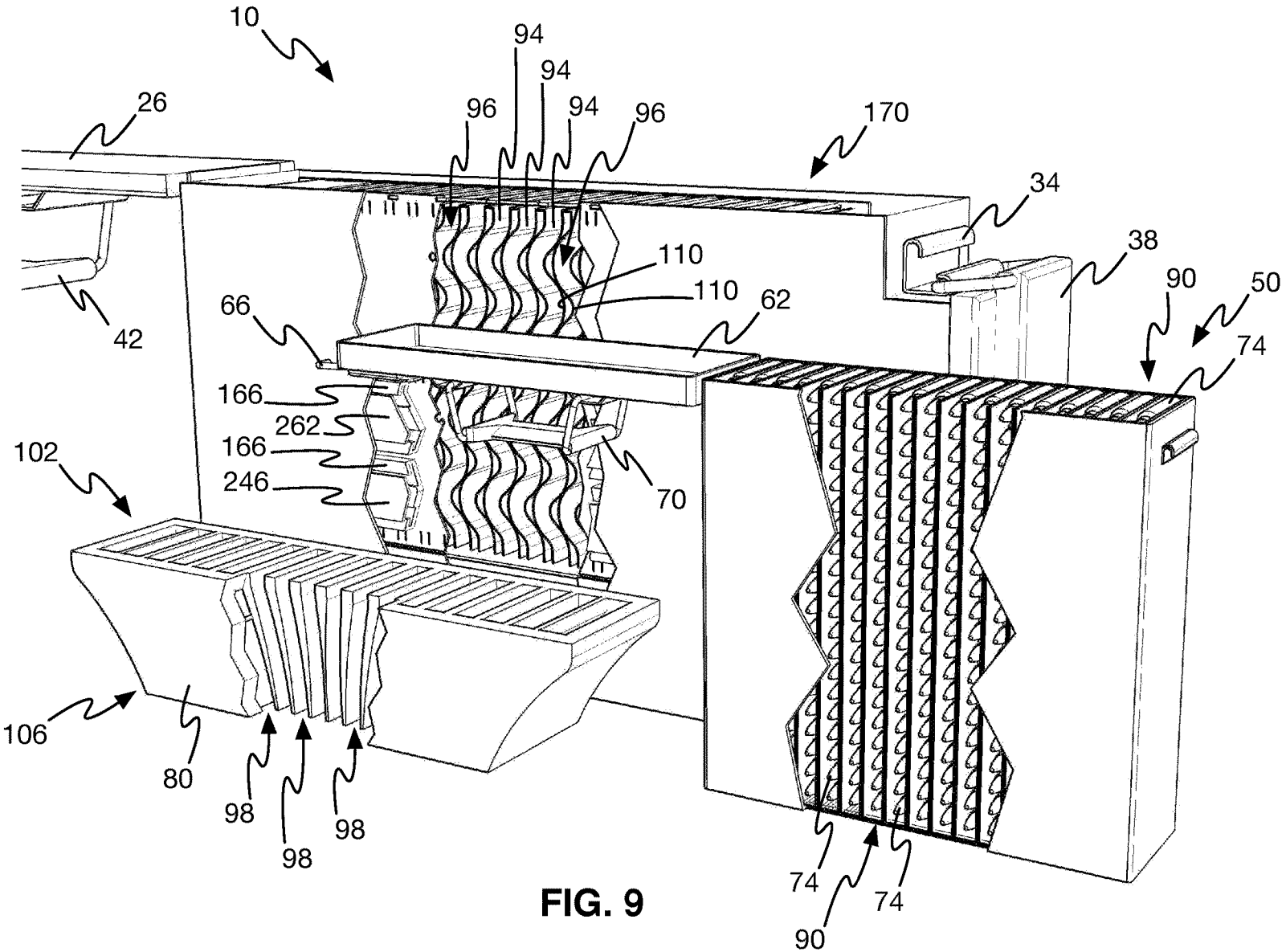
FIG. 9 is an isometric view of the magazine loader, the bullets container, with the lid opened, and the adaptor of FIG. 8, in accordance with at least one embodiment thereof.
Figure 12:
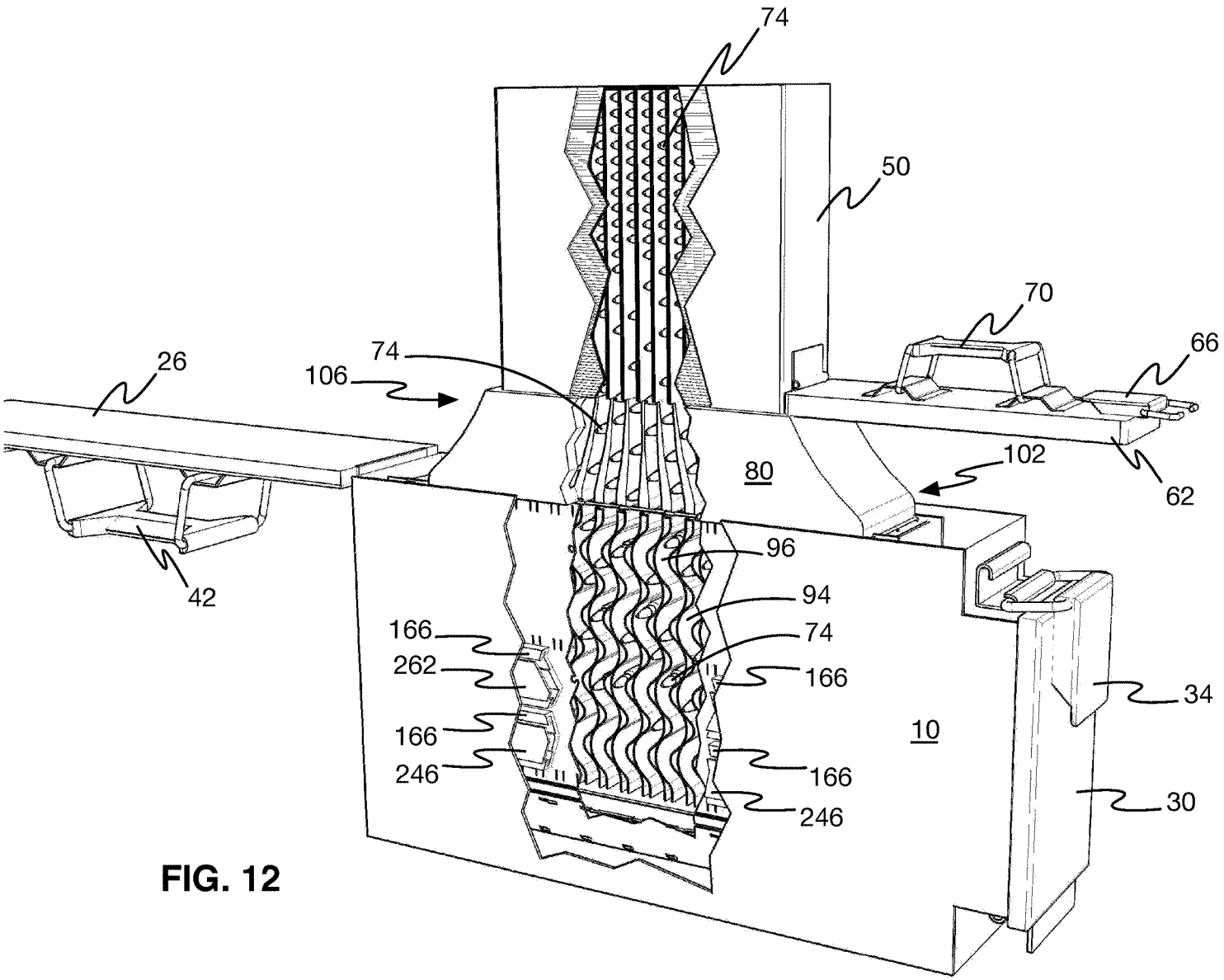
FIG. 12 is an isometric view of the magazine loader, the bullets container and the adaptor of FIG. 8, where the bullets container is assembled to the adaptor and the adaptor is assembled to the magazine loader in an operating configuration, in accordance with at least one embodiment thereof.

The bullets container 50 is not adapted to load magazines 230 with the bullets 74 contained therein. The bullets 74 from the bullets container 50 needs to be manually fed in the magazine 230, which is long and tedious. Embodiments of the invention suggest means for transferring the bullets 74 from the bullets container 50 to the magazine loader 10. It can be appreciated the size and the design of the bullets container 50 need to cooperate with the magazine loader 10. In the present illustrated configuration, the bullets container 50 is smaller than the magazine loader 10 and an adaptor 80 is required to facilitate the transfer of the bullets 74 from the bullets container 50 to the magazine loader 10. FIG. 8 throughout FIG. 12 depict a magazine loader 10, a bullets container 50 and an exemplified adaptor 80 that is sized and designed to interface the bullets container 50 with the magazine loader 10 to route the bullets 74 from the bullets container 50 inside the magazine loader 10. The exact shape, size and configuration of the adaptor 80 can vary without departing from the scope of the invention. It can be appreciated the magazine loader 10 and the bullets container 50 are illustrated with an open portion thereof to allow visualization of their internal structures for the purpose of the present application.

The bullet container 50 of the illustrated embodiment includes therein a series of bullets-receiving slots 90 vertically separating the bullets 74 in a plurality of bullets-receiving slots 90. Similarly, the magazine loader 10 includes a series of channels 96 separated with respective rails 94 sized and designed to receive and locate a series of bullets 74 in channels 96 therein in a position for loading a magazine 230. Consequently, the adaptor 80 includes a series of slots 98 designed to allow bullets 74 transfer from the bullets container 50 to the magazine loader 10. The adaptor 80 is designed, at a first side 102 thereof with a layout of slots 98 corresponding to the layout and the spacing of channels 96 of the magazine loader 10. The layout of slots 98 of the adaptor 80, at a second side 106 thereof, is generally corresponding to the layout of bullets-receiving slots 90 in the bullet container 50. In the present situation, the adaptor 80 has a trapezoidal shape because the spacing between the series of channels 96 of the magazine loader 10 is larger than the spacing of the bullets-receiving slots 90 of the bullets container 50. Other possible configurations are not illustrated and remain within the scope of the present specification.

Figure 10:
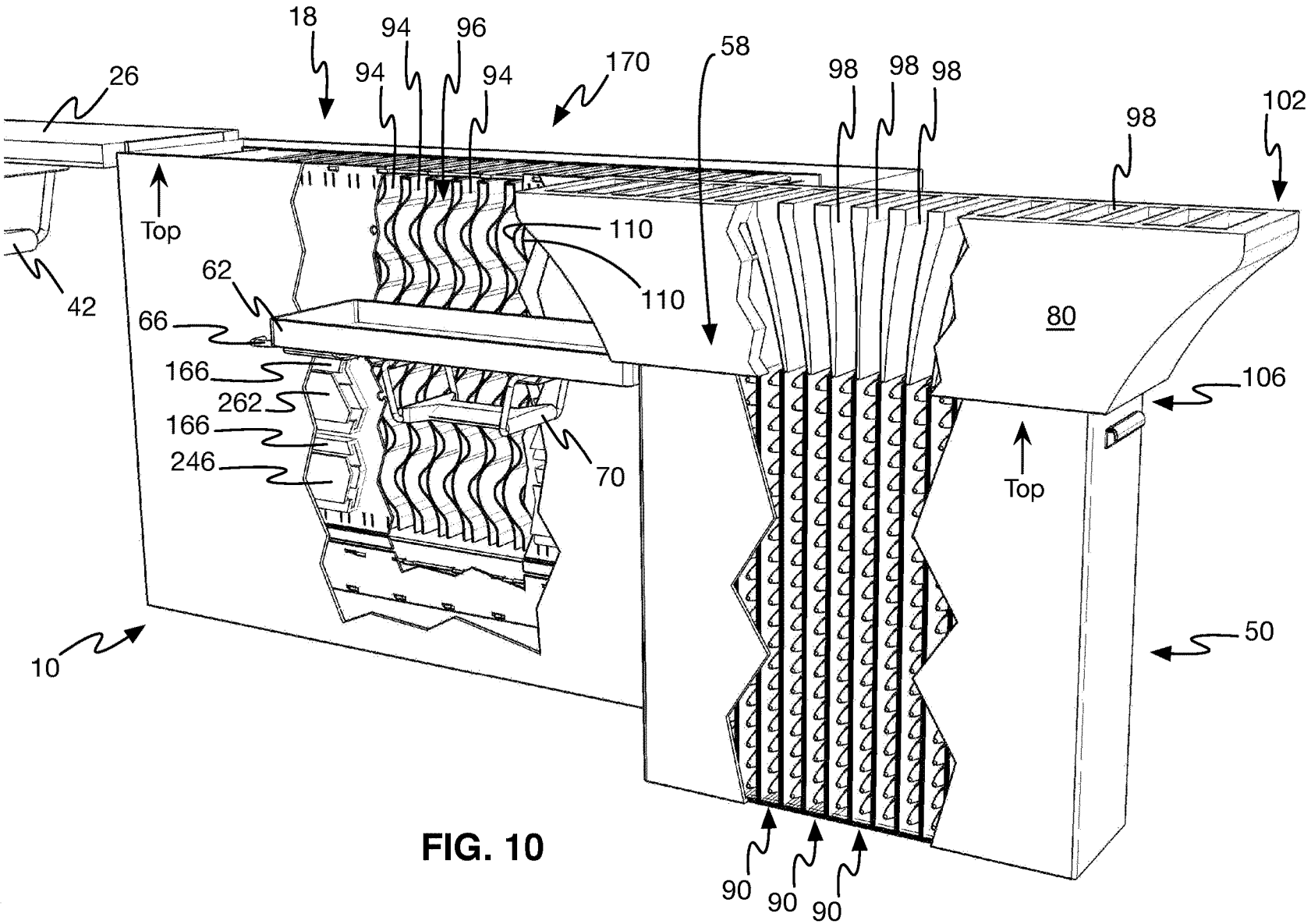
FIG. 10 is an isometric view of the magazine loader, the bullets container and the adaptor of FIG. 8, the adaptor being installed on top of the bullets container, in accordance with at least one embodiment thereof.
Figure 11:
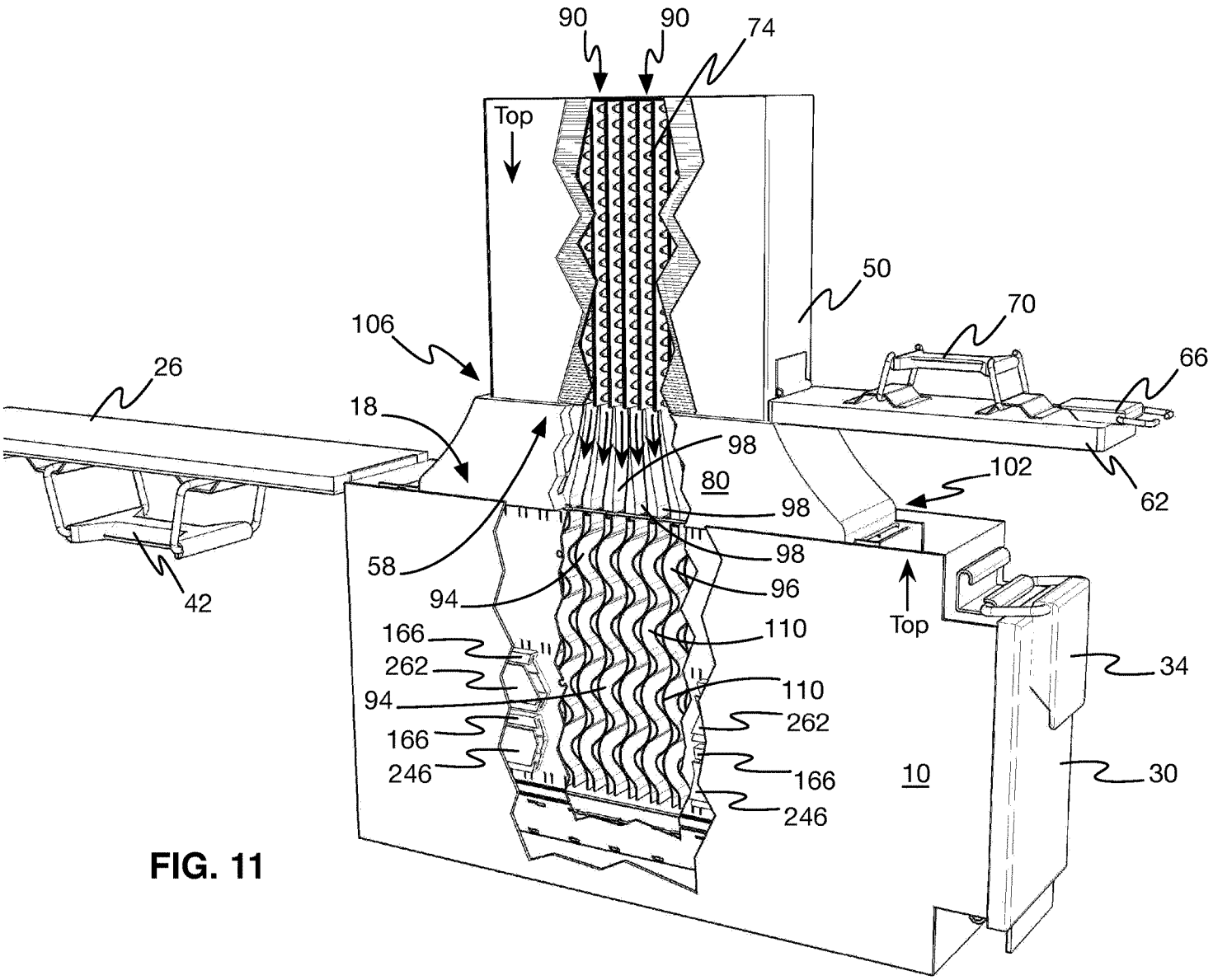
FIG. 11 is an isometric view of the magazine loader, the bullets container and the adaptor of FIG. 8, where the bullets container is assembled to the adaptor and the adaptor is assembled to the magazine loader in an operating configuration, in accordance with at least one embodiment thereof.
Figure 13:
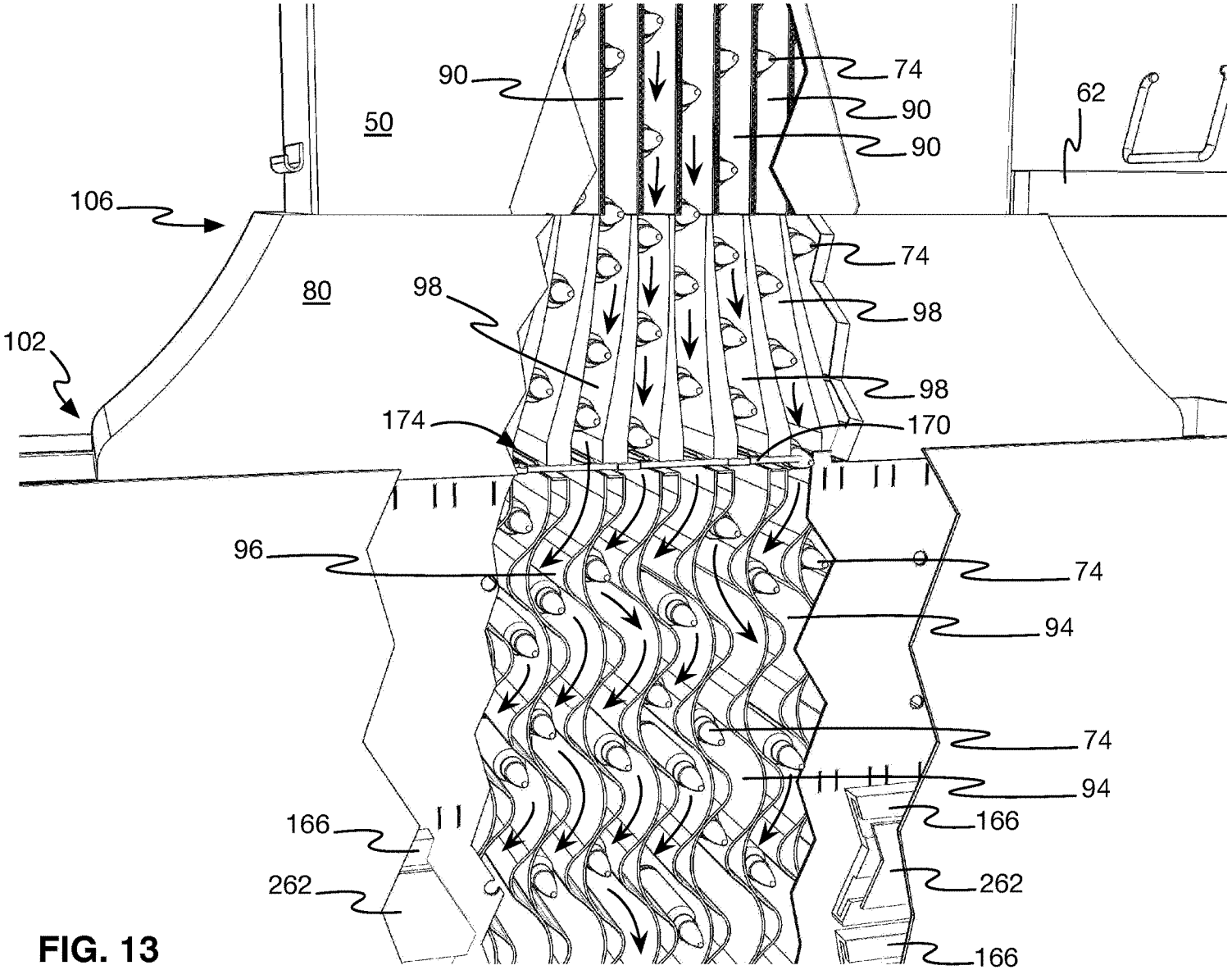
FIG. 13 is a magnified portion of the isometric view of the magazine loader, the bullets container and the adaptor of FIG. 8, where the bullets container is assembled to the adaptor and the adaptor is assembled to the magazine loader in an operating configuration, in accordance with at least one embodiment thereof.
Figure 14:
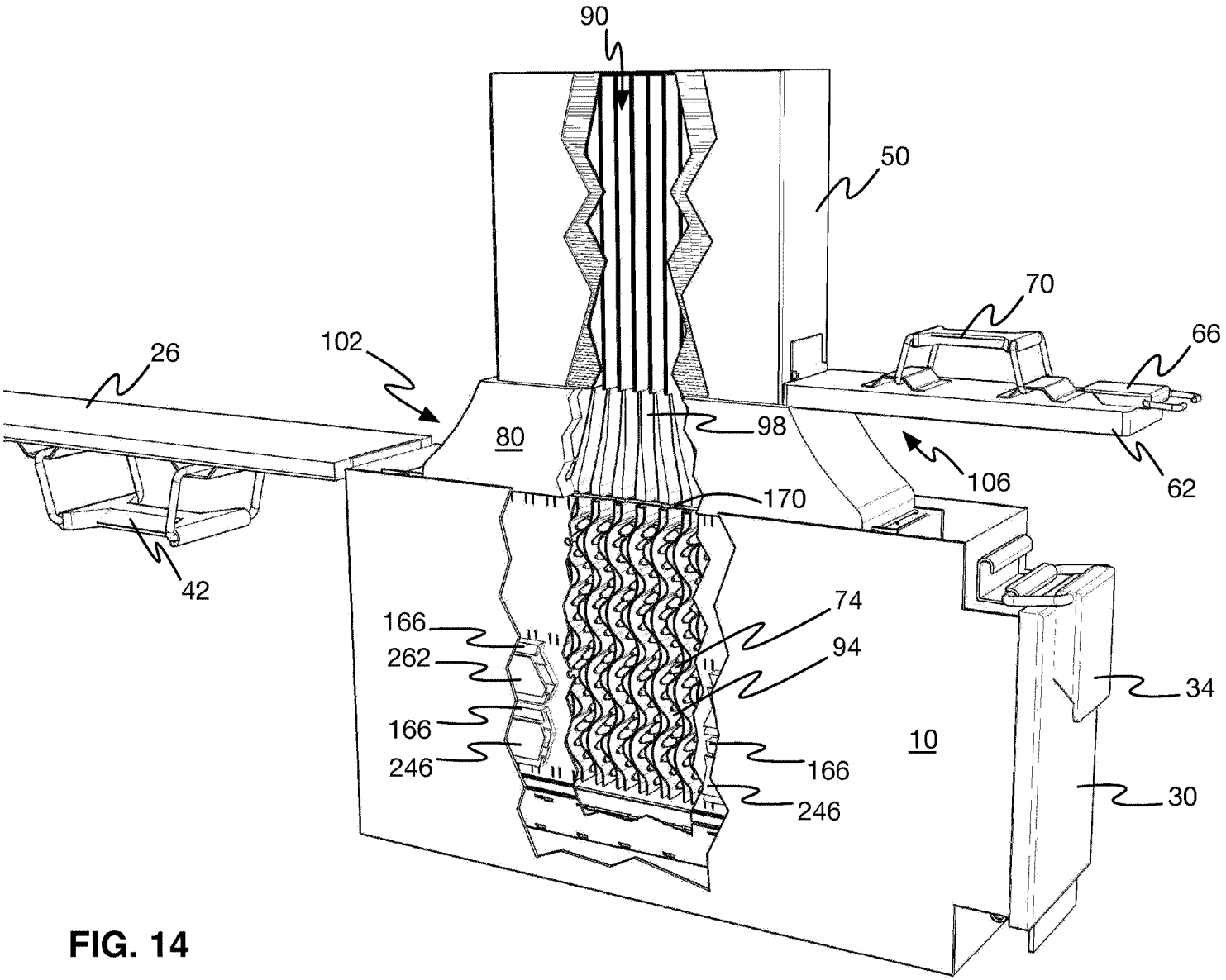
FIG. 14 is an isometric view of the magazine loader, the bullets container and the adaptor of FIG. 8, where the bullets container is assembled to the adaptor and the adaptor is assembled to the magazine loader in an operating configuration with the bullets moved down in the magazine loader, in accordance with at least one embodiment thereof.
Figure 15:
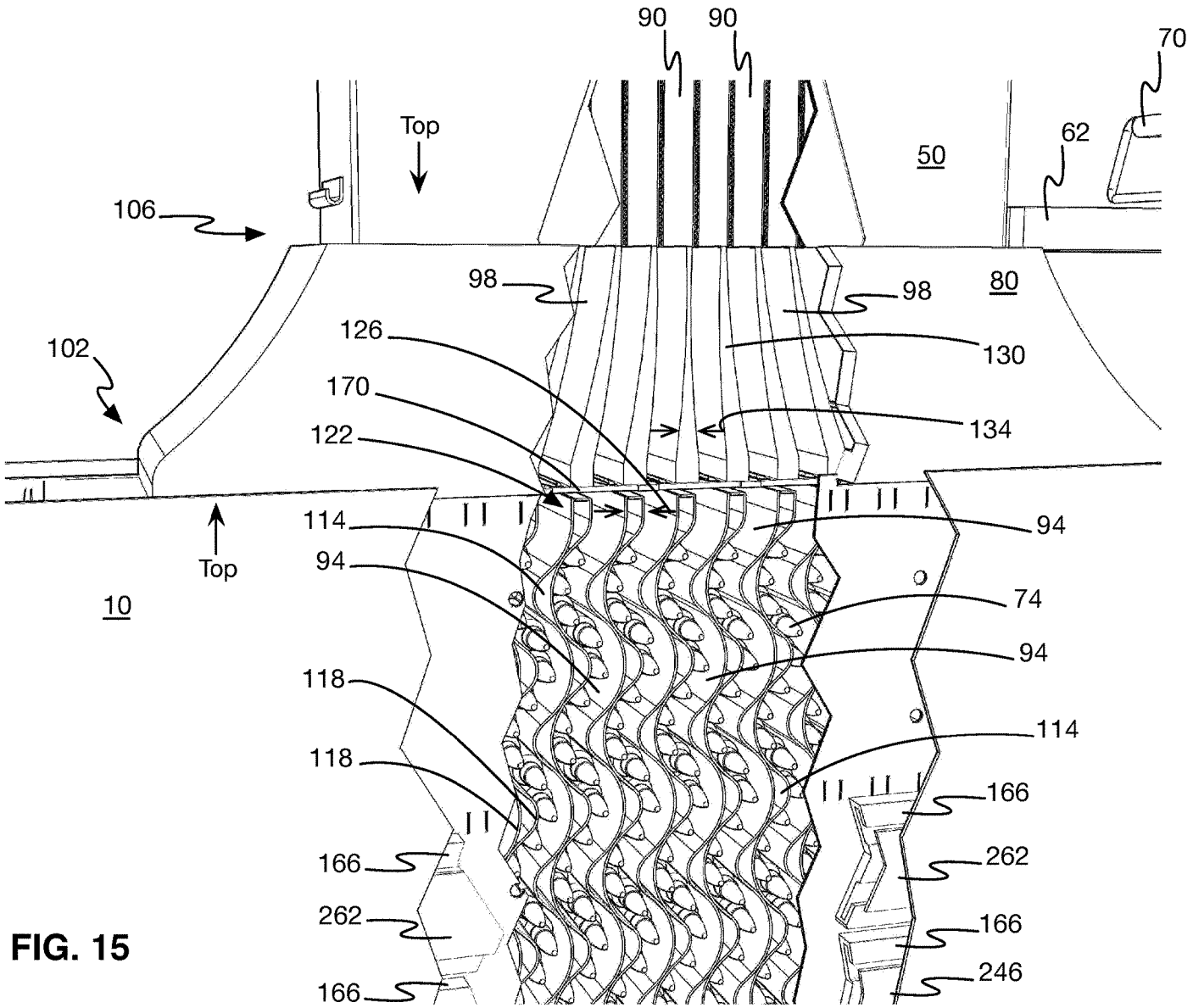
FIG. 15 is a magnified portion of the isometric view of the magazine loader, the bullets container and the adaptor of FIG. 8, where the bullets container is assembled to the adaptor and the adaptor is assembled to the magazine loader in an operating configuration with the bullets moved down in the magazine loader, in accordance with at least one embodiment thereof.
Figure 16:
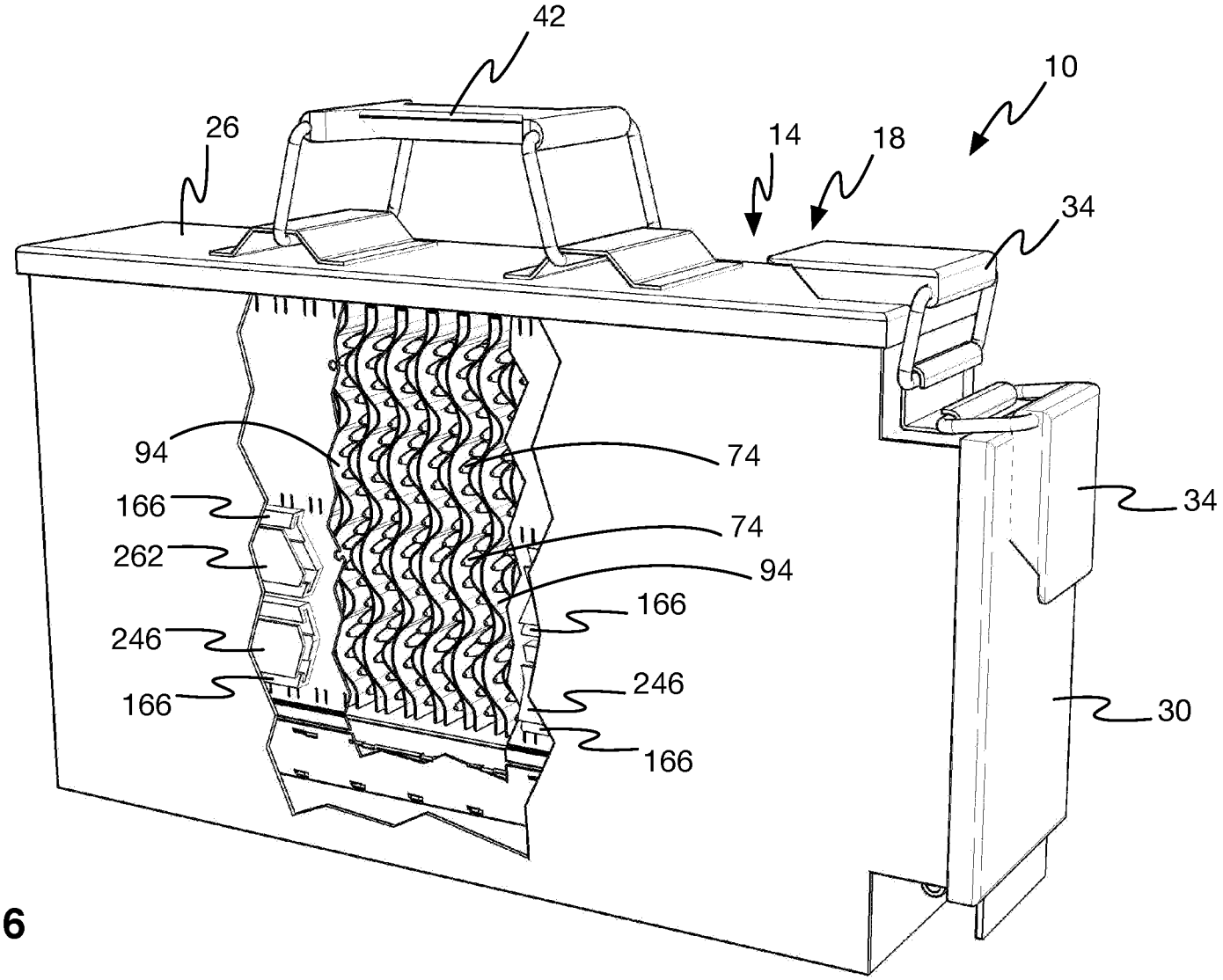
FIG. 16 is an isometric view of the magazine loader of FIG. 1, full of bullets, in accordance with at least one embodiment thereof.

As it can be appreciated from FIG. 10, FIG. 11 and FIG. 12, the second side 106 of the adaptor 80 is installed on the bullets-container 50 top opening 58, the magazine loader 10 and the bullets-container 50 connected thereto are reversed upside-down to fit the top opening 18 thereof with the first side 102 of the adaptor 80. The assembly is illustrated unsecured together however a securing mechanism can be used without departing from the teaching of the present invention. The magazine loader 10, bullets container 50 and the intervening adaptor 80 assembly is then reversed to transfer the bullets 74 from the bullets container 50 to the magazine loader 10. In that configuration, gravity is used to transfer the bullets 74 from the bullets-container 50 downwardly to the magazine loader 10, as exemplified in FIG. 12 and FIG. 13. The magazine loader 10, adaptor 80 and bullets container 50 assembly can be separated when the bullets 74 are all moved and stored in the magazine loader 10 as illustrated in FIG. 14 and FIG. 15. The magazine loader 10 can be closed with the top cover 26, as depicted in FIG. 16, and is ready for transportation and future use to load magazines 230 with the bullets 74 stored therein.

Figure 17:
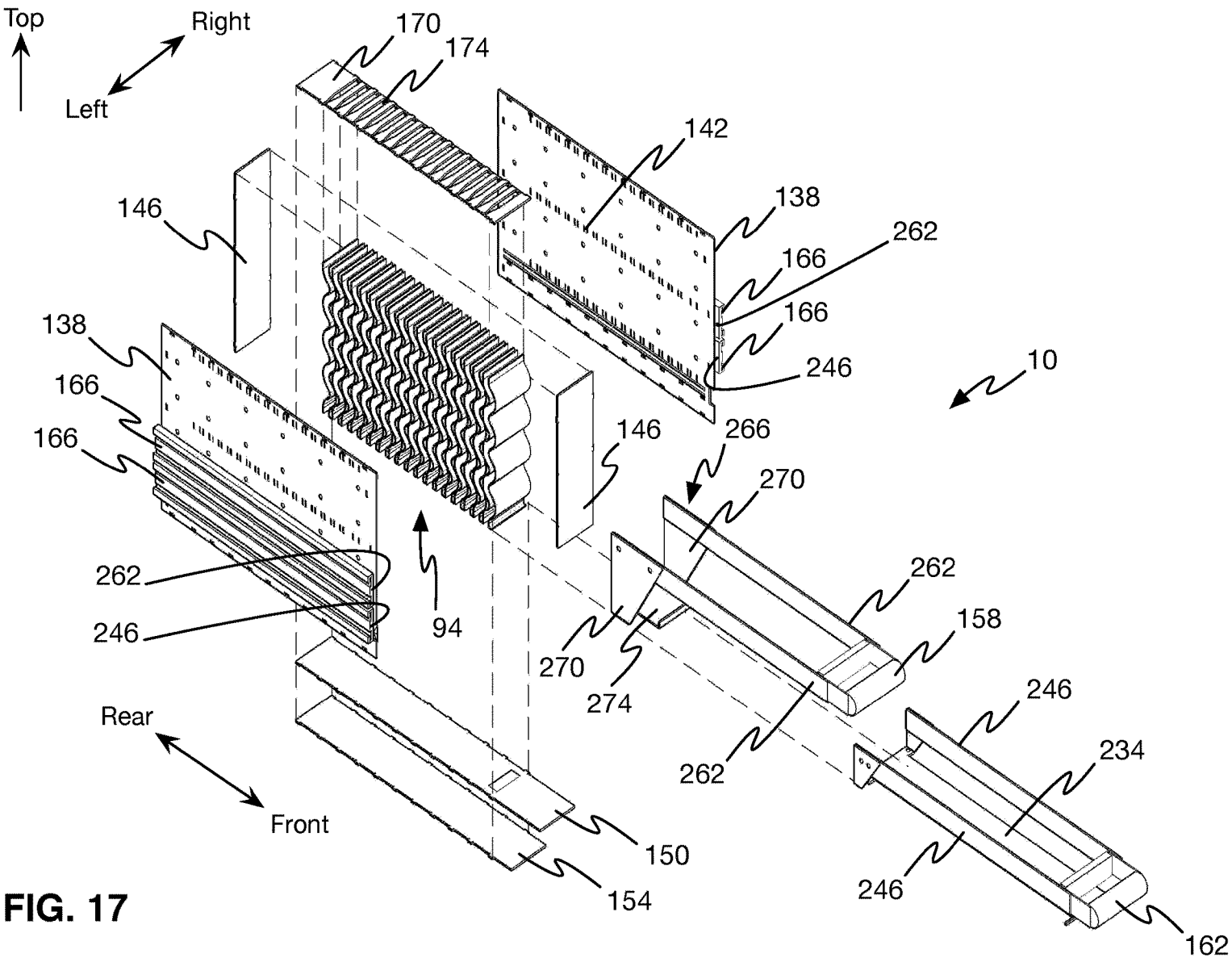
FIG. 17 is an exploded isometric view of internal components of the magazine loader of FIG. 1, in accordance with at least one embodiment thereof.

The rails 94 of the magazine loader 10 of the embodiment illustrated in FIG. 15 throughout FIG. 17 have a sinusoidal configuration. The sinusoidal configuration forces the ammunition to stay in a proper loading position as it slows down the bullets in a controlled fall and reduces the room that could, otherwise, allow the bullets to take an improper position in case of sudden movements. All ammunitions are stacked horizontally and oriented to be loaded in the receiving magazine, during rough handling. The sinusoidal configuration maintains the ammunition in the proper position without the need of a mechanical force to do so. Each rail 94 is bordered on each lateral side by a pair of guides 110, embodied as a pair of curved metal sheet layers, of a sinusoidal shape. The guides 110, in an embodiment thereof, do not have a constant thickness between them to provide rails 94 of an even width all along their lengths despite their sinusoidal configuration. In the illustrated embodiment, each guide 110 is made with a double wall 114 to allow rails 94 thickness variations. The double wall 114 can be made of a pair of aluminum sheet 118 material that is bent properly and assembled together. It can be appreciated from FIG. 15 that the upper portion 122 of the rails 94 has a significant thickness 126 that is mirrored by the thickness 134 of the slots separator 130 on the first side 102 of the adaptor 80. Similar channels 96 spacing is embodied on the second side 106 of the adaptor 80 in respect with the bullets-receiving slots 90 of the bullets container 50.

Figure 18:
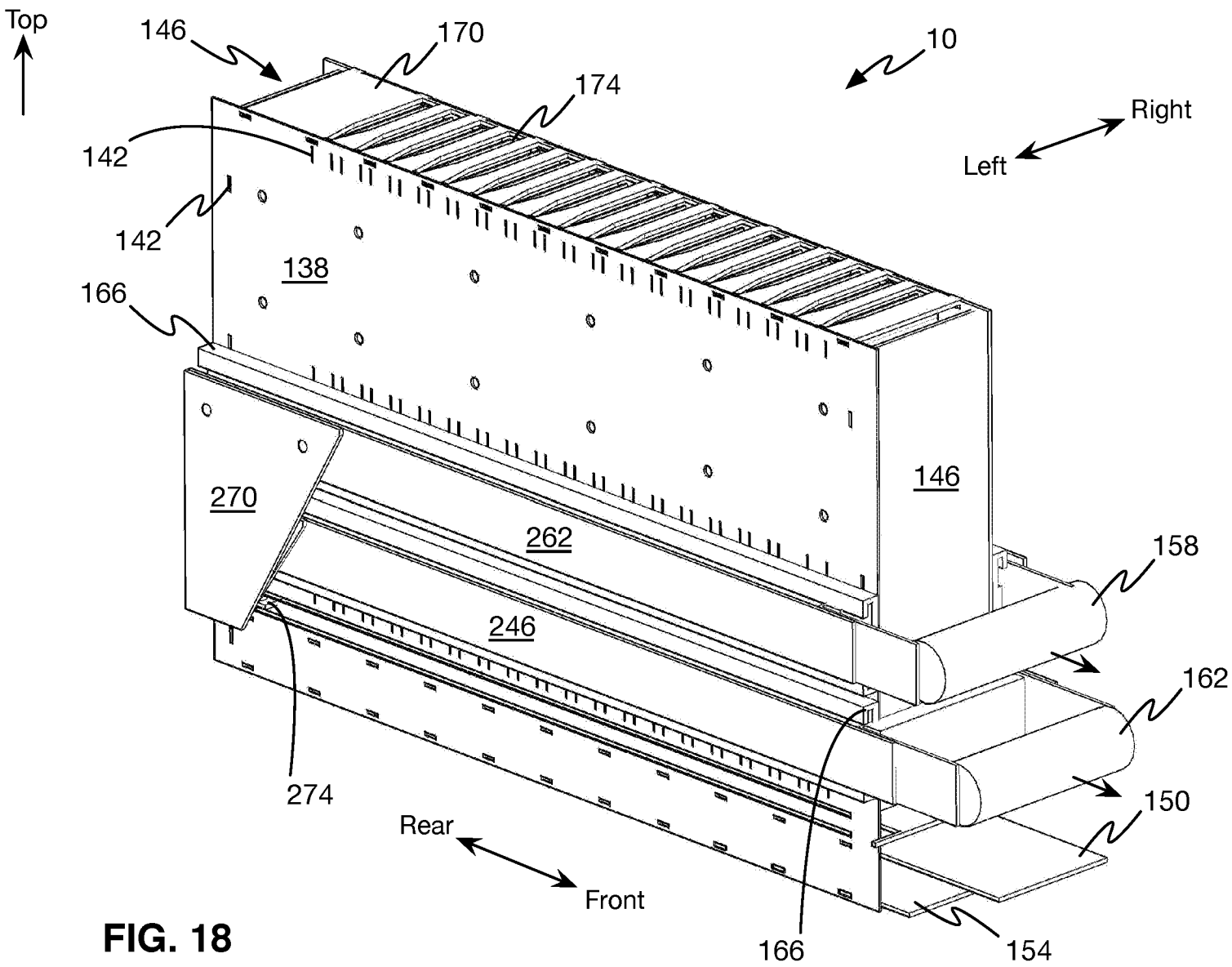
FIG. 18 is an isometric view of internal components of the magazine loader of FIG. 1, in accordance with at least one embodiment thereof.

The internal structure of the magazine loader 10 is exemplified in FIG. 17 and FIG. 18. The series of rails 94 are supported by lateral plates 138 and secured with a series of engaging openings 142. A pair of cover plates 146 are disposed between the lateral plates 138 at the front and the rear of the magazine loader 10. A first floor portion 150 and a second floor portion 154 are disposed below the series of rails 94 and are also secured in the assembly between the lateral plates 138. A first drawer 158, also referred to an actuator, and a second drawer 162 can also be appreciated in FIG. 17. The first drawer 158 and the second drawer 162 are slideably assembled with respective pairs of drawer support rails 166 disposed on external sides of the lateral plates 138. A top plate 170 is affixed on top of the lateral plates 138. The embodied top plate 170 includes an optional set of holes 174 that have the profile of the bullets 74 to ensure only bullets 74 of the intended size is going to enter the magazine loader 10 and alleviate confusion as the user can see the direction the ammunition must be facing.

Bullets 74 can be packaged in 10 rounds clips 190 in the army's current ammunition system. When the bullets 74 are coming with such clips 190, an optional bullets ram support 194 is configured to receive therein a plurality of clips 190 with bullets 74 attached thereto. The clips 190 are generally manually inserted in respective slots 198 inside the bullets ram support 194. Once filled with bullets 74, the bullets ram support 194 is installed on top of the magazine loader 10 and actuated as it will be described below. The bullets ram support 194 includes a handle portion 202 connected to a push member 206 with elongated pivot support members 210. The elongated pivot support members 210 are pivotably and slidably connected to pivot supports members 210 interconnected between a pair of plates 214 and a pair of support plates 218 to which are connected the slots 198. It can be appreciated the bullet ram support 194 includes a push member 206 sized and designed to push, preferably, on the rim (base) of the bullets 74 that are engaged in the clip 190. The push member 206 is long enough to push through the entire length of the slots 198 to empty the bullets 74 from the clips 190.

Figure 20:
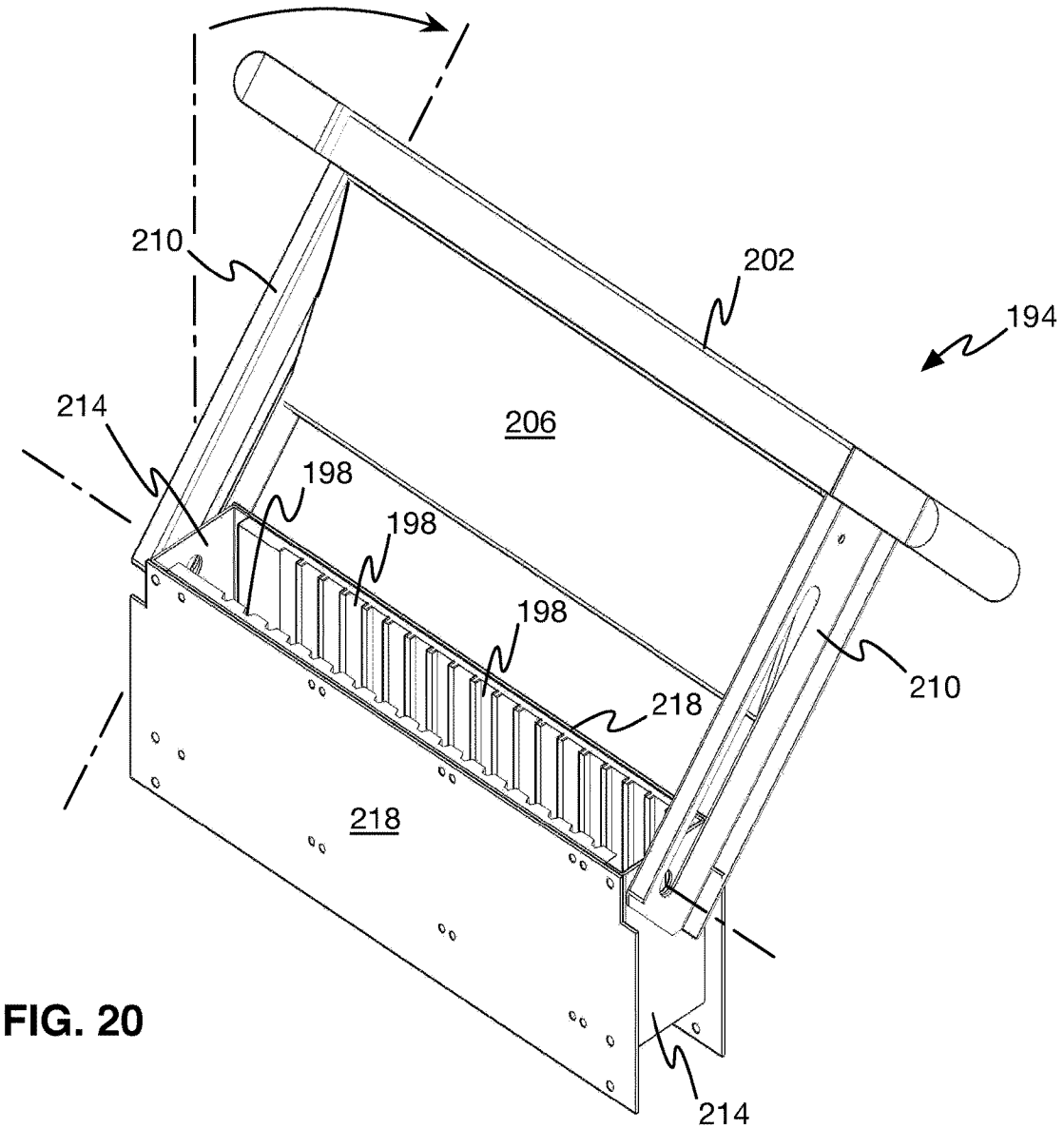
FIG. 20 is an isometric view of a bullets ram support, in accordance with at least one embodiment thereof.
Figure 21:
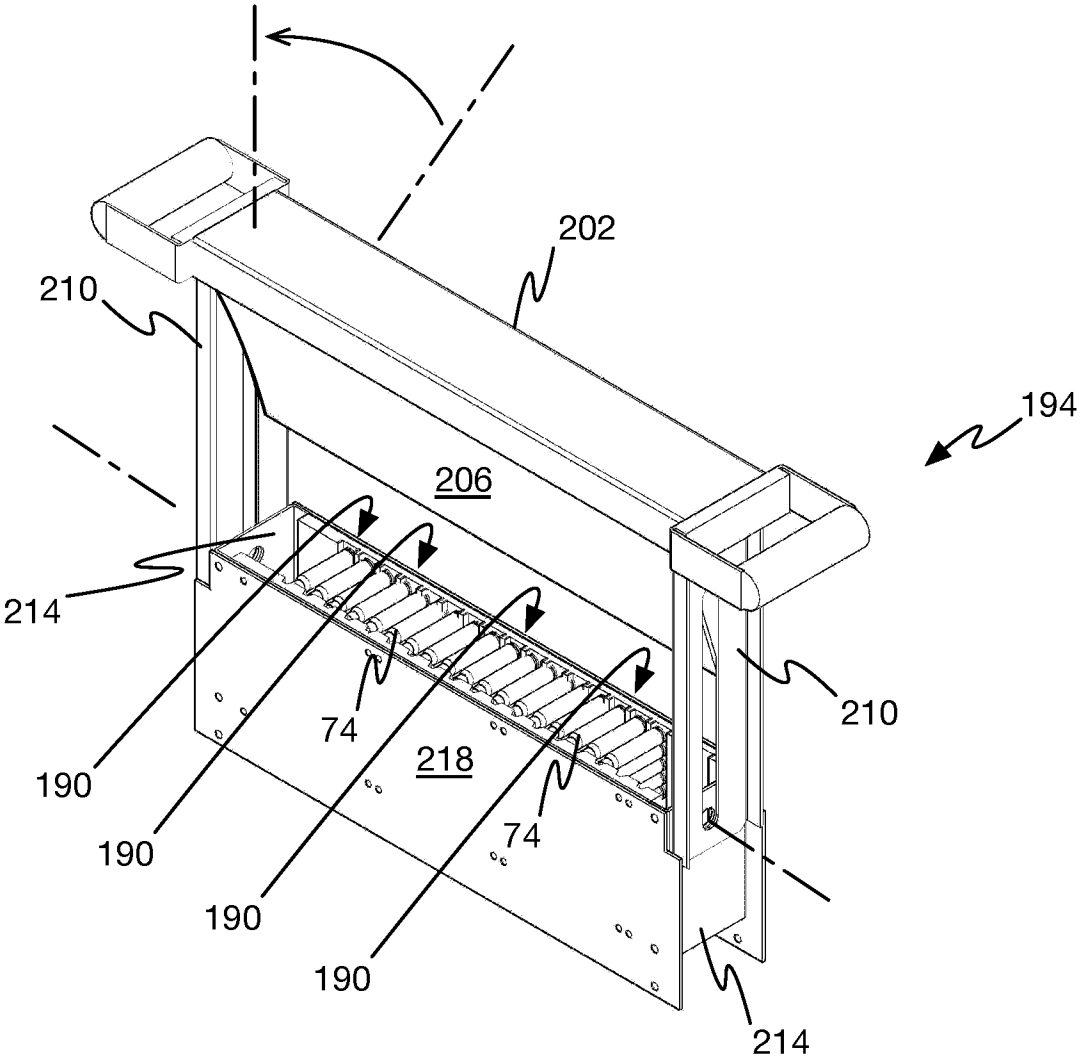
FIG. 21 is an isometric view of a bullets ram support, in accordance with at least one embodiment thereof.
Figure 22:
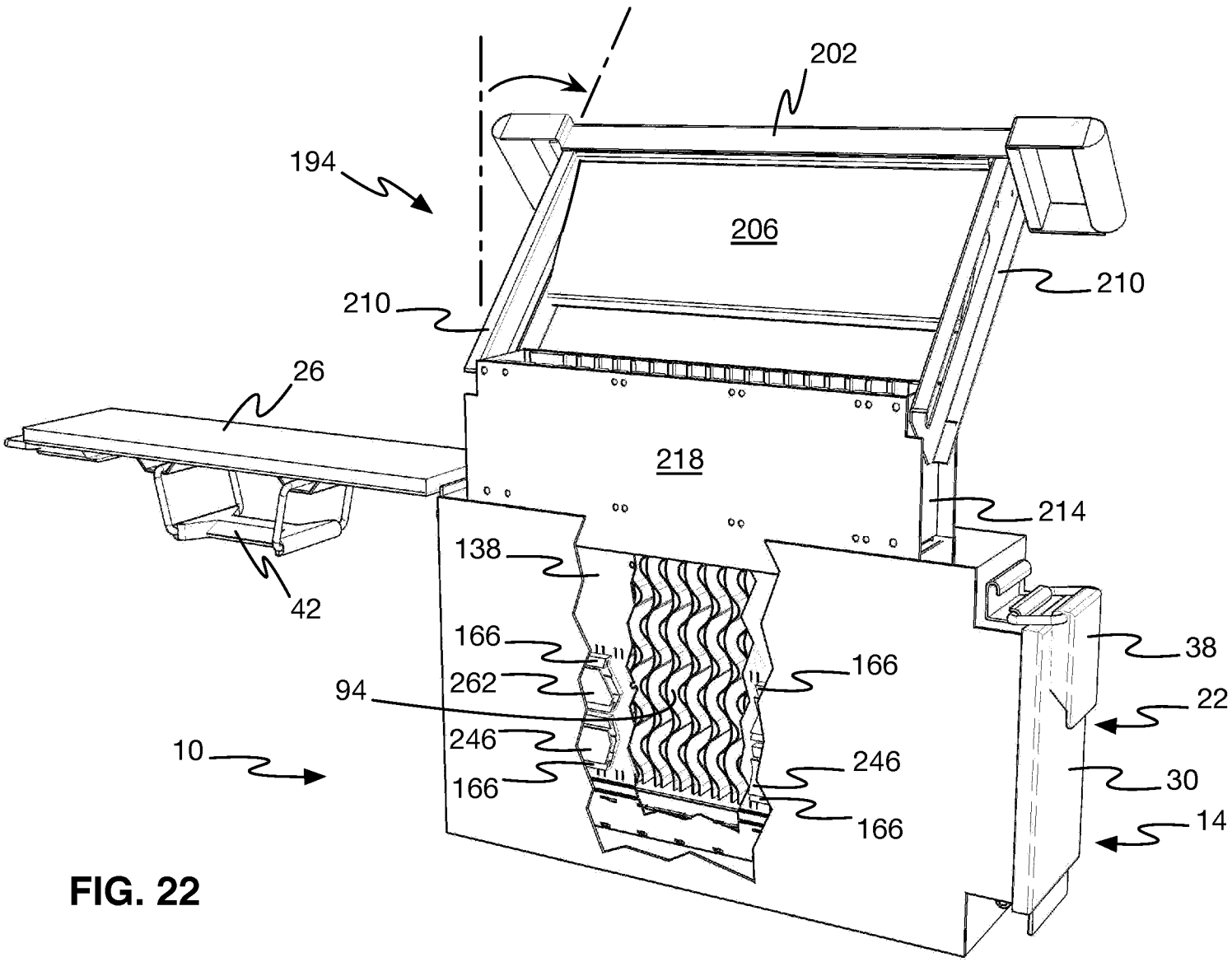
FIG. 22 is an isometric view of a bullets ram support operatively assembled to a magazine loader, in accordance with at least one embodiment thereof.
Figure 23:
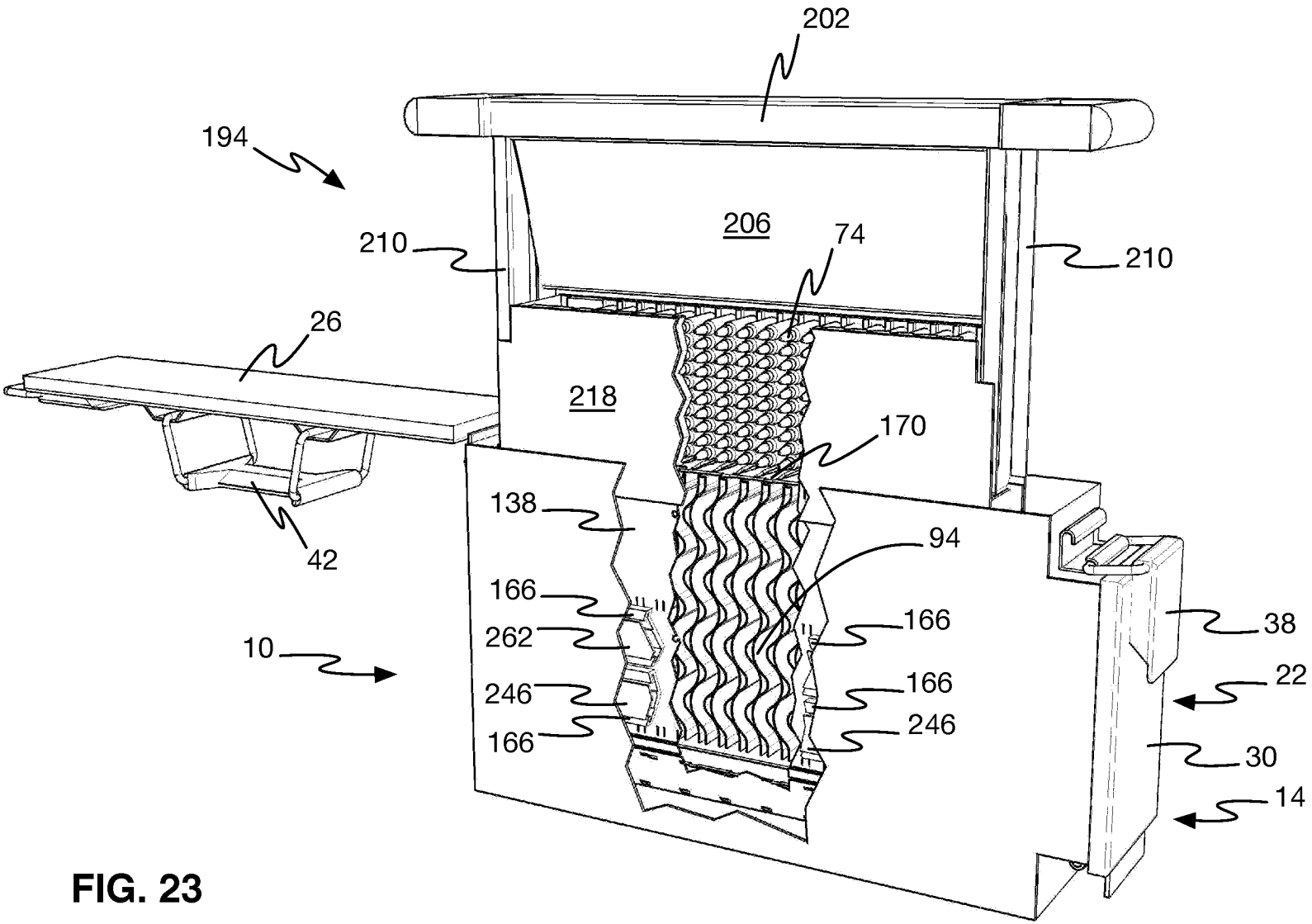
FIG. 23 is an isometric view of a bullets ram support operatively assembled to a magazine loader, in accordance with at least one embodiment thereof.
Figure 24:
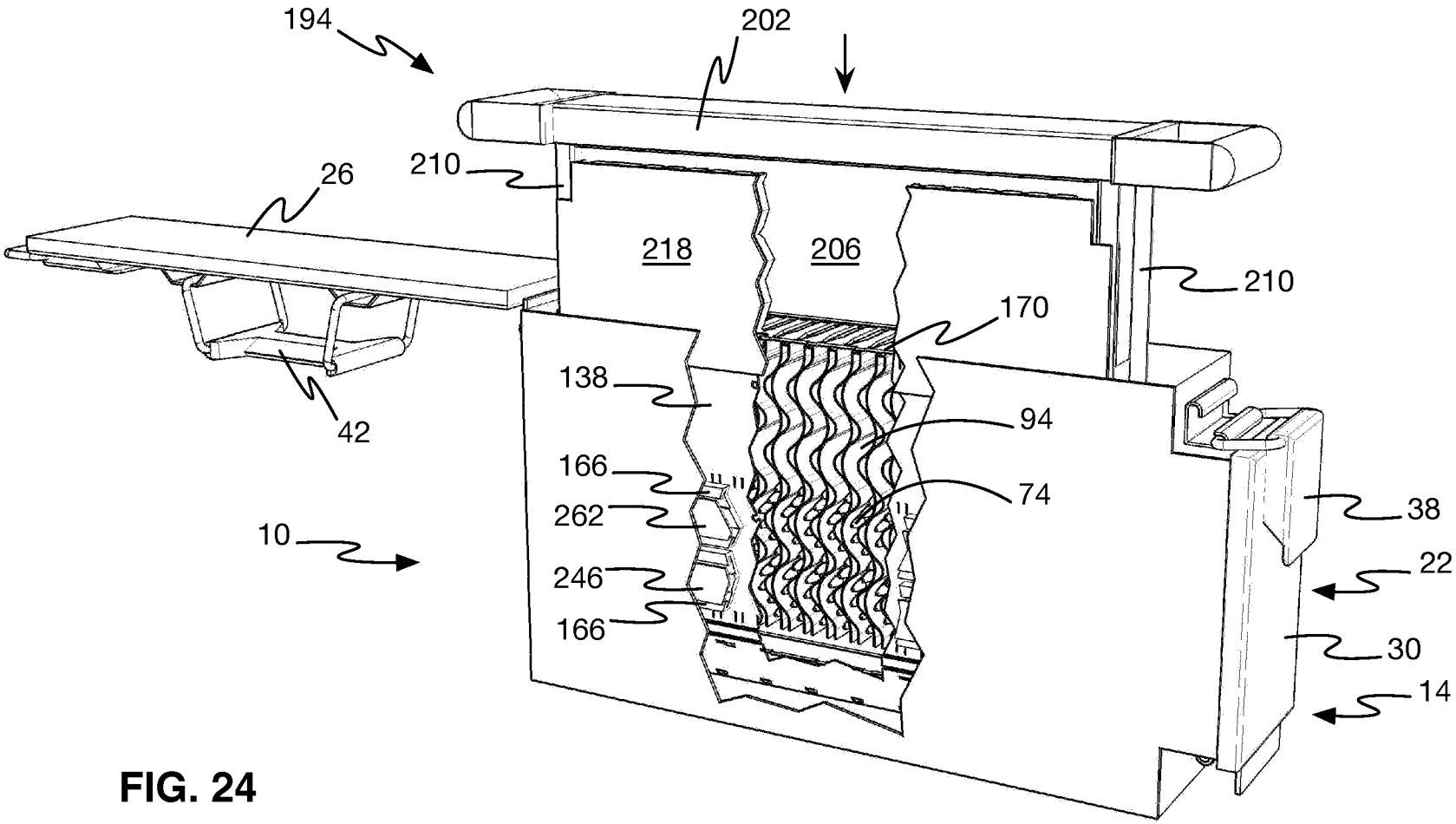
FIG. 24 is an isometric view of a bullets ram support operatively assembled to a magazine loader, in accordance with at least one embodiment thereof.
Figure 25:
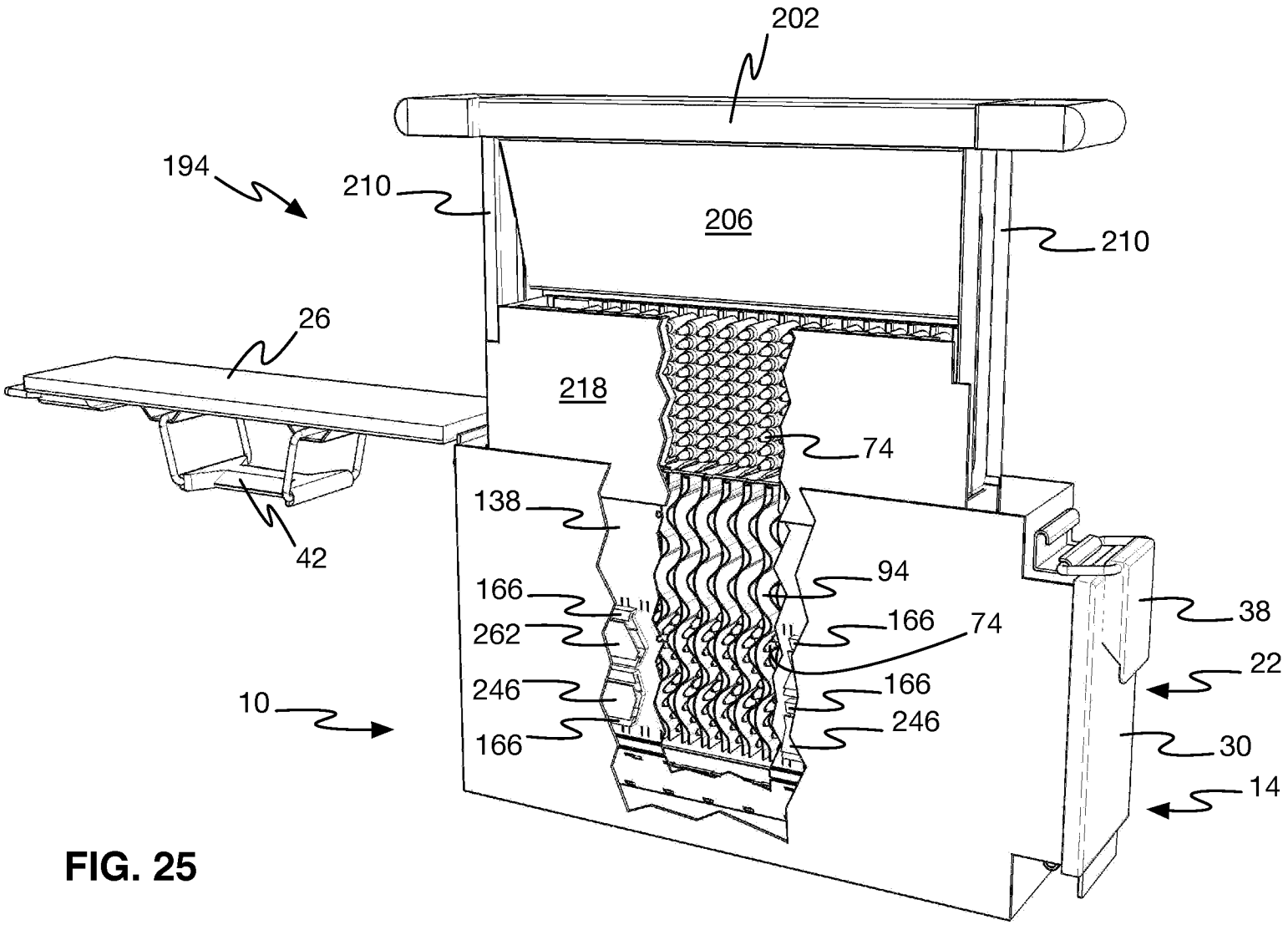
FIG. 25 is an isometric view of a bullets ram support operatively assembled to a magazine loader, in accordance with at least one embodiment thereof.
Figure 26:
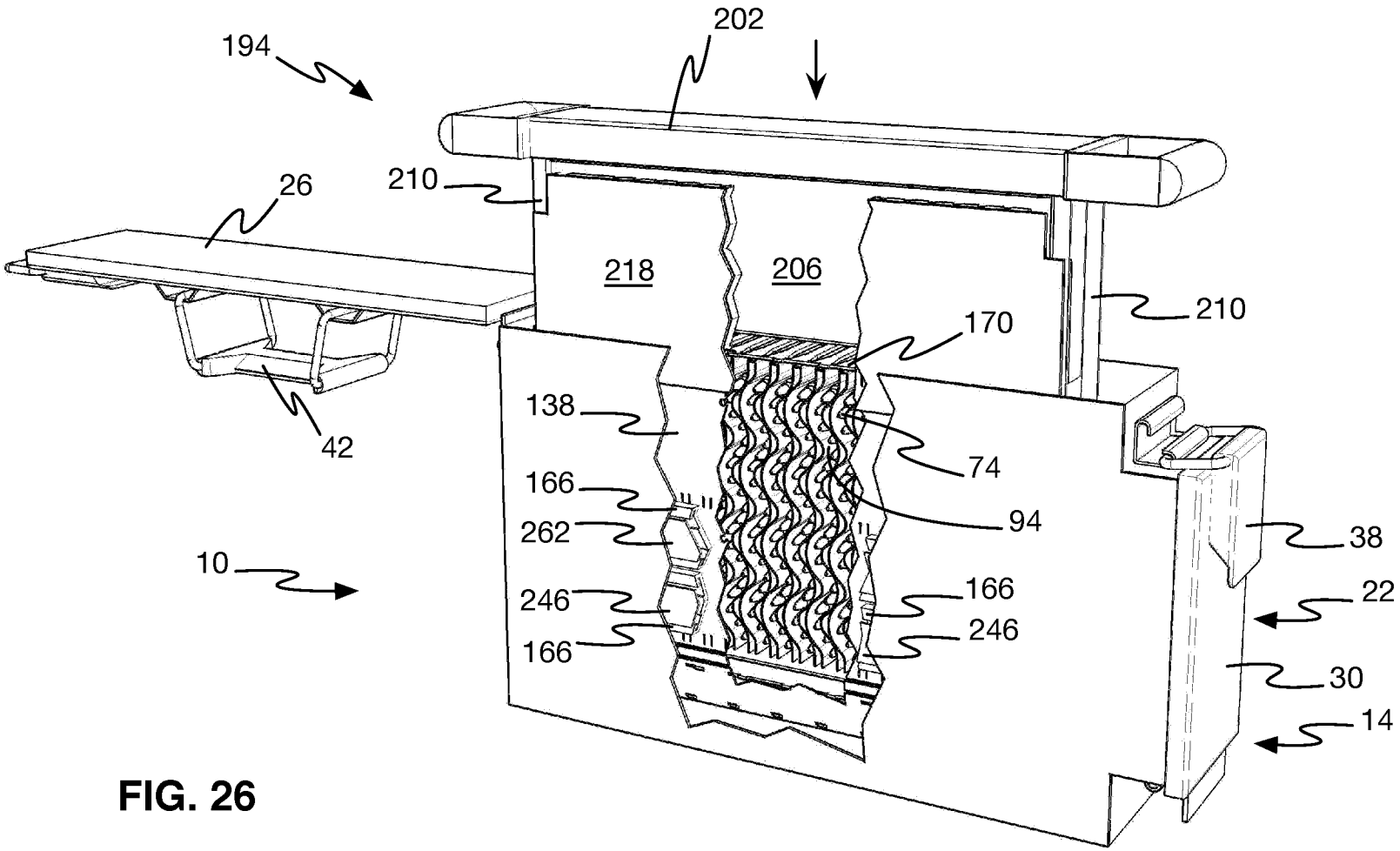
FIG. 26 is an isometric view of a bullets ram support operatively assembled to a magazine loader in the process of pushing down the bullets in the magazine loader, in accordance with at least one embodiment thereof.

FIG. 20 throughout FIG. 26 are illustrating the operating sequential steps to load the clips 190 of bullets in the bullets ram support 194. FIG. 20 illustrates the handle portion 202 can be angled to allow easy access to the slots 198 in the bullets ram support 194. After a series of clips 190 loaded with ten bullets 74 each are installed in the bullets ram support 194, the handle portion 202 is raised vertically, as illustrated in FIG. 21. The bullets ram support 194 is installed on the magazine loader 10 before pushing the handle portion 202 down toward the magazine loader 10, as illustrated in FIG. 22 and FIG. 23. FIG. 24 illustrates a first set of ten bullets 74 are pushed by the push member 206 in the magazine loader 10. The process is done another time, as shown in FIG. 25 and FIG. 26, to insert a second set of clips 190 of ten bullets 74 per rail 94, that can accommodate ten bullets 74 therein, in the magazine loader 10. The bullets ram support 194 is removed from the magazine loader 10 and the magazine loader 10 is closed for future use.

Figure 27:
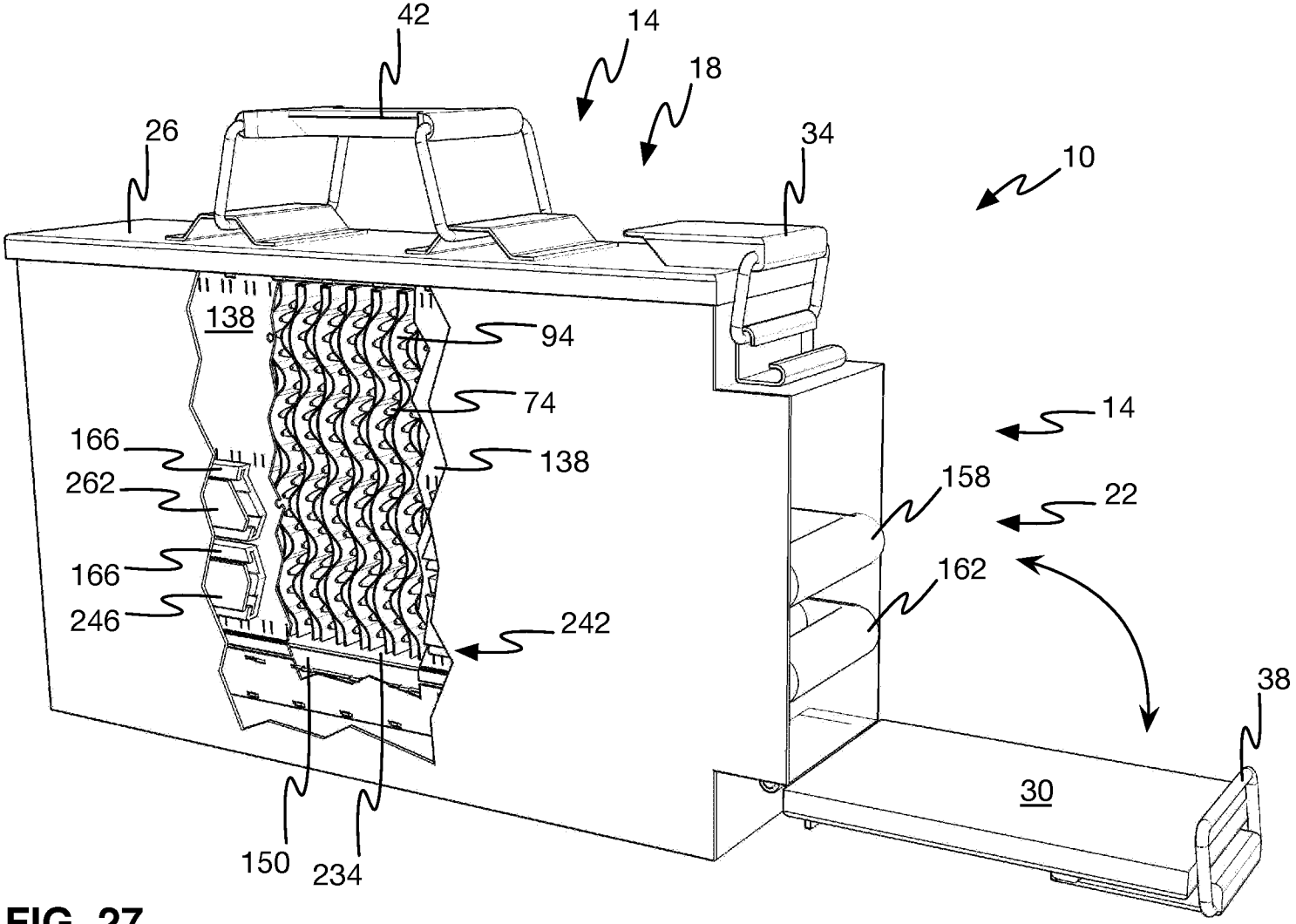
FIG. 27 is an isometric view of a magazine loader, in accordance with at least one embodiment thereof.
Figure 28:
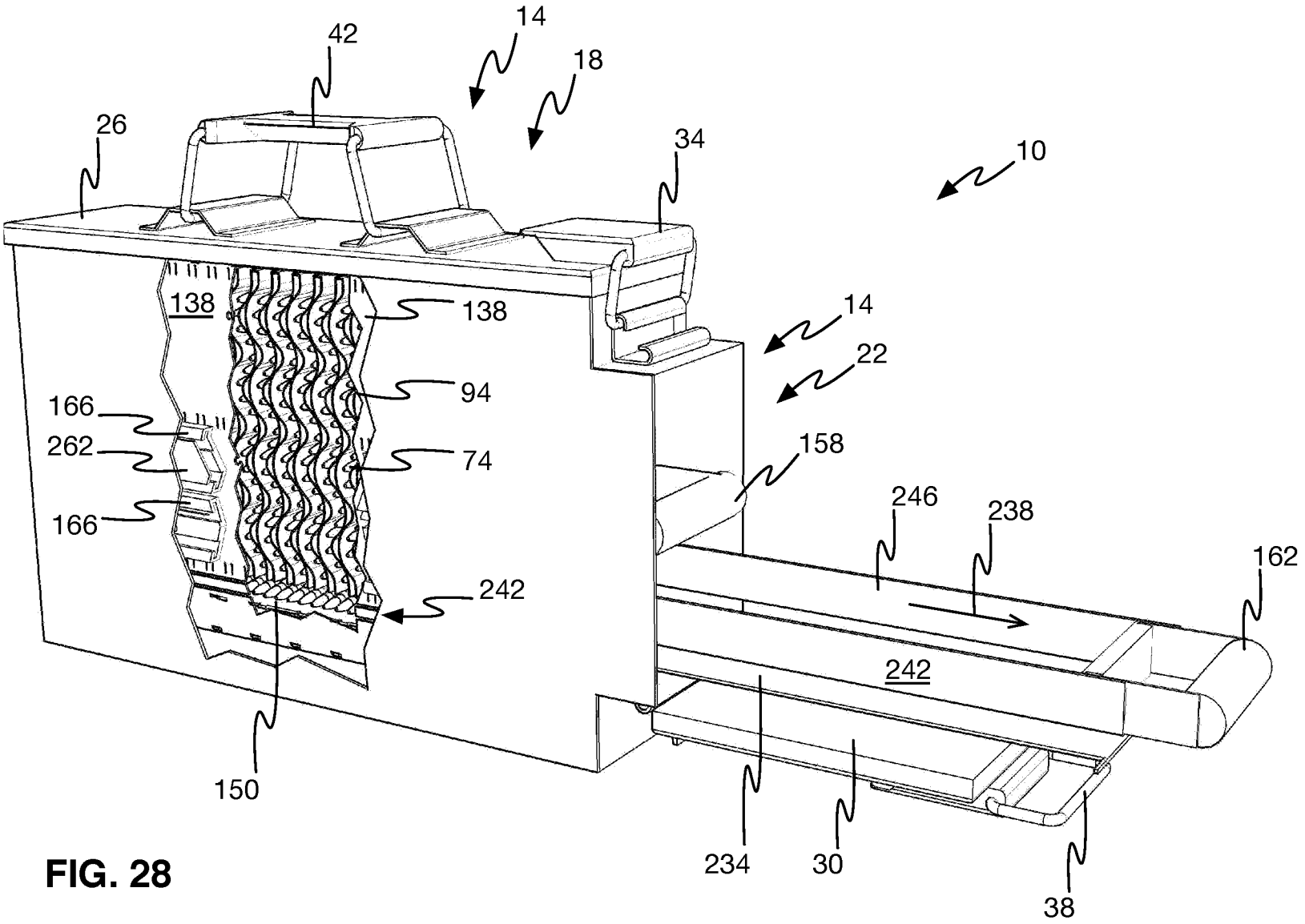
FIG. 28 is an isometric view of a magazine loader, in accordance with at least one embodiment thereof.
Figure 29:
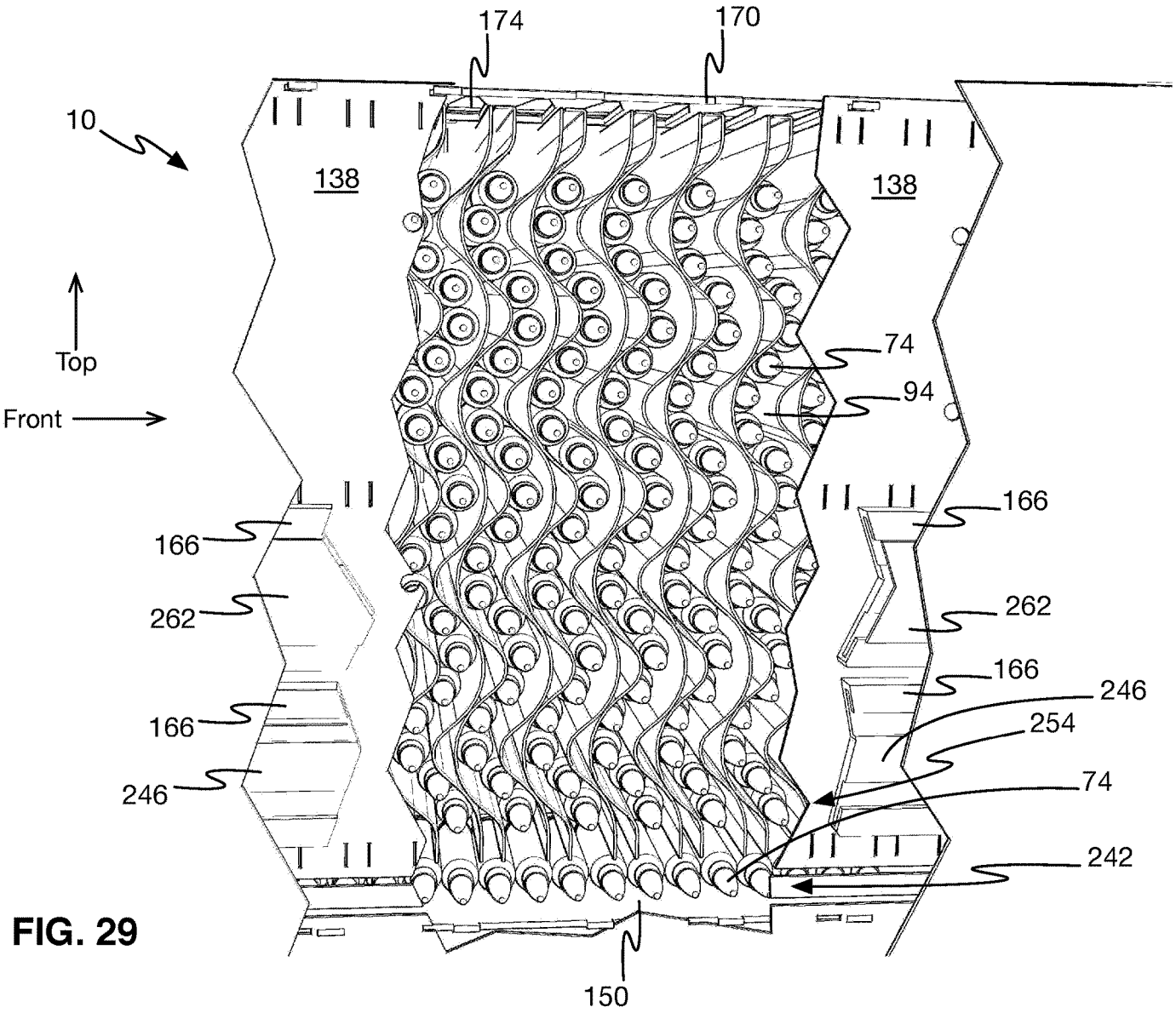
FIG. 29 is a partial front elevation view of a magazine loader, in accordance with at least one embodiment thereof.
Figure 30:
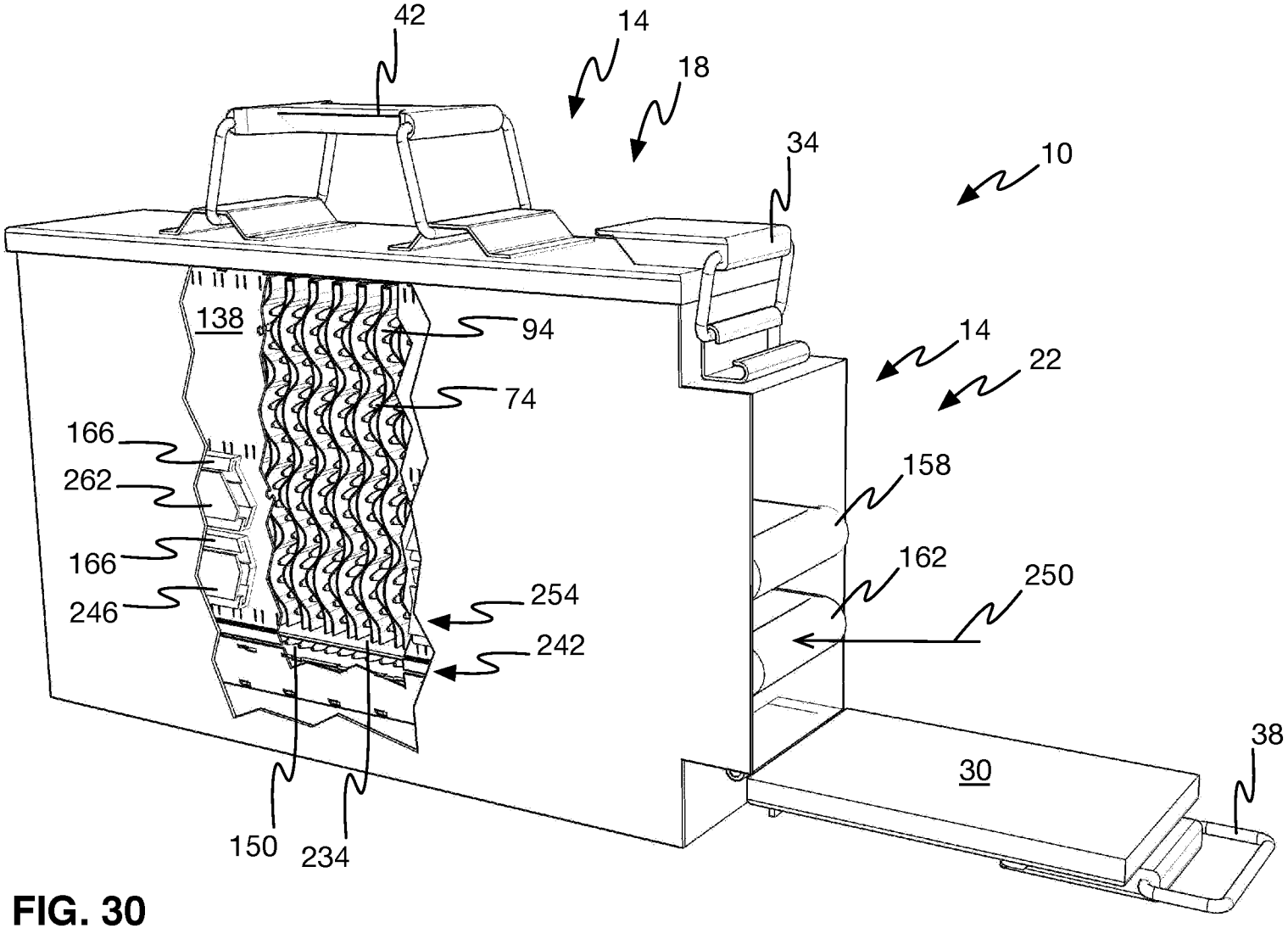
FIG. 30 is an isometric view of a magazine loader, in accordance with at least one embodiment thereof.
Figure 31:
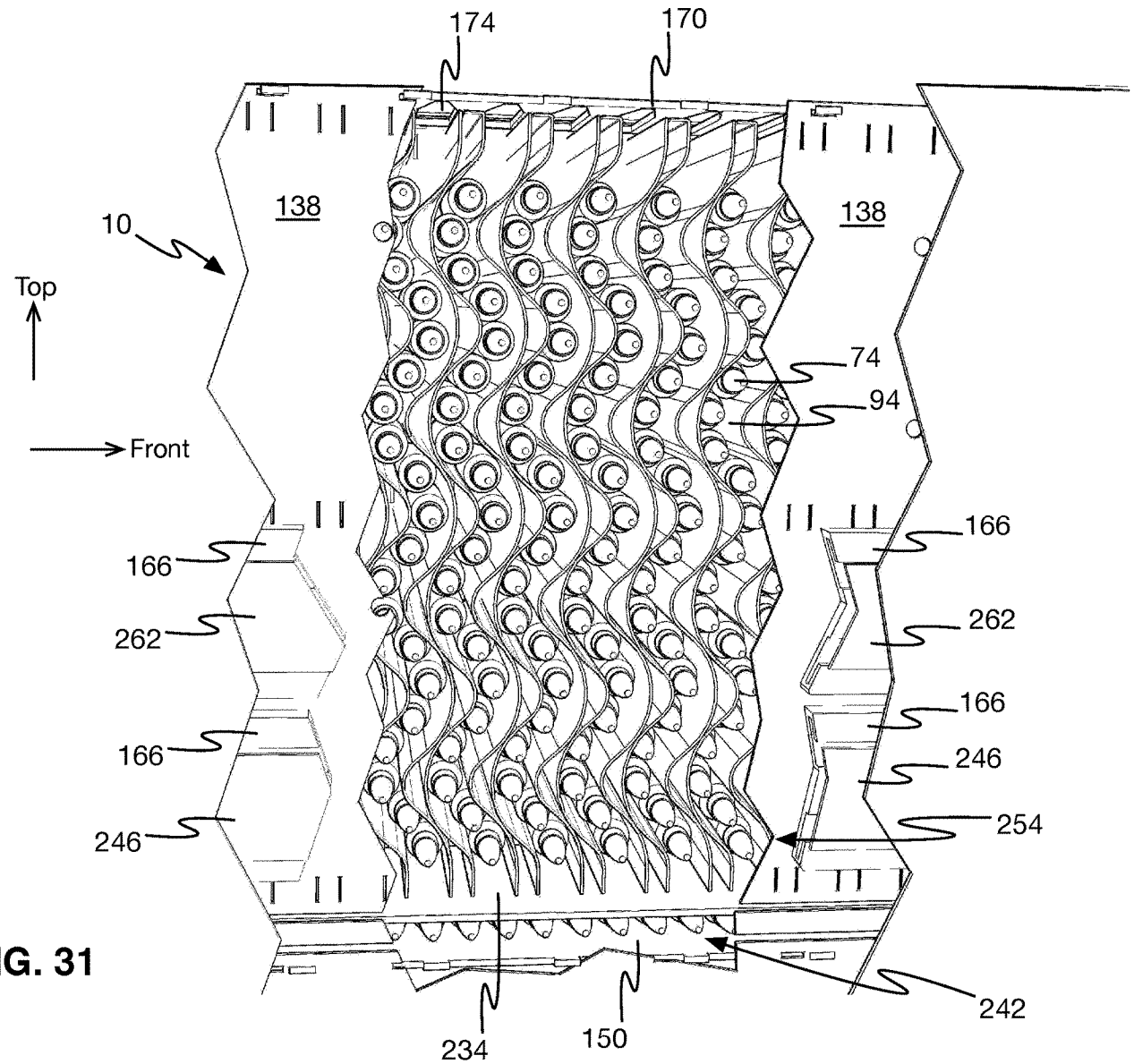
FIG. 31 is a partial front elevation view of a magazine loader, in accordance with at least one embodiment thereof.
Figure 32:
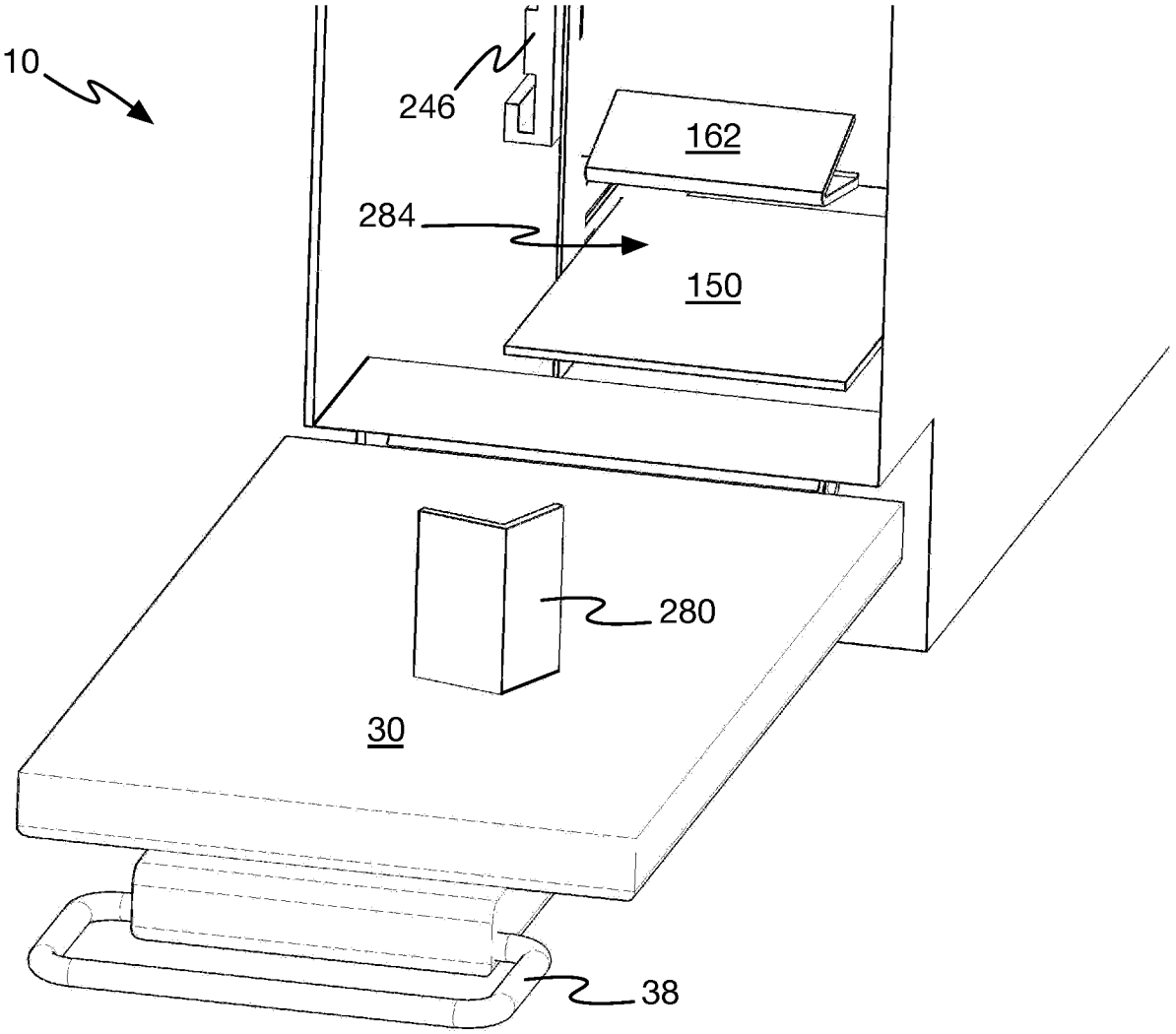
FIG. 32 is an isometric view of a portion of a magazine loader with an opened front door thereof, in accordance with at least one embodiment thereof.
Figure 35:
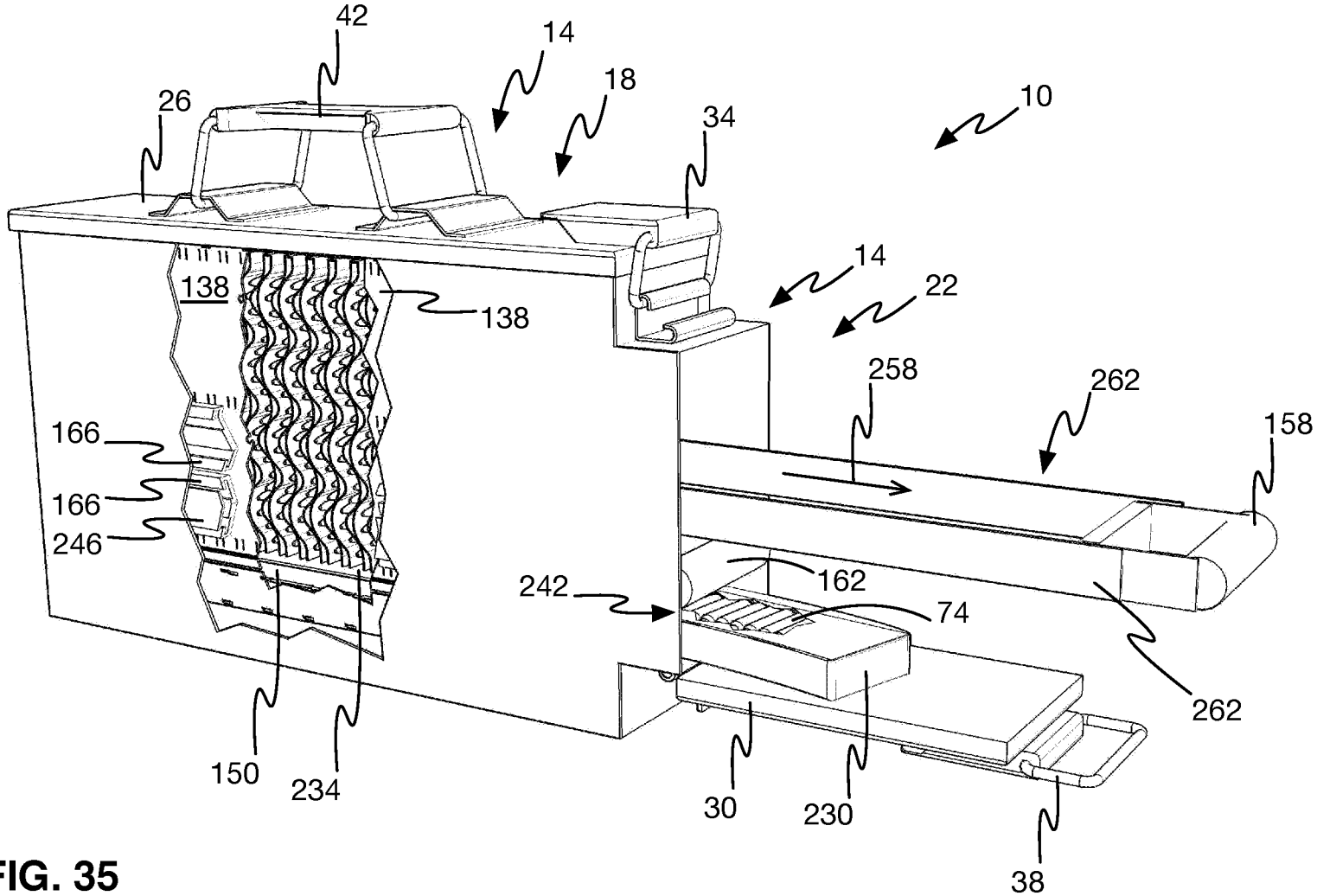
FIG. 35 is an isometric view of a magazine loader with a magazine secured in an operating configuration thereof, in accordance with at least one embodiment thereof.
Figure 36:
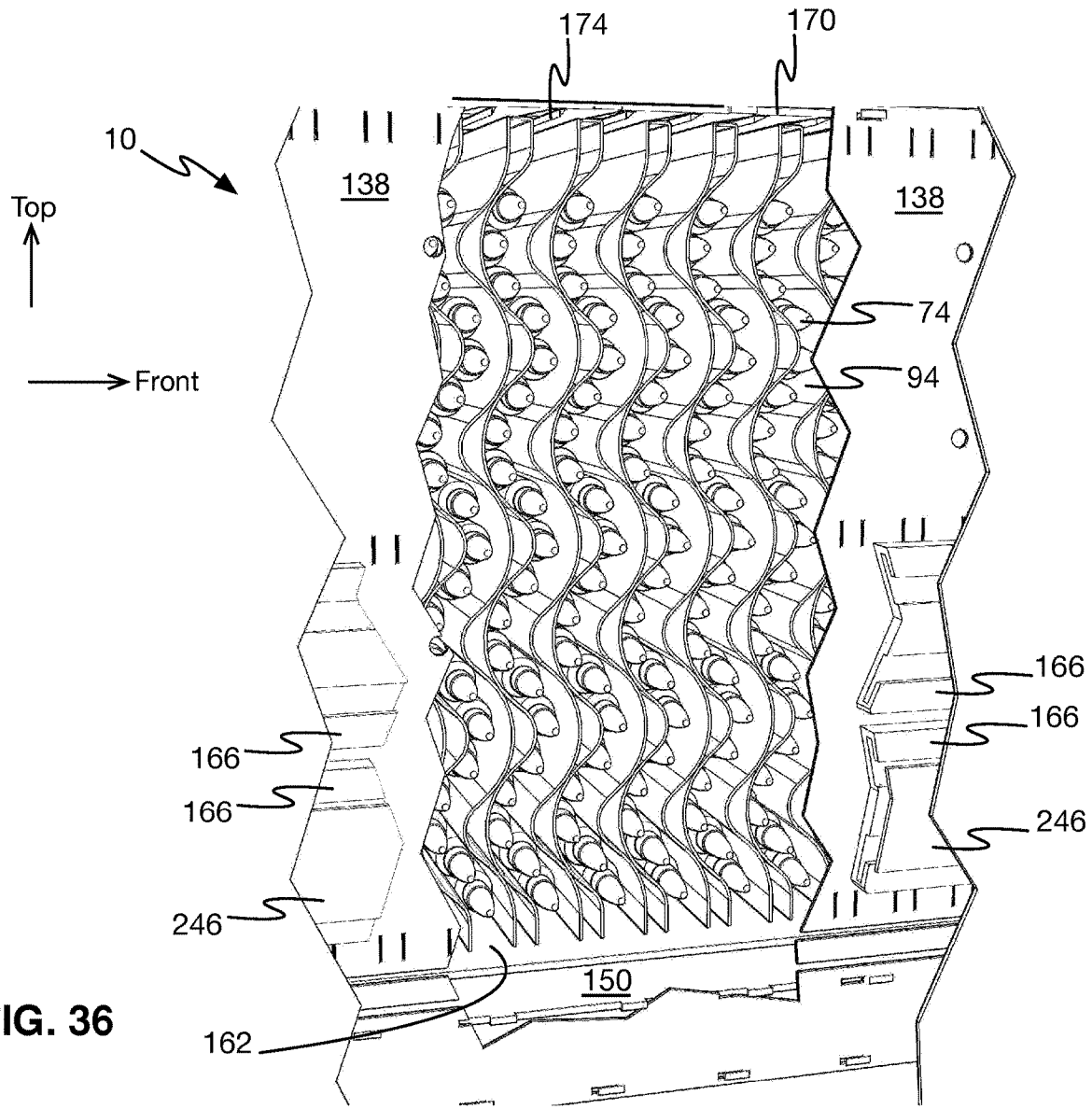
FIG. 36 is a partial front elevation view of a magazine loader, in accordance with at least one embodiment thereof.
Figure 37:
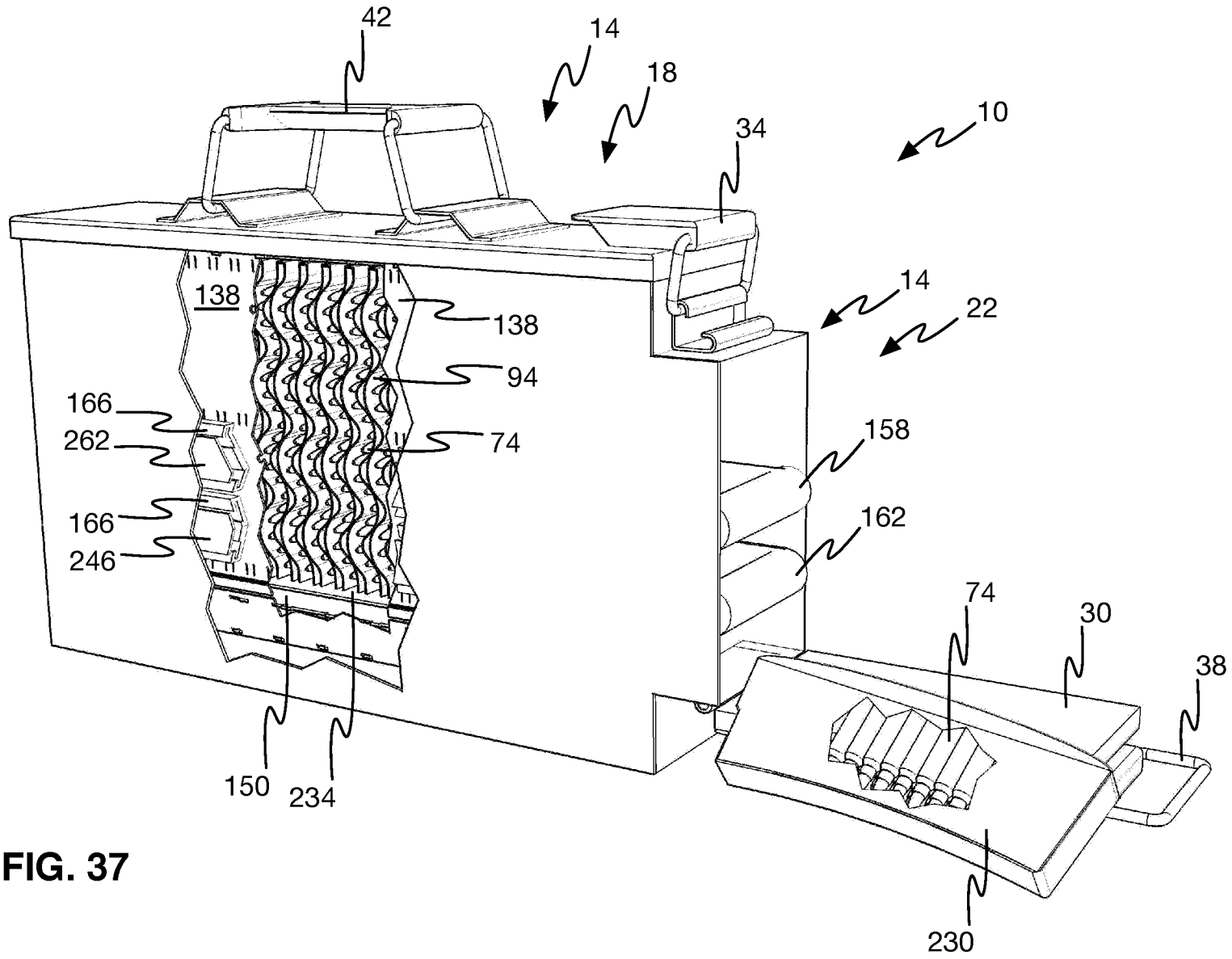
FIG. 37 is an isometric view of a magazine loader with a detached magazine full of bullets, in accordance with at least one embodiment thereof.

FIG. 27 throughout FIG. 35 are exemplifying loading a magazine 230 with the magazine loader 10. The front cover 30 is opened to allow access to the front opening 22 where a user can operatively secure the magazine 230 to the magazine loader 10 to be filled with bullets 74. A retaining floor 234 of the second drawer 162 is preventing bullets 74 in the rails 94 to fall below the rails 94 in the configuration illustrated in FIG. 27. The second drawer 162 is pulled 238 outside the front opening 22 to allow the lower bullet 74 of each of the rail 94, forming a row of thirty bullets 242, to move lower than the rails 94 and be retained by the first floor portion 150, as illustrated in FIG. 28 throughout FIG. 32. It can be appreciated the lateral supports 246 of the second drawer 162 are engaging in a slideable manner with corresponding drawer support rails 166 hence allowing movements of the second drawer 162. The second drawer 162 is then pushed back 250 into the magazine loader 10 and the retaining floor 234 is separating the lower row of bullets 242 from the second row 254 of bullets 74 adjacent above each respective bullet 74 of the lower row of bullets 242.

Figure 33:
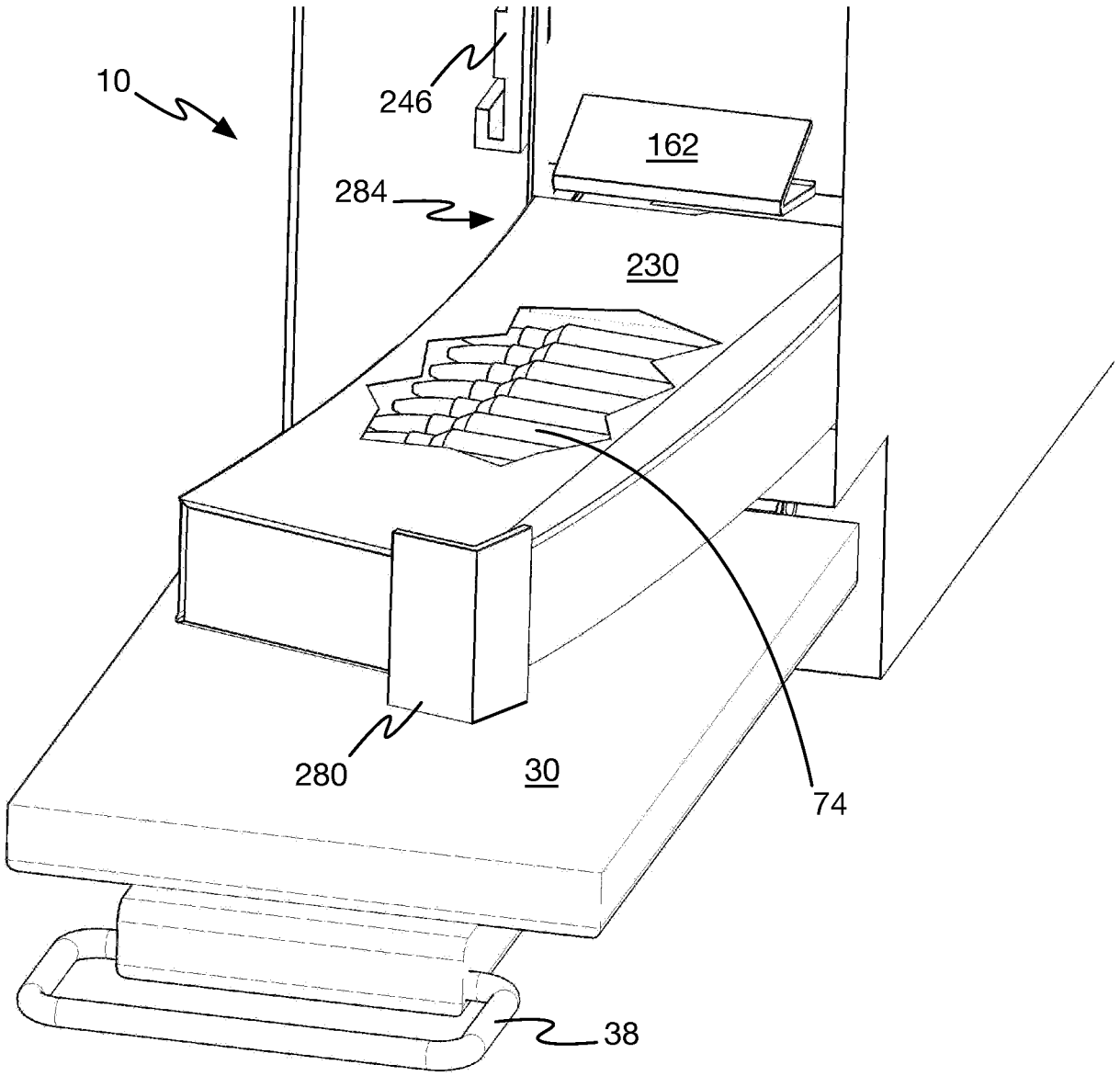
FIG. 33 is an isometric view of a portion of a magazine loader with a magazine secured in an operating configuration thereof, in accordance with at least one embodiment thereof.
Figure 34:
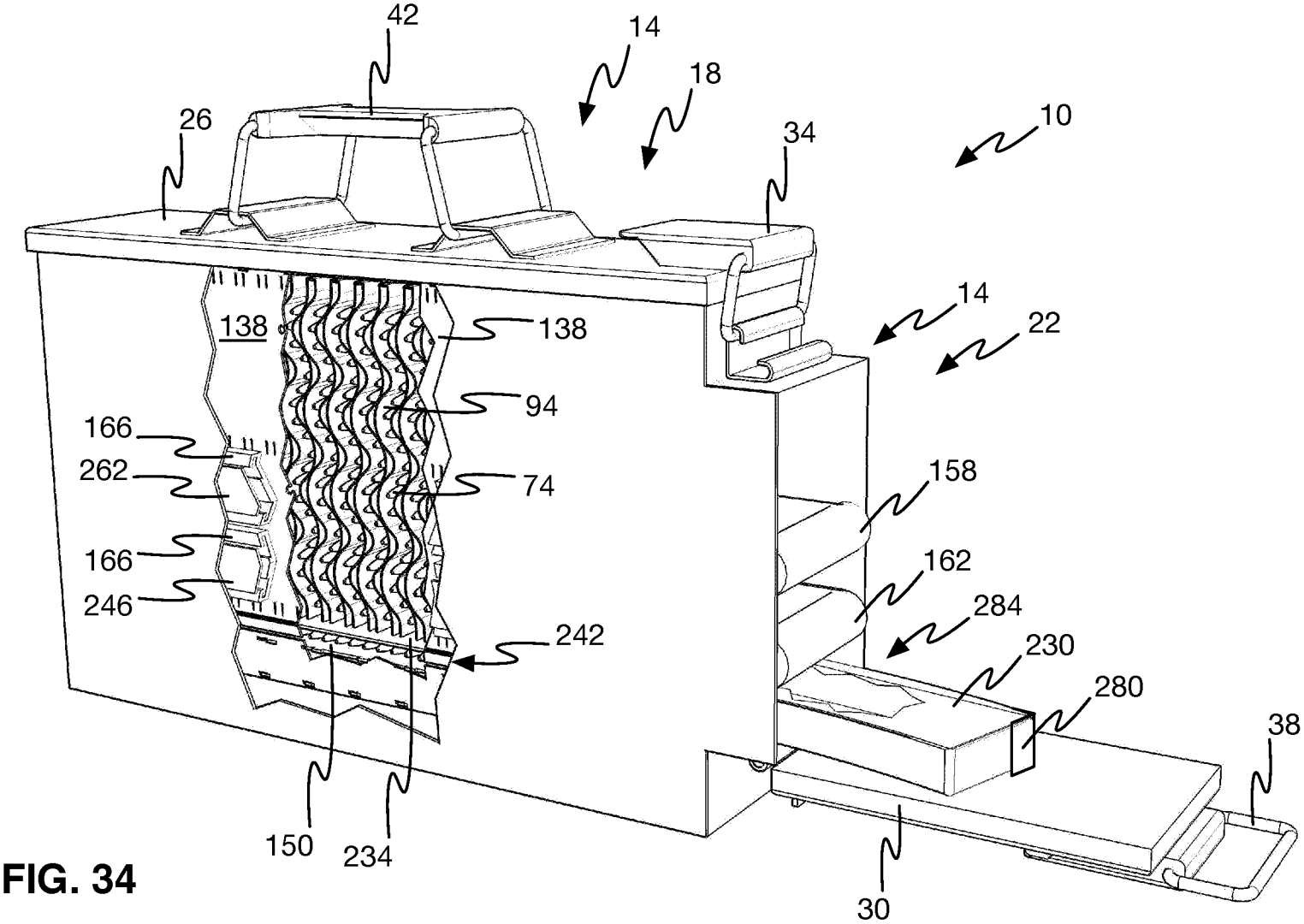
FIG. 34 is an isometric view of a magazine loader with a magazine secured in an operating configuration thereof, in accordance with at least one embodiment thereof.

In reference with FIG. 34, a magazine 230 is secured in the front opening 22 in an aligned position suitable to receive therein the lower row 242 of thirty bullets 74. The transfer of the lower row 242 of bullets 74 from the magazine loader 10 to the magazine 230 is made by pulling 258 the first drawer 158. Pulling 258 the first drawer 158 is allowed by the slideable engagement of the pair of lateral supports 262 with corresponding drawer support rail 166. The first drawer 158 includes, as best seen in FIG. 17, a rear portion 266 equipped with a pair of downward extending arms 270 securing a push member 274 thereof designed in a fashion adapted to contact the row of bullets 74 adequately for moving the row of bullets 74 in the magazine 230. The push member 274 is abutting the lower row 242 of bullets 74 and is pushing the bullets 74, as an actuator, guided by the retaining floor 234 and the first floor portion 150, into the magazine 230. The fully loaded magazine 230 is illustrated in FIG. 35. It can be appreciated the magazine 230 loading is made in a single operation, when pulling the first drawer 158. This is a quick, safe and efficient way to load a magazine 230 with a plurality of bullets 74. A magazine retainer 280 is optionally disposed on the interior portion of the front cover 30 to secure the magazine 230 in place when loading it with bullets 74 as depicted in FIG. 33 and FIG. 34. The opened end of the magazine 230 is inserted or abutted to a magazine receptacle 284 preferably aligned with a lower row of bullets 242 for easy insertion of the bullets 74 in the magazine 230.

Figure 38:
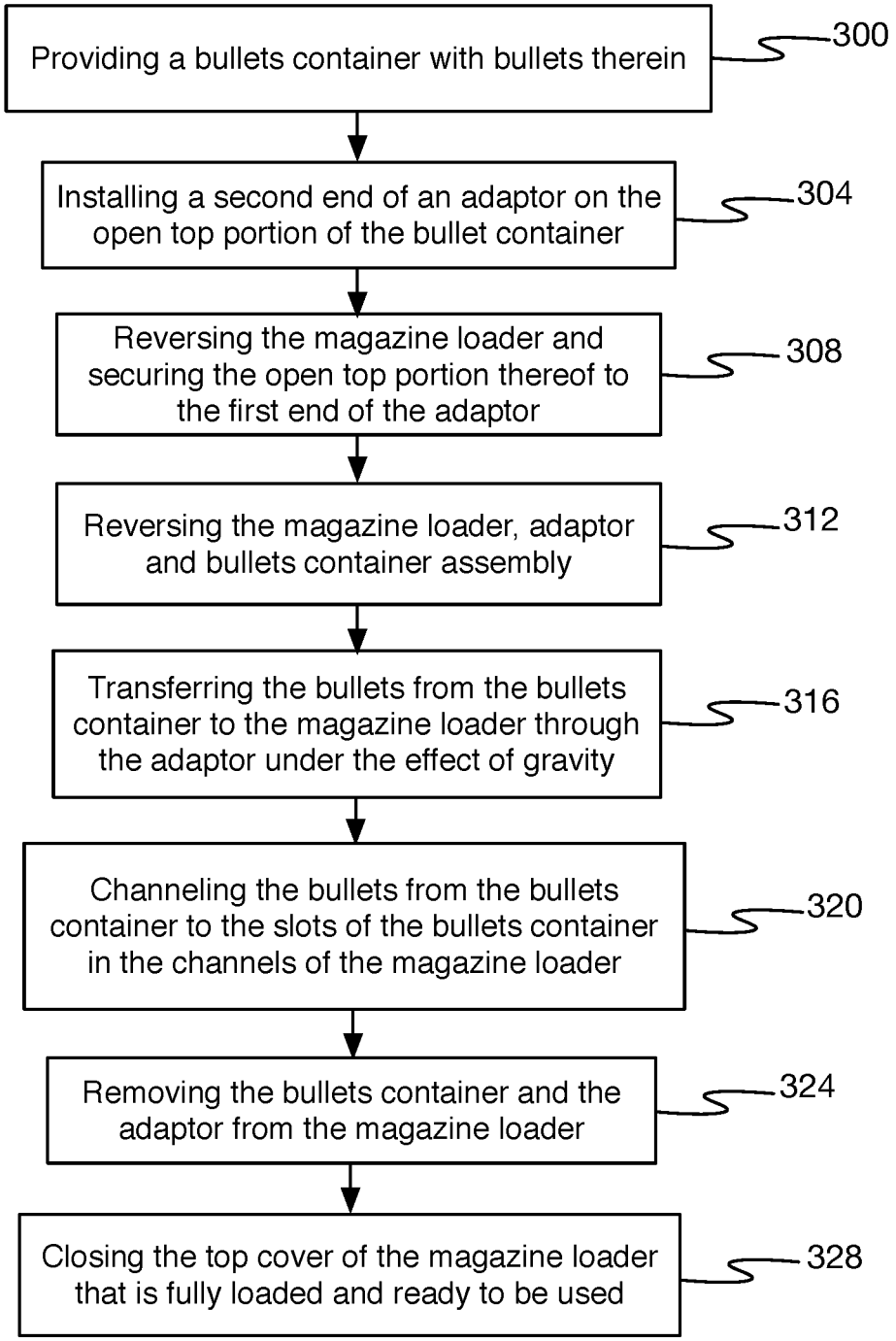
FIG. 38 is flow chart describing the steps in the process of loading the magazine loader with a bullet container and an adaptor.

Step 300 throughout step 328 of FIG. 38 illustrate an exemplary process of loading the magazine loader 10 with a bullet container 50 and using an adaptor 80. The illustrative process begins by providing a bullets container 50 with bullets 74 therein at step 300 and installing a cooperating end of the adaptor 80 on the open top portion of the bullet container 50 at step 304. Step 308 reverses the magazine loader 10 and securing the open top portion thereof to the first end of the adaptor 80 to be able to reverse collectively the magazine loader 10, the adaptor 80 and the bullets container 50 at step 312 to transfer the bullets 74 from the bullets container 50 to the magazine loader 10 through the adaptor 80 under the effect of gravity as illustrated in steps 316 and 320. The bullets container 50 and the adaptor 80 are removed in step 324 from the magazine loader 10 to be able to close the top cover of the magazine loader 10 to be used for charging magazines 230.

Figure 39:
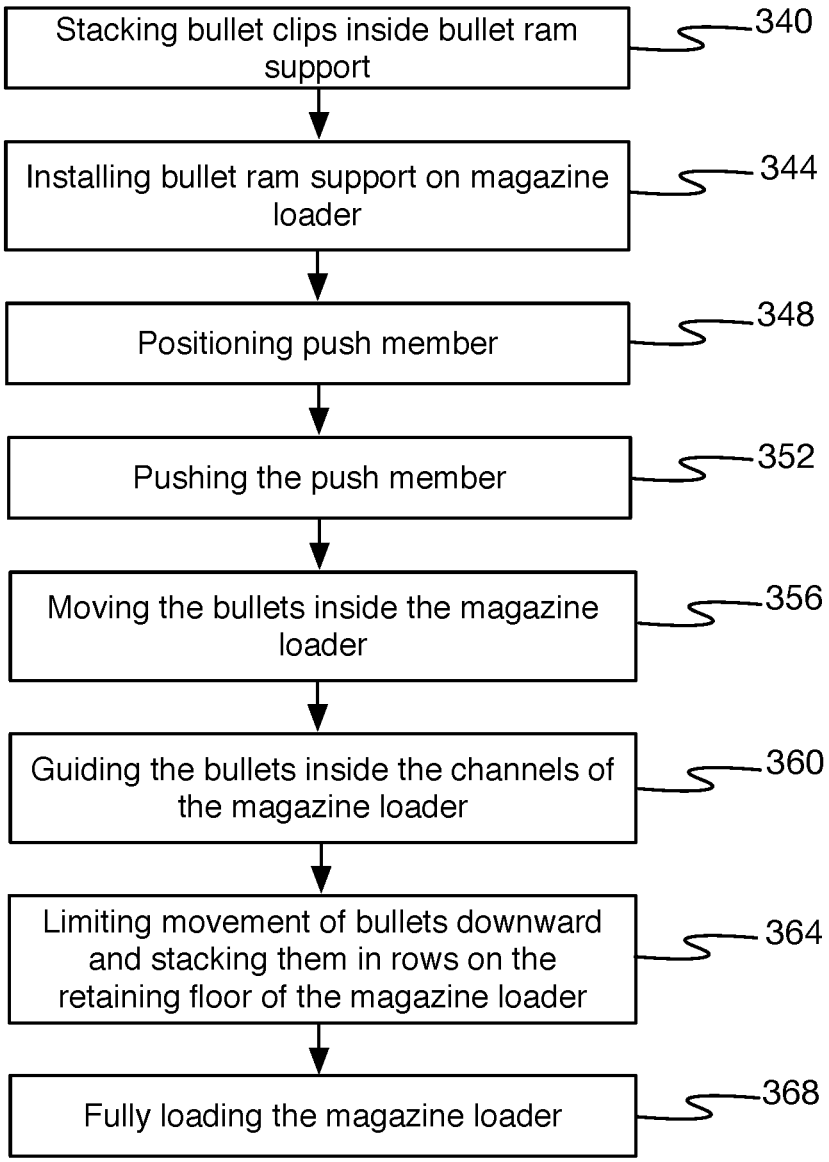
FIG. 39 is flow chart describing the steps in the process of loading the magazine loader with a bullet ram support.

Step 340 throughout step 368 in FIG. 39 illustrate the process of loading the magazine loader 10 with ten-rounds clips of bullets 74 using a bullet ram support 194. Indeed, the following steps can be exemplary performed as follows: Stacking bullet clips 190 inside the bullet ram support 194 in step 340 followed by installing the bullet ram support 194 on the magazine loader 10 in step 344 to then position the push member 206 at step 348 to be able to push the push member at the following step 352 to move the bullets inside the magazine loader 10 at step 356. Step 360 indicates the bullets are then guided inside the channels of the magazine loader 10 limited by the first floor portion 150, if the first drawer 158 is not pulled out, of the magazine loader 10 as in step 364 to load the magazine loader 10 by a movement of the second drawer 162 as indicated at step 368.

Figure 40:
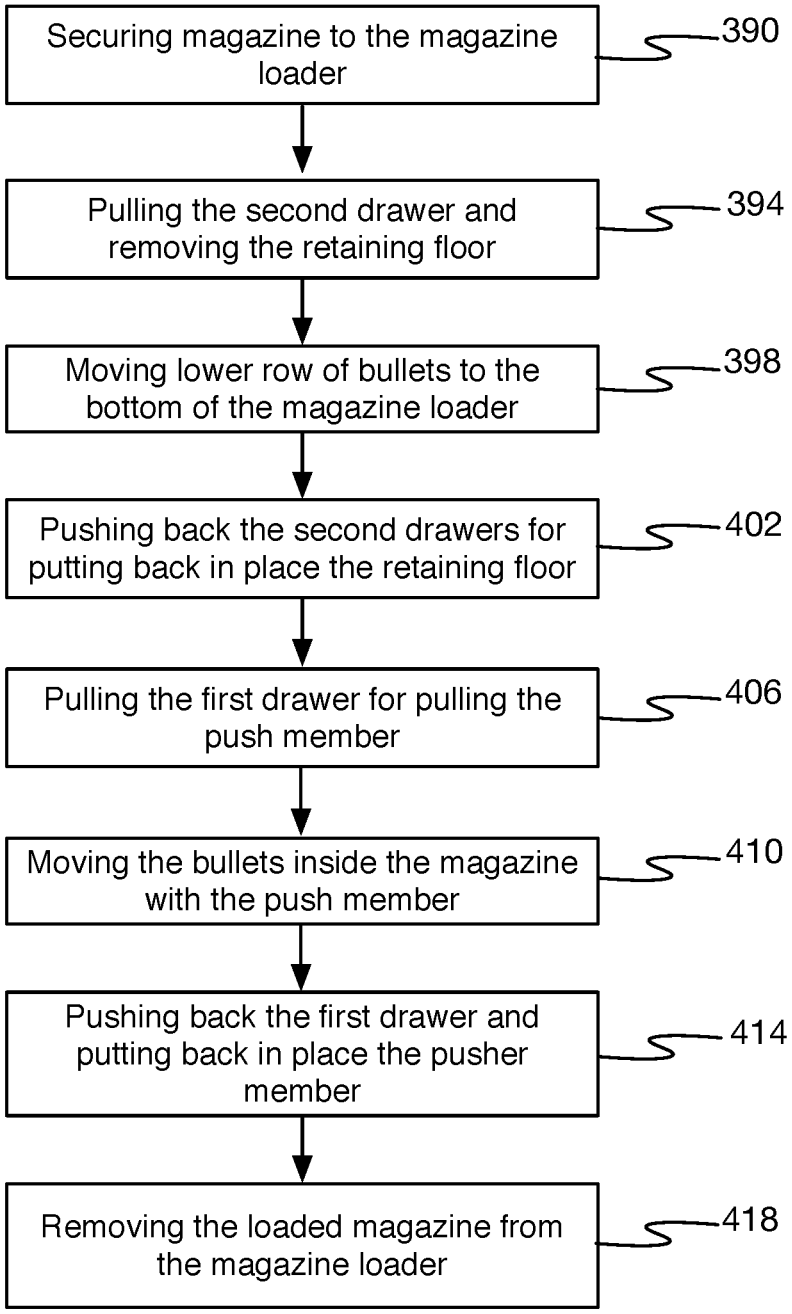
FIG. 40 is a flow chart describing the steps to load a magazine with the magazine loader.

And step 390 throughout step 418 in FIG. 40 illustrate the process of loading a magazine 230 with the magazine loader 10 through the use of drawers 162 and 158. Step 390 secures the magazine 230 to the magazine loader 10 and step 394 pulls the second drawer 162 for removing the retaining floor 234 to allow movement of the lower bullets 74 to the bottom of the magazine loader 10 in step 398. Pushing back the second drawer 162 for putting back in place the retaining floor 234 to retain the remaining bullets 74 in the magazine loader 10 in step 402 for, then, pulling the first drawer 158 to pull the push member 206 of step 406 that is moving the bullets 74 inside the magazine 230, as identified in step 410. Step 414 pushes back the first drawer 158 and the push member 206 to finally remove the loaded magazine 230 from the magazine loader 10 in step 418.

Figure 41:
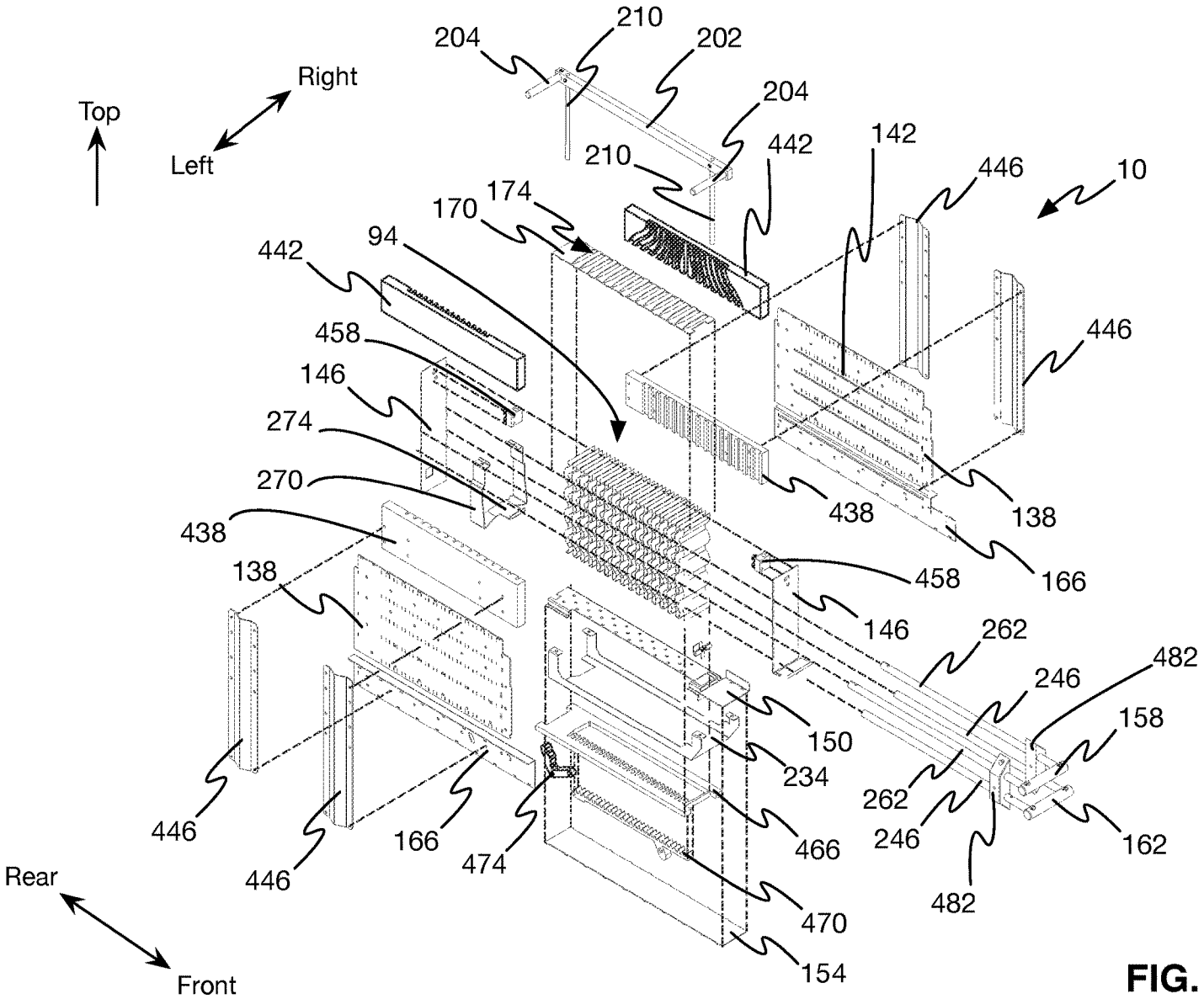
FIG. 41 is an exploded isometric view of a magazine loader, in accordance with an embodiment thereof.
Figure 61:
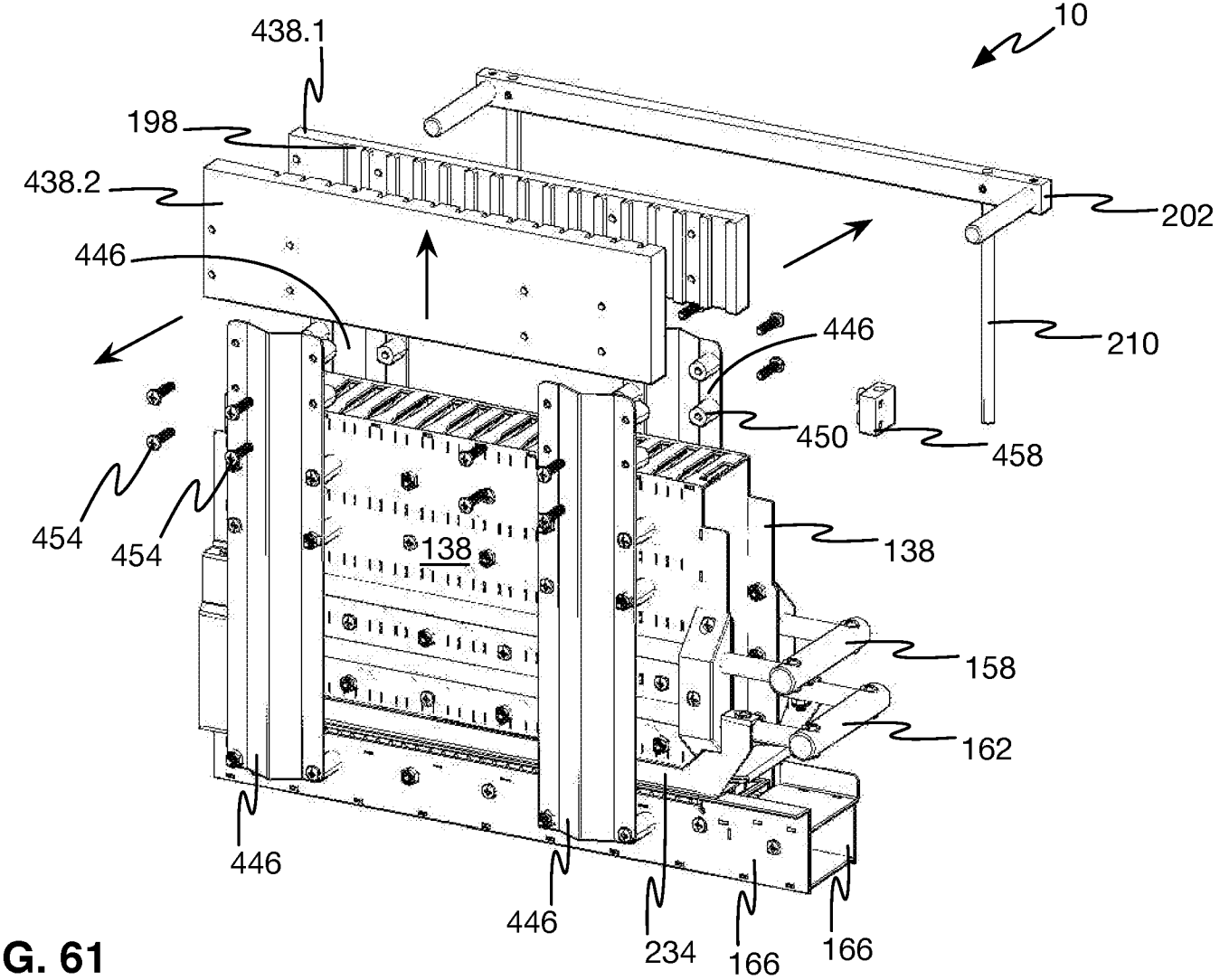
FIG. 61 is a semi-assembled isometric view of the magazine loader, in accordance with an embodiment thereof.
Figure 62:
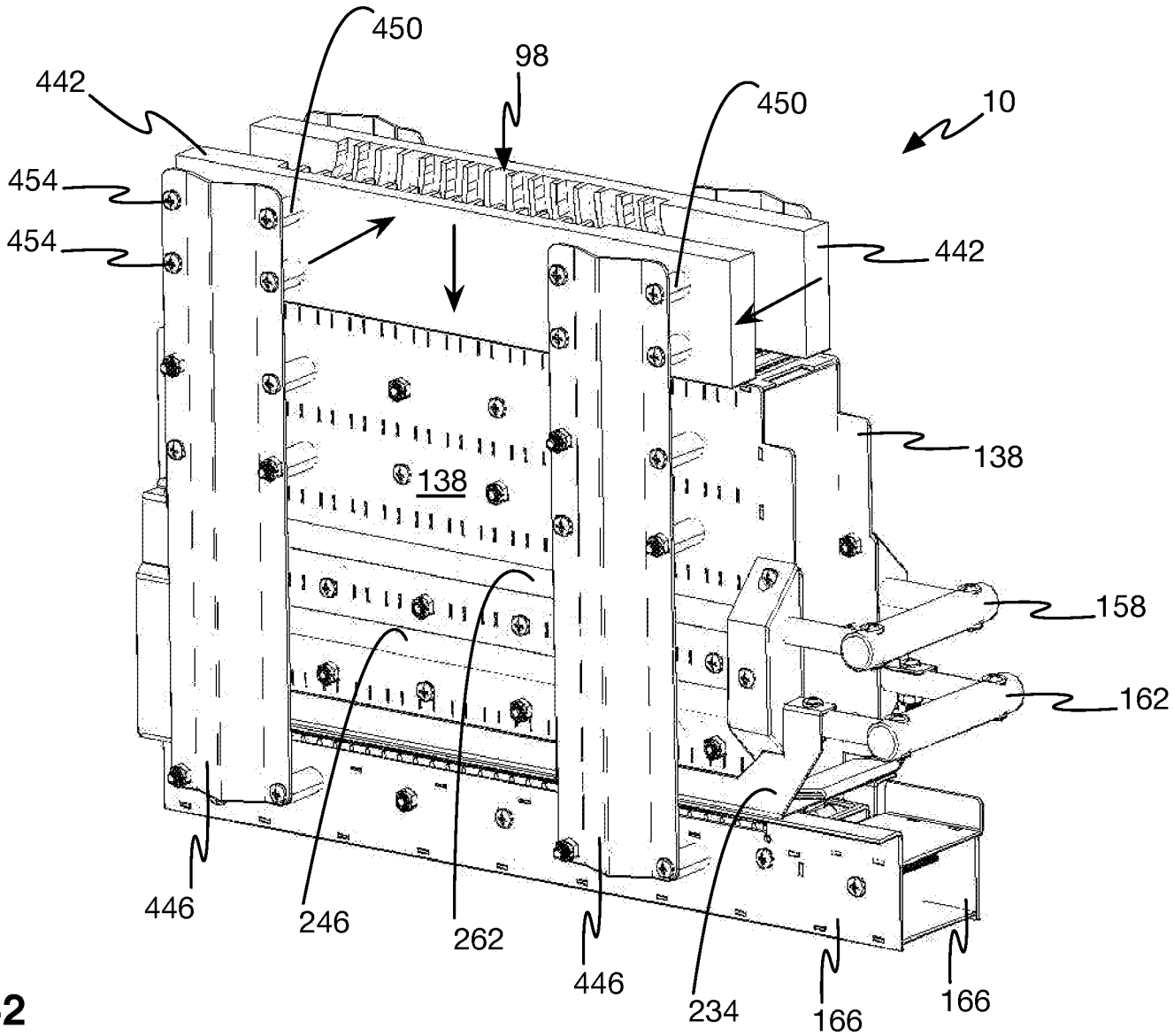
FIG. 62 is an isometric view of the magazine loader, in accordance with an embodiment thereof.
Figure 63:
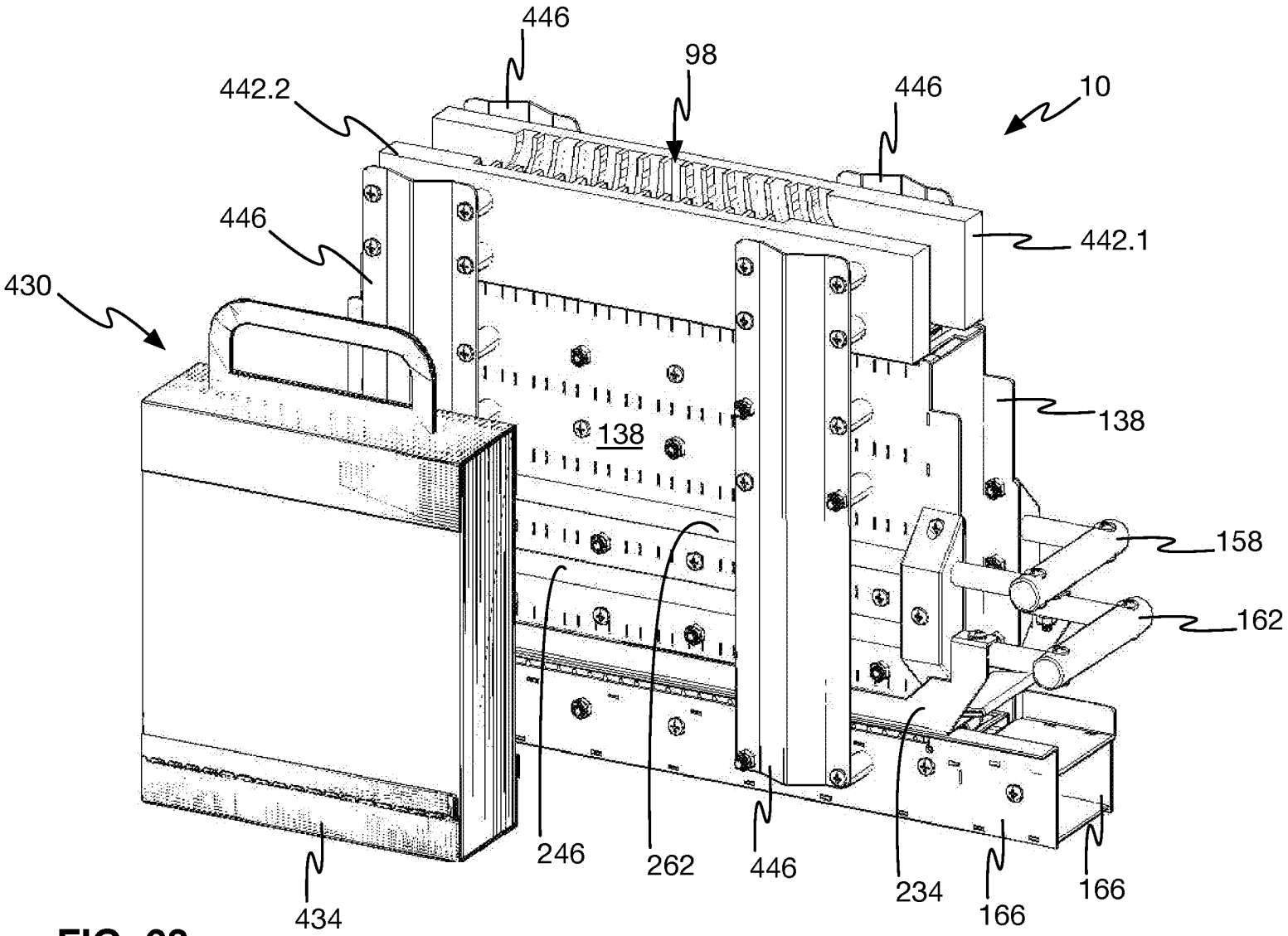
FIG. 63 is an isometric view of the magazine loader with a bullets container, in accordance with an embodiment thereof.
Figure 64:
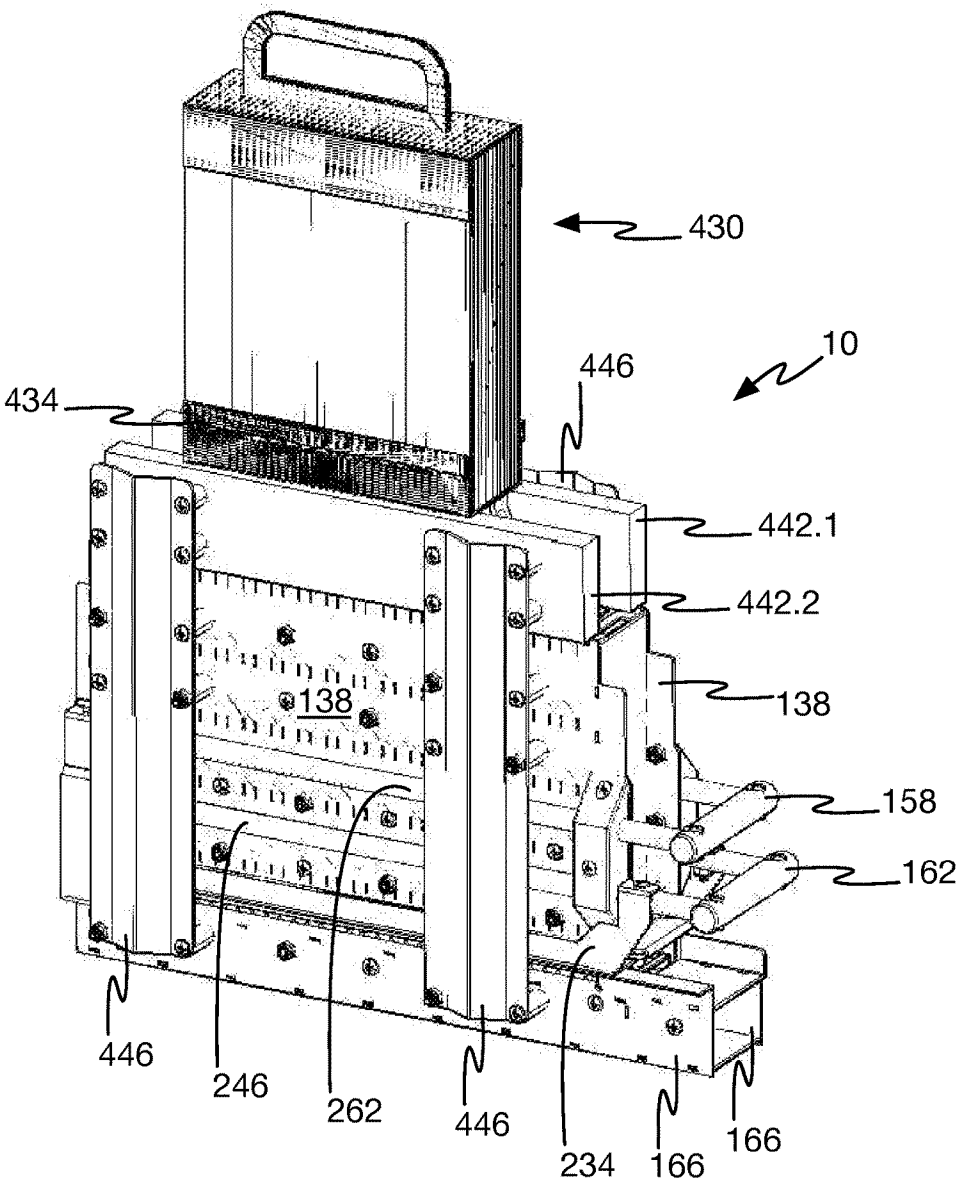
FIG. 64 is an isometric view of the magazine loader with a bullets container, in accordance with an embodiment thereof.
Figure 65:
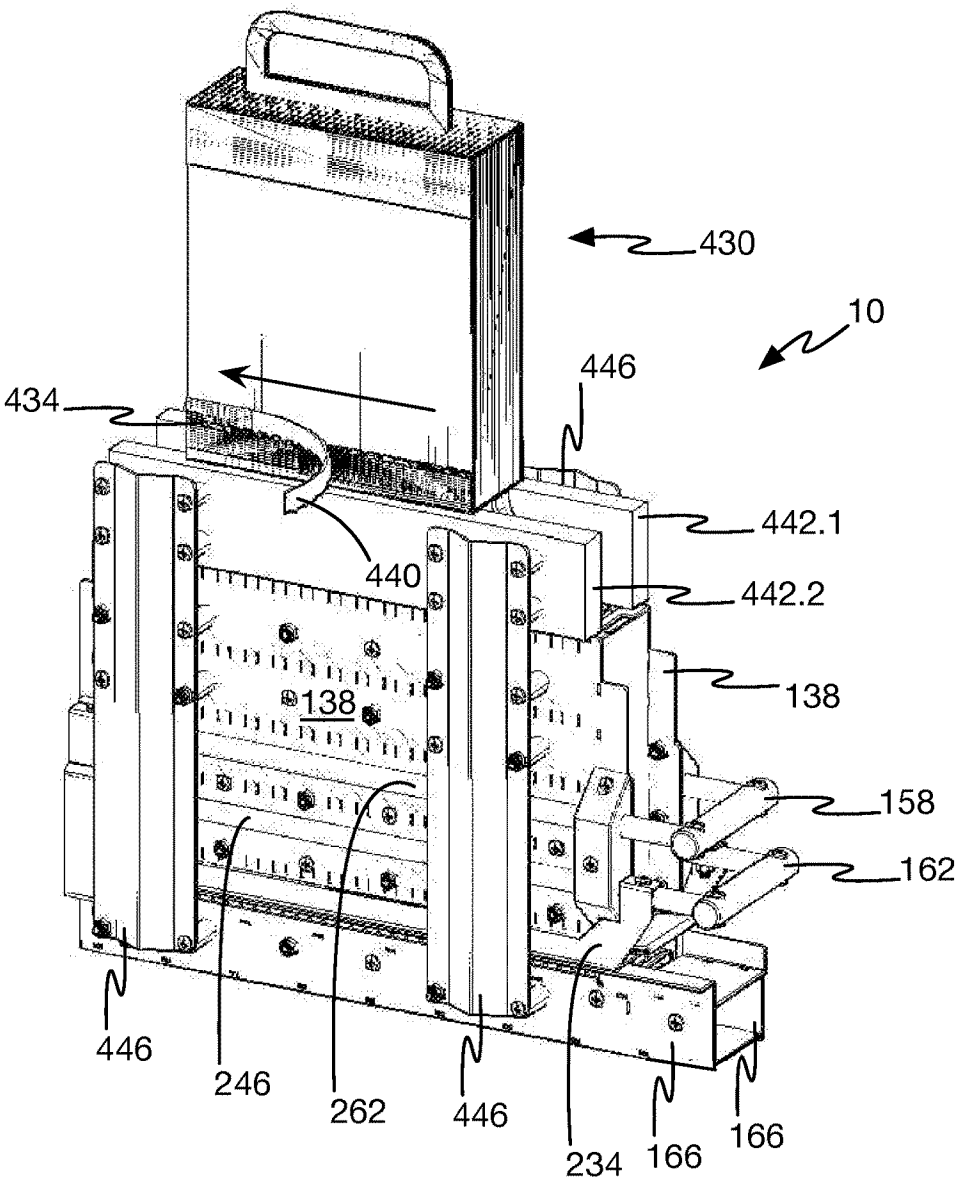
FIG. 65 is an isometric view of the magazine loader with a bullets container, in accordance with an embodiment thereof.
Figure 66:
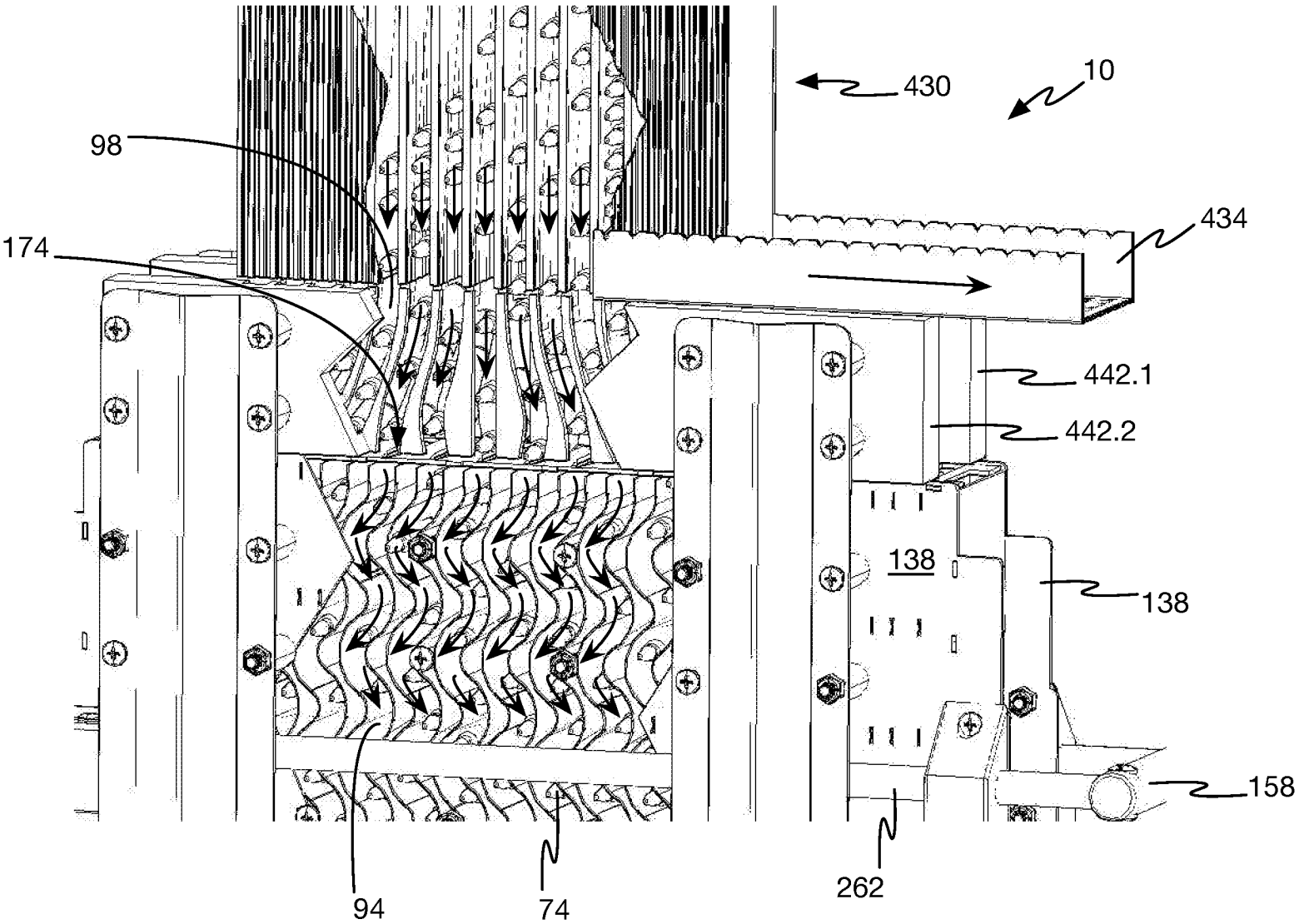
FIG. 66 is a partial isometric view of the magazine loader with a bullets container, in accordance with an embodiment thereof.
Figure 67:
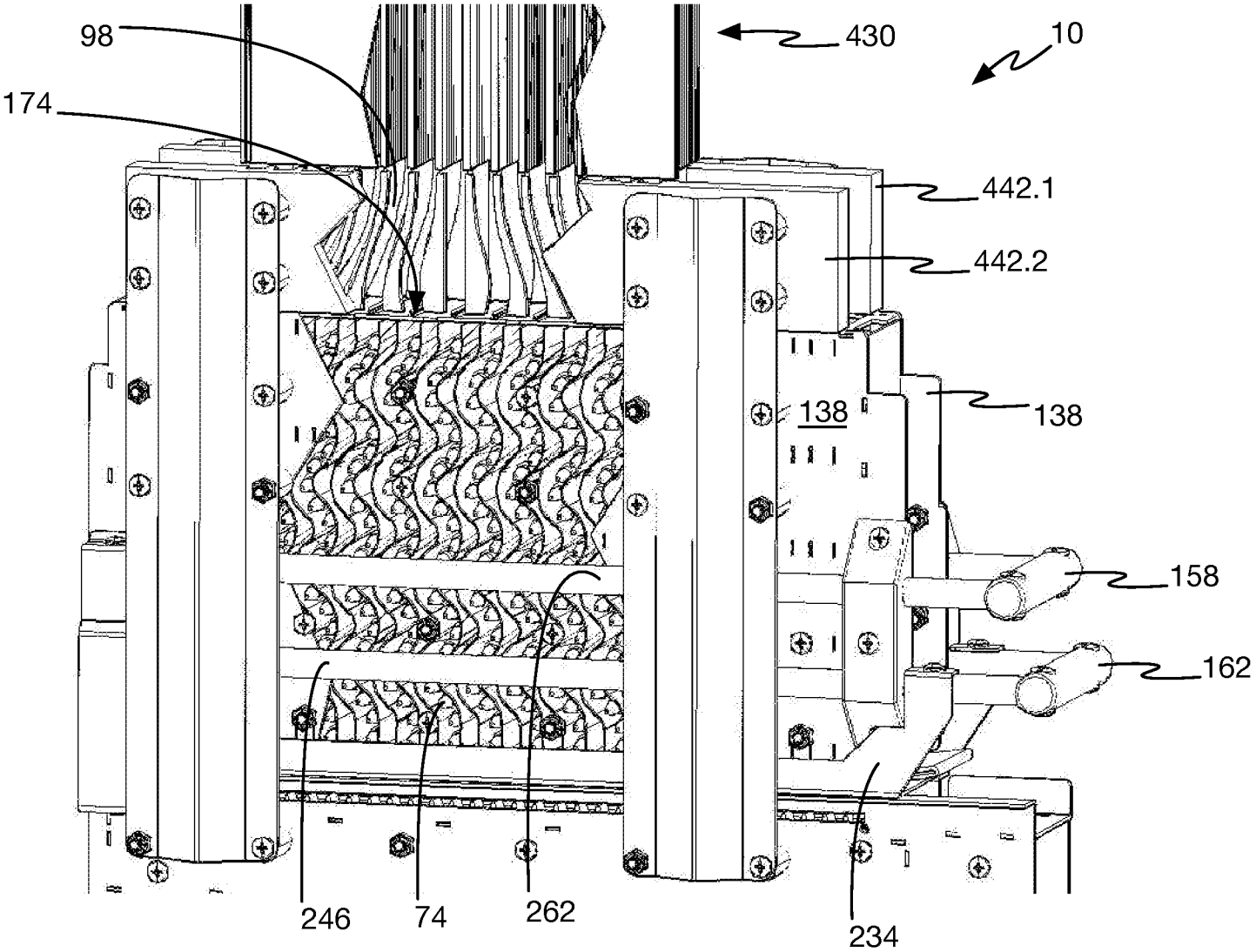
FIG. 67 is a partial isometric view of the magazine loader with a bullets container, in accordance with an embodiment thereof.

Another embodiment of the invention using the same general principles of operation is illustrated in FIG. 41 throughout FIG. 66. In this embodiment, the components of the magazine loader 10 are secured between a plurality of frame portions 446 optionally designed with bents therein for increased rigidity. The illustrated frame portions 446 are also provided with spacers 450 and fasteners 454 to secure the magazine loader 10 components in an operative configuration. The embodiment illustrated in FIG. 41 throughout FIG. 66 allows for integration and use of various means for routing bullets 74 from bullets containers 50, 430 of different configurations in the magazine loader 10. For example, in the embodiment shown in FIG. 1 throughout FIG. 16, the adaptor 80 is a distinct and separate piece of equipment which is put on top of the bullets container 50 over the channels 96 of the magazine loader 10. In the embodiment illustrated in FIG. 61 throughout FIG. 66, a pair of guide plates 438 is installed atop the series of channels 96 to route bullets 74 from bullet clips 190 in the magazine loader 10. The guide plates 438 include a series of vertically aligned slots 98 and are used to assemble a bullet container 50, 430 that has compatible slots 98 pattern. Alternatively, the pair of adaptor plates 442 includes a series of divergent slots 98 and are used to assemble a bullet container 430 that has not a slots 98 pattern directly compatible with the magazine loader 10. These various means for routing bullets 74 from bullets containers 50, 430 are selectively and removably secured in the magazine loader 10. It is also encompassed by the present invention that the means for routing bullets 74 from bullets containers to the magazine loader 10 are permanently secured to the magazine loader 10 in alternate embodiments thereof.

FIGS. 1 to 16, related to the previous embodiment, describe the magazine loader 10 used with a regular ammunition container 50. As described above, the regular ammunition container 50 is generally consisting of a metallic box of cubic shape with an opening/closing top. This type of ammunition container 50 is in use since World War Two, has been in use in conflicts since, and will probably remain in use for decades to come. The main issue with this type of ammunition container 50 is that it requires to be flipped upside down to empty its load of bullets 74 inside the magazine loader 10.

In the embodiment described in FIGS. 61 to 66, the magazine loader 10 is used with an alternative ammunition container 430, which could be designed as a disposable bullets container. This alternative ammunition container 430 has a bottom portion 434 that is designed to be removable by removing, for instance, a securing strip 440. Removing the securing strip 440 allows to slide the bottom portion 434 from the ammunition container 430 to open the alternative ammunition container 430 and empty its content into the magazine loader 10 as illustrated in FIG. 66.

Figure 19:
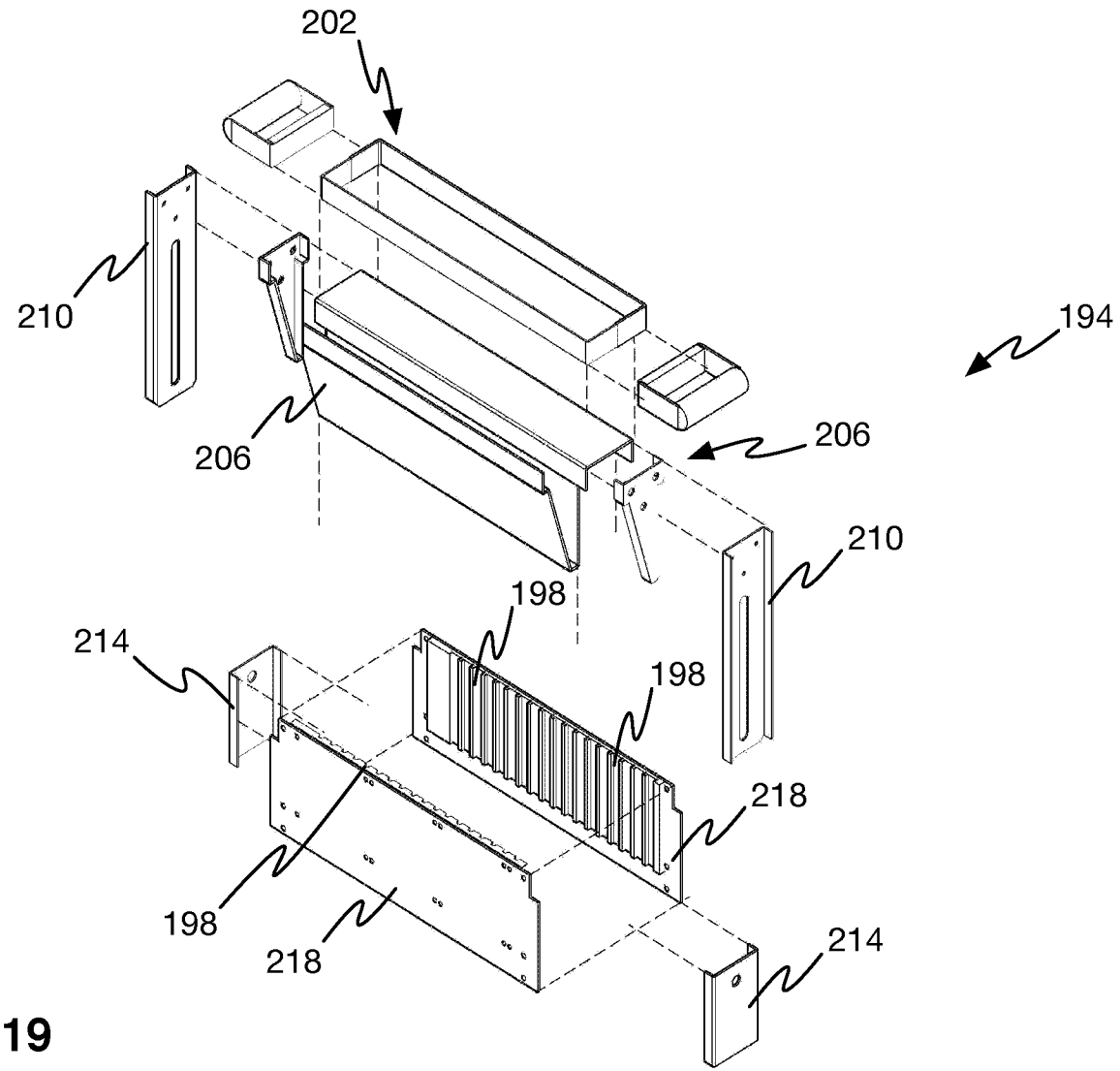
FIG. 19 is an exploded isometric view of a bullets ram support, in accordance with at least one embodiment thereof.
Figure 42:
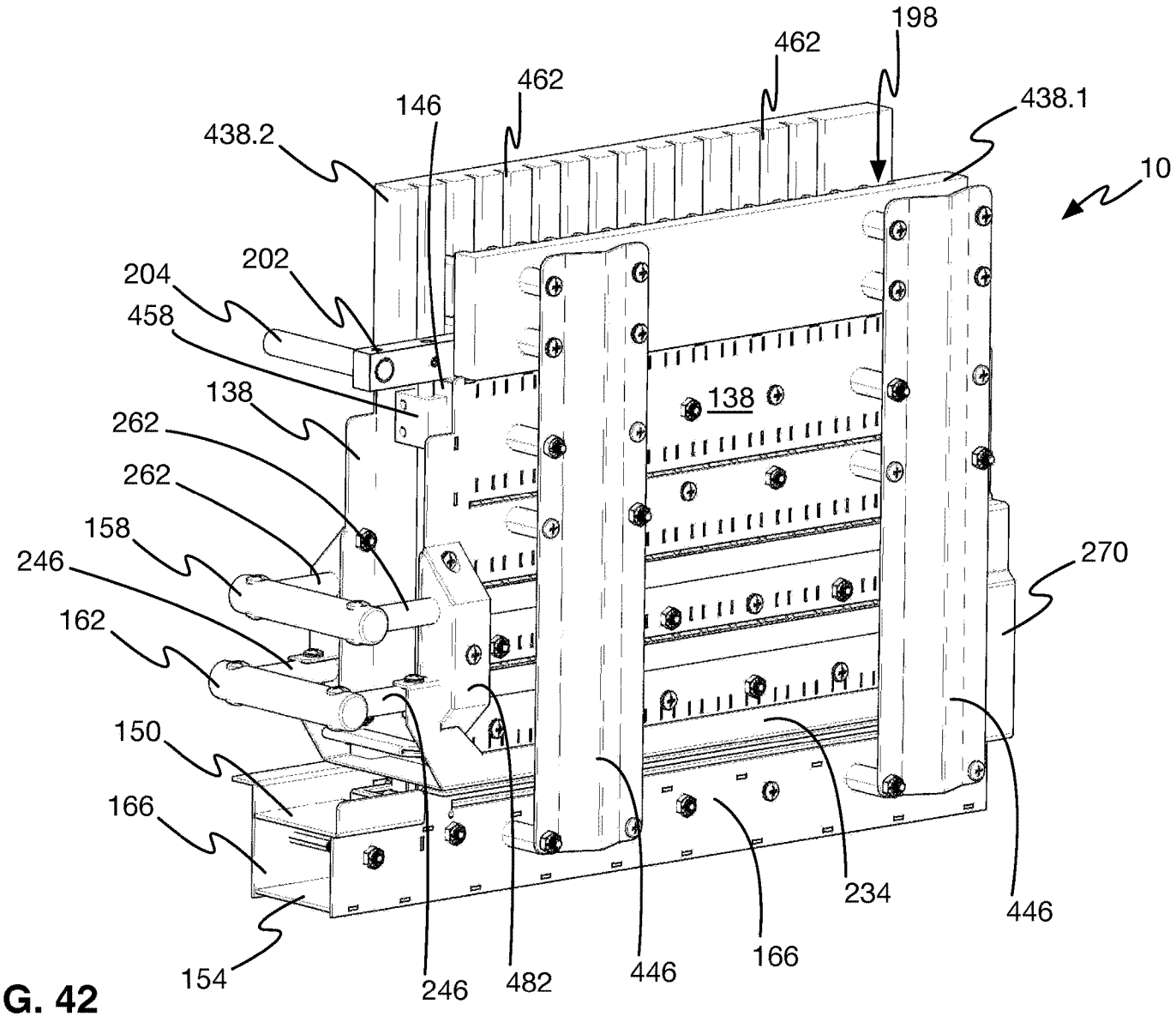
FIG. 42 is a view of a magazine loader, in accordance with an embodiment thereof.
Figure 43:
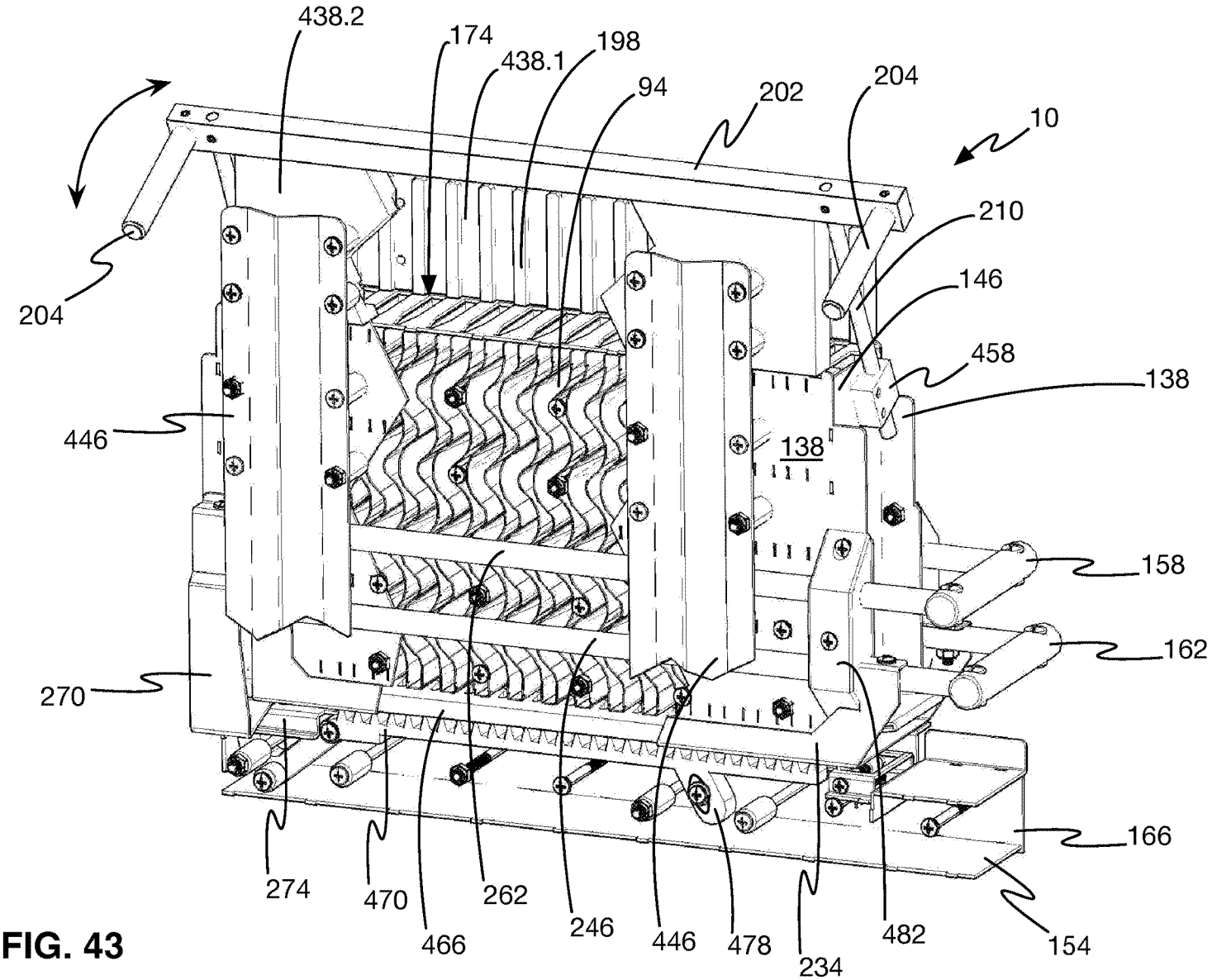
FIG. 43 is an isometric view of the magazine loader, in accordance with an embodiment thereof.
Figure 44:
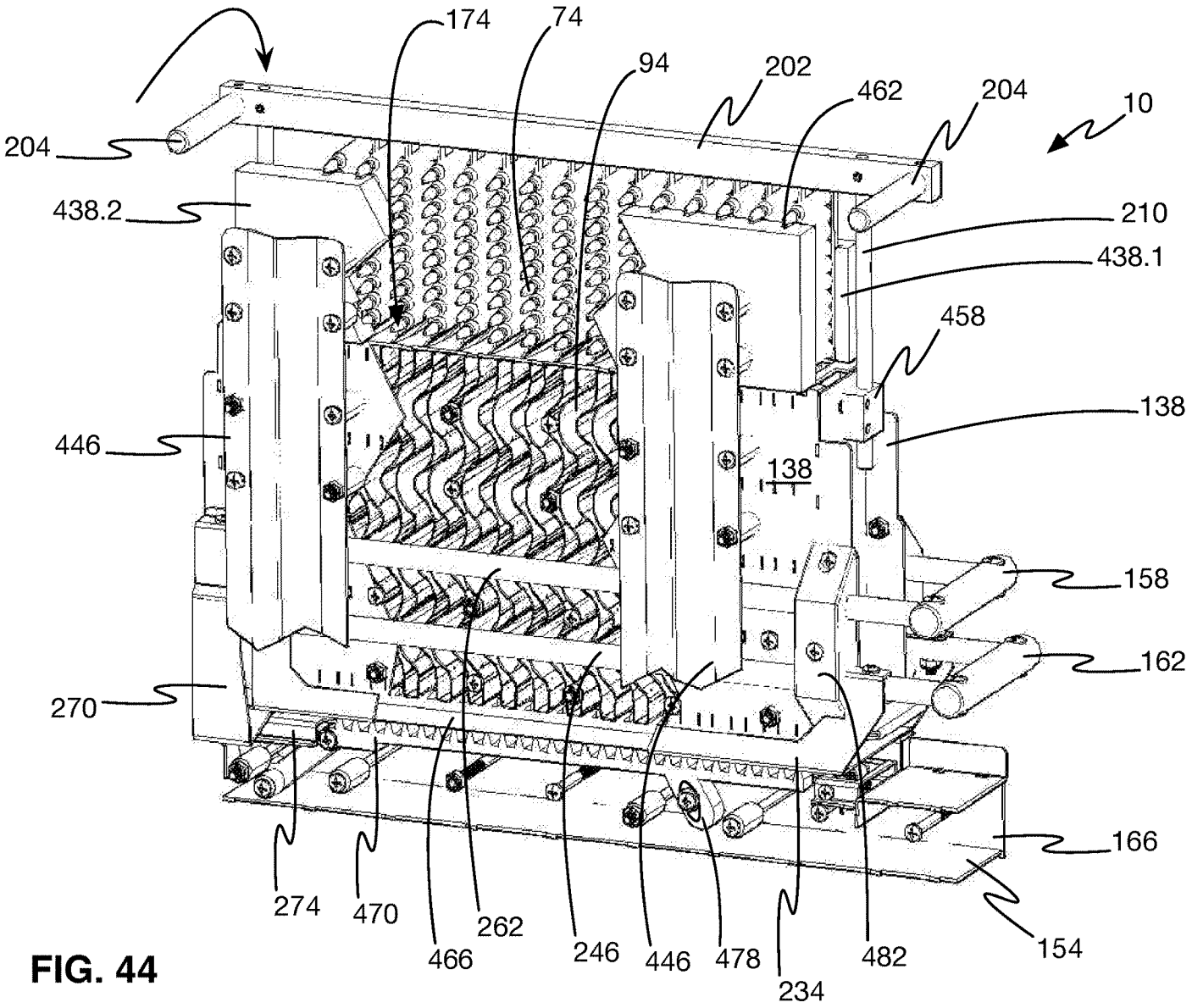
FIG. 44 is an isometric view of the magazine loader, in accordance with an embodiment thereof.
Figure 45:
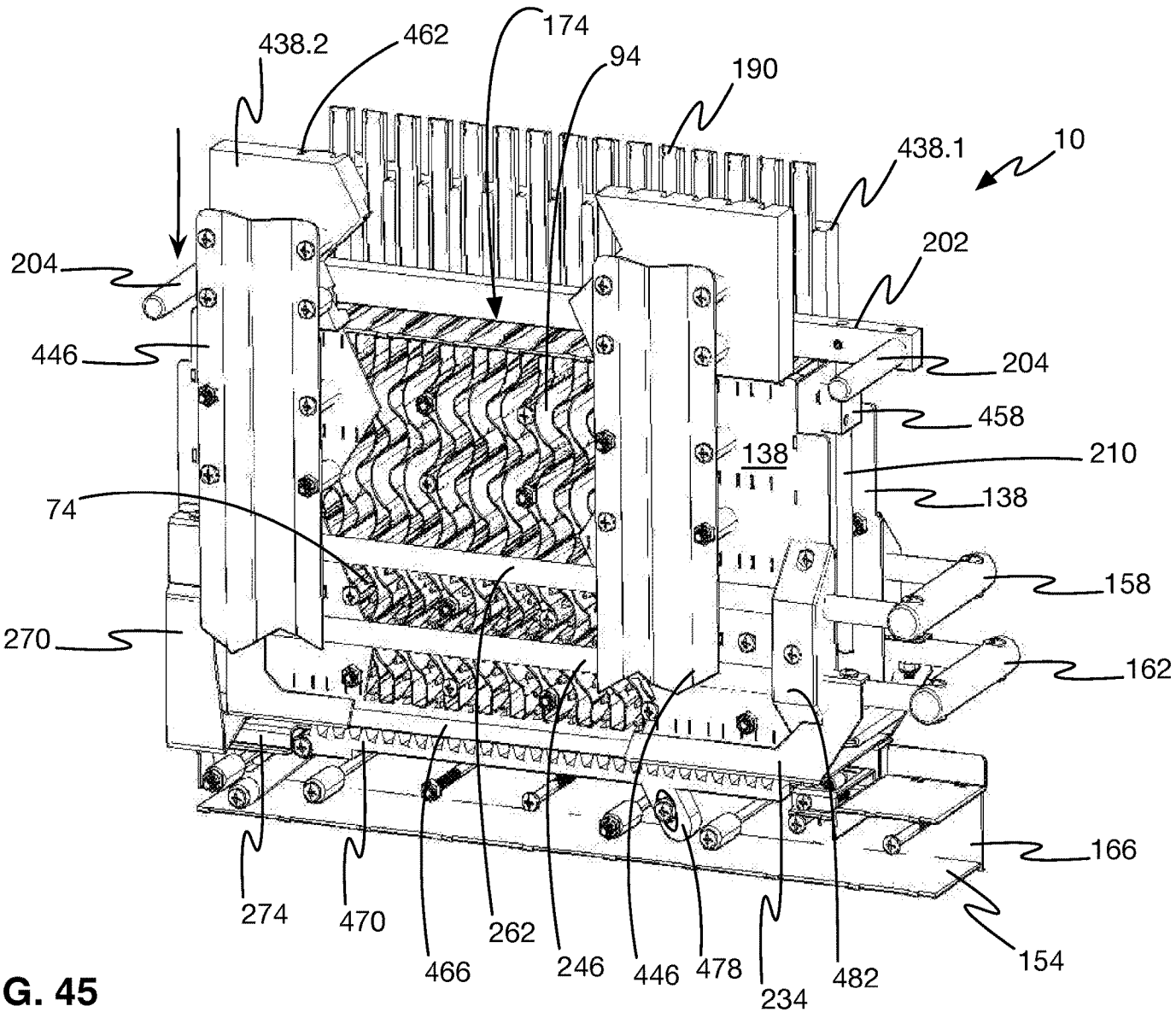
FIG. 45 is an isometric view of the magazine loader, in accordance with an embodiment thereof.
Figure 46:
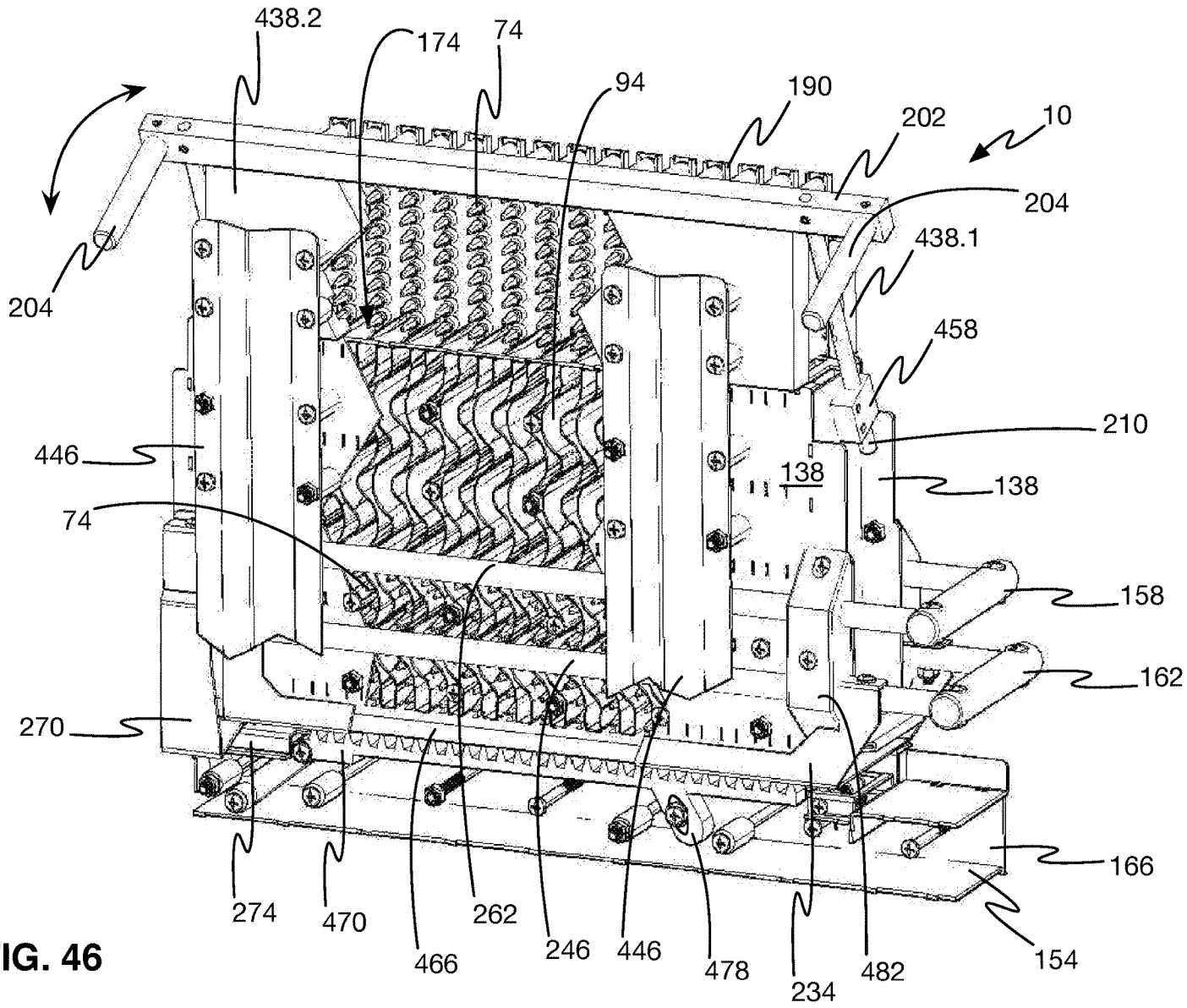
FIG. 46 is an isometric view of the magazine loader, in accordance with an embodiment thereof.
Figure 47:
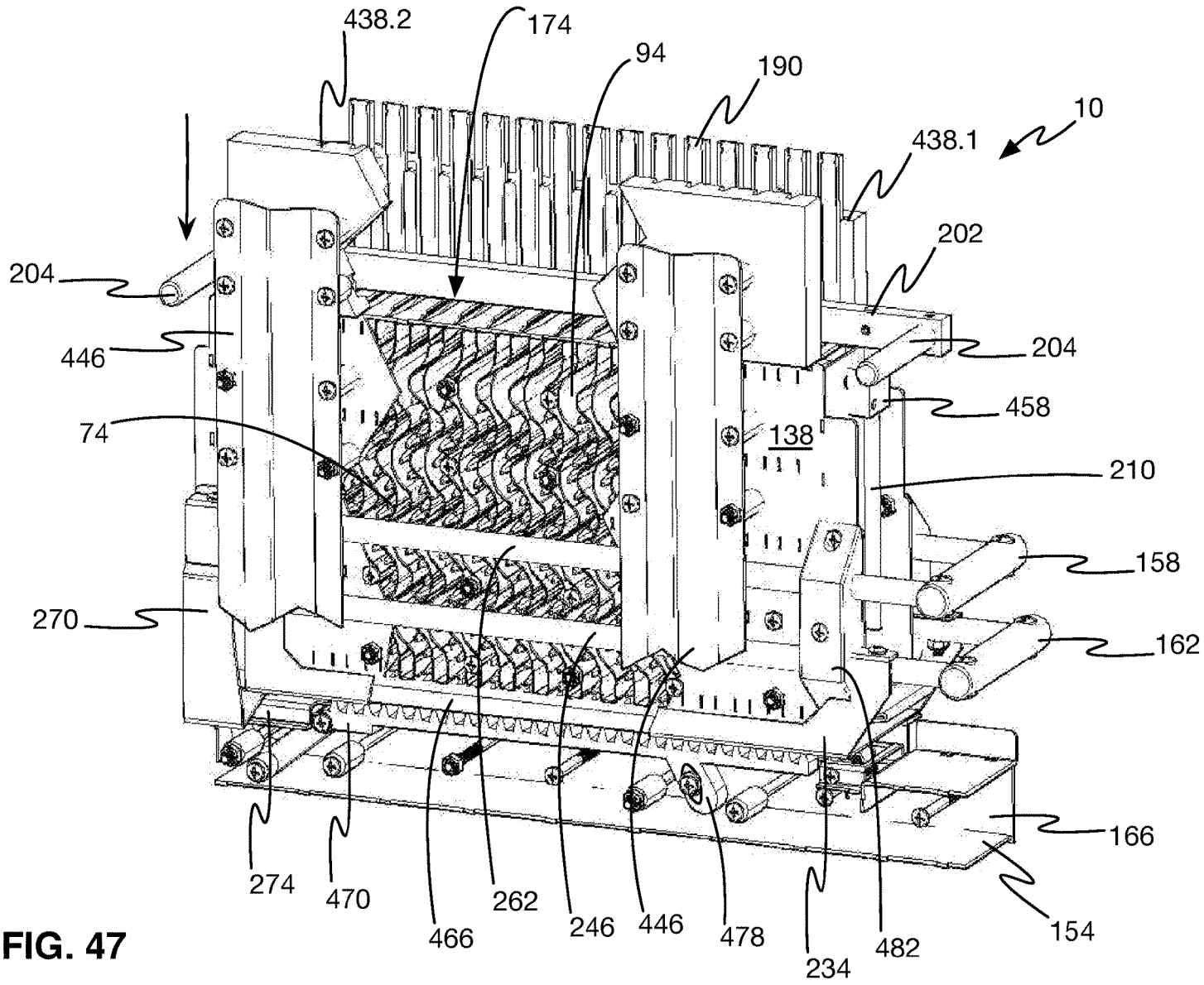
FIG. 47 is an isometric view of the magazine loader, in accordance with an embodiment thereof.

The embodiments of FIG. 19 throughout FIG. 26 and FIG. 42 throughout FIG. 47 is used with ten-bullets clips 190. In FIG. 19 throughout FIG. 26, the clips 190 are positioned inside the slots 198 of the support plates 218, which with the pair of plates 214, form the bullet ram support 194. The clips 190 are completely inserted in the slots 198. As described above, the push member 206 (embodied as a rectangular plate in the embodiment) is pushed between the support plates 218 with the handle portion 202 to ram the bullet in the channels 96 and into the magazine loader 10. In FIG. 42 throughout FIG. 47, the handle portion 202 itself, now provided with a pair of handles 204, is used to ram the bullets 74 inside the channels 96 of the magazine loader 10. The handle portion 202 is slidably secured in a pair of guide members 458 pivotably secured to respective cover plates 146. As best seen in FIG. 42, the pair of guide plates 438 have different heights to allow pivotal of the handle portion 202. The clips 190 are secured to the shorter guide plate 438.1 equipped with clips-receiving slots 198. The taller guide plate 438.2 includes a series of vertical grooves 462 sized and designed to slidably receive therein bullets heads.

Still referring to the embodiment of FIG. 41 throughout FIG. 47, a bullet distancing member 466 is disposed on top of retaining floor 234 to ensure proper alignment and distance between the bullets 74 before they reach the lower row 242. The bullet distancing member 466 is designed to accommodate the tip of the bullets 74. Instead of the bullet 74 falling onto the first floor portion 150, each bullet 74 has its dedicated location maintained in place by the discrete location teeth to prevent any undesired movement of the bullets 74 ready to be loaded in the magazine 230 and contribute to prevent any jamming in the event a bullet 74 would not be in the proper orientation.

Figure 48:
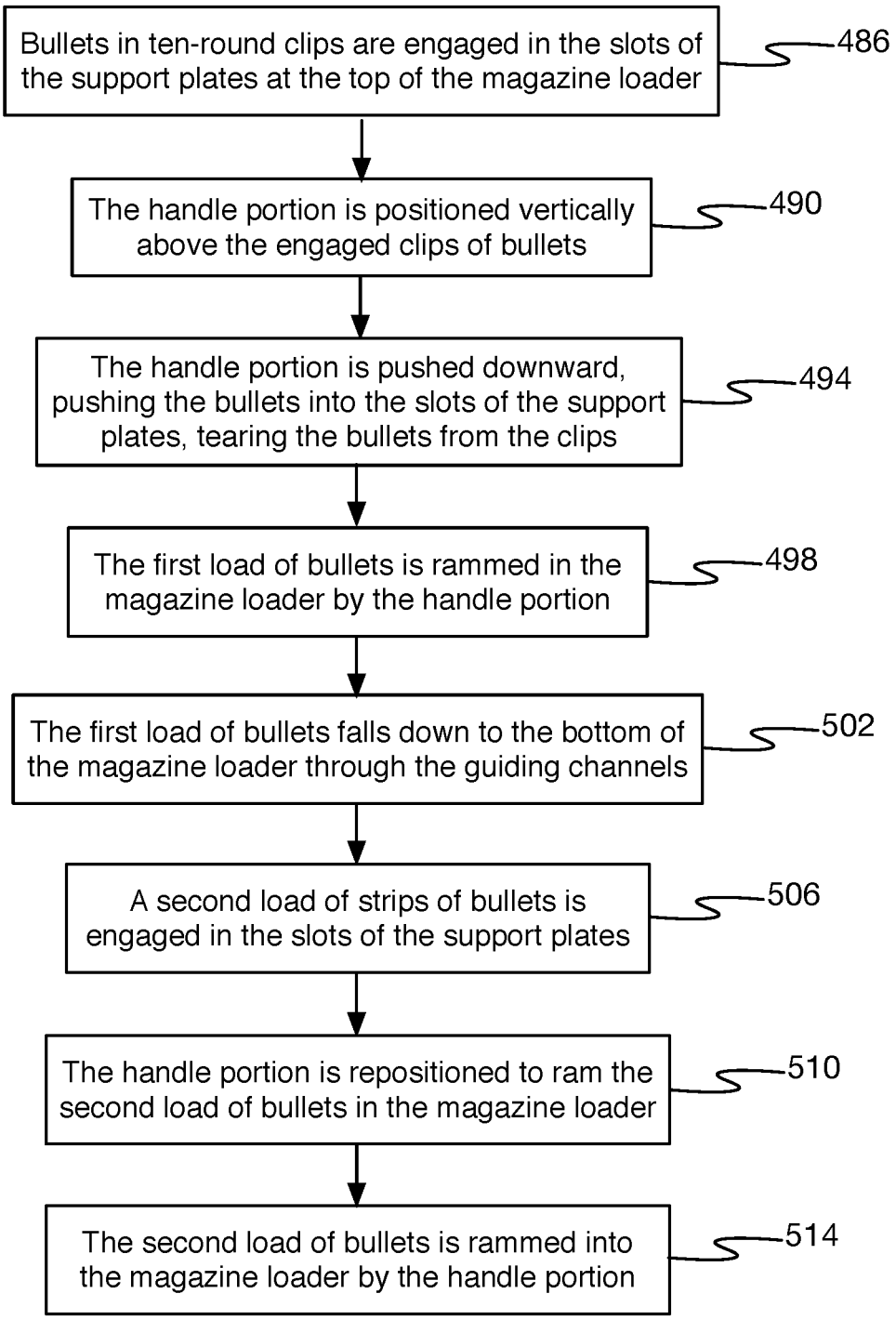
FIG. 48 is a flow chart illustrating a method of use of the magazine loader, in accordance with an embodiment thereof.
Figure 49:
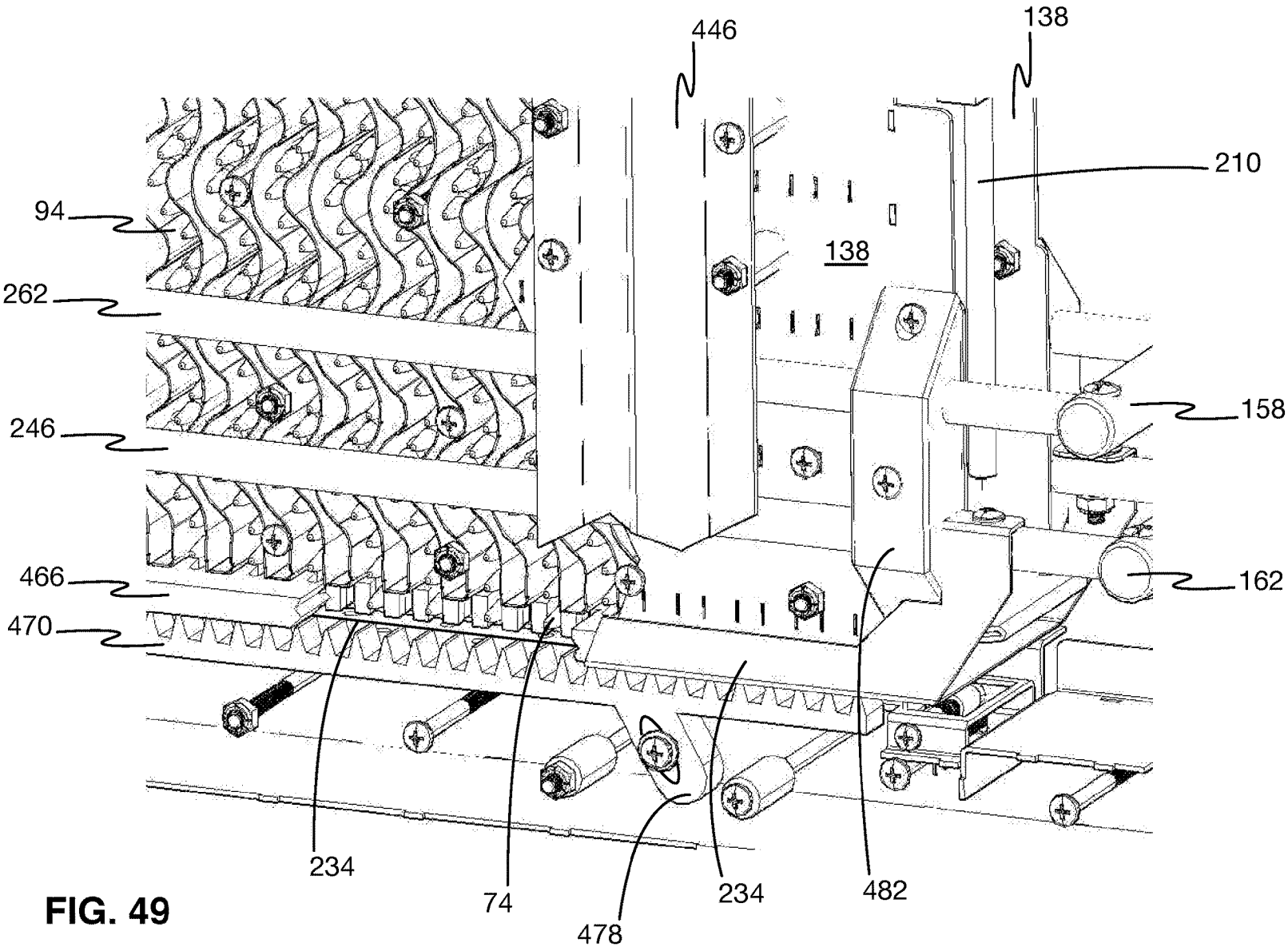
FIG. 49 is a partial isometric view of the magazine loader, in accordance with an embodiment thereof.
Figure 50:
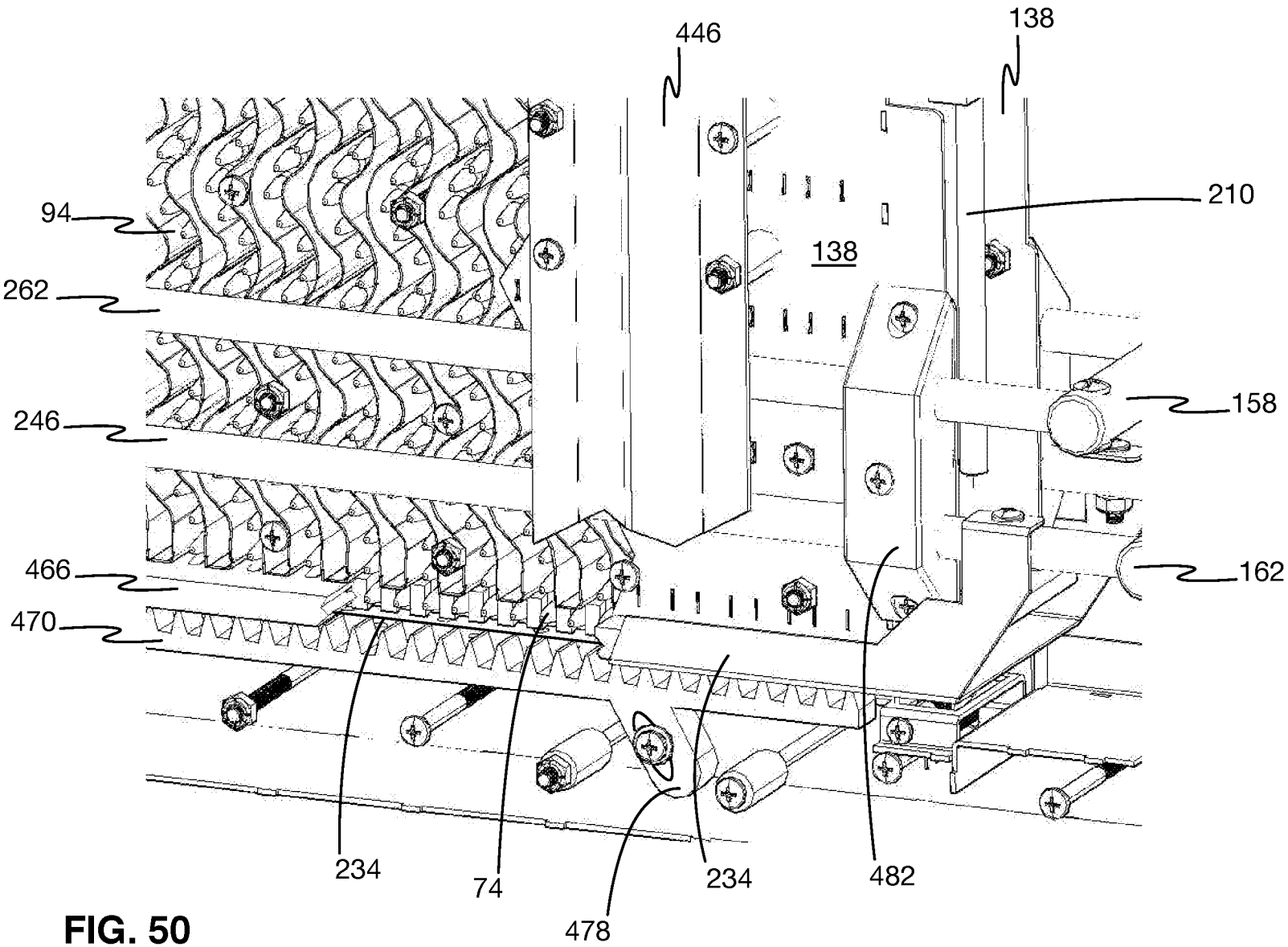
FIG. 50 is a partial isometric view of the magazine loader, in accordance with an embodiment thereof.
Figure 51:
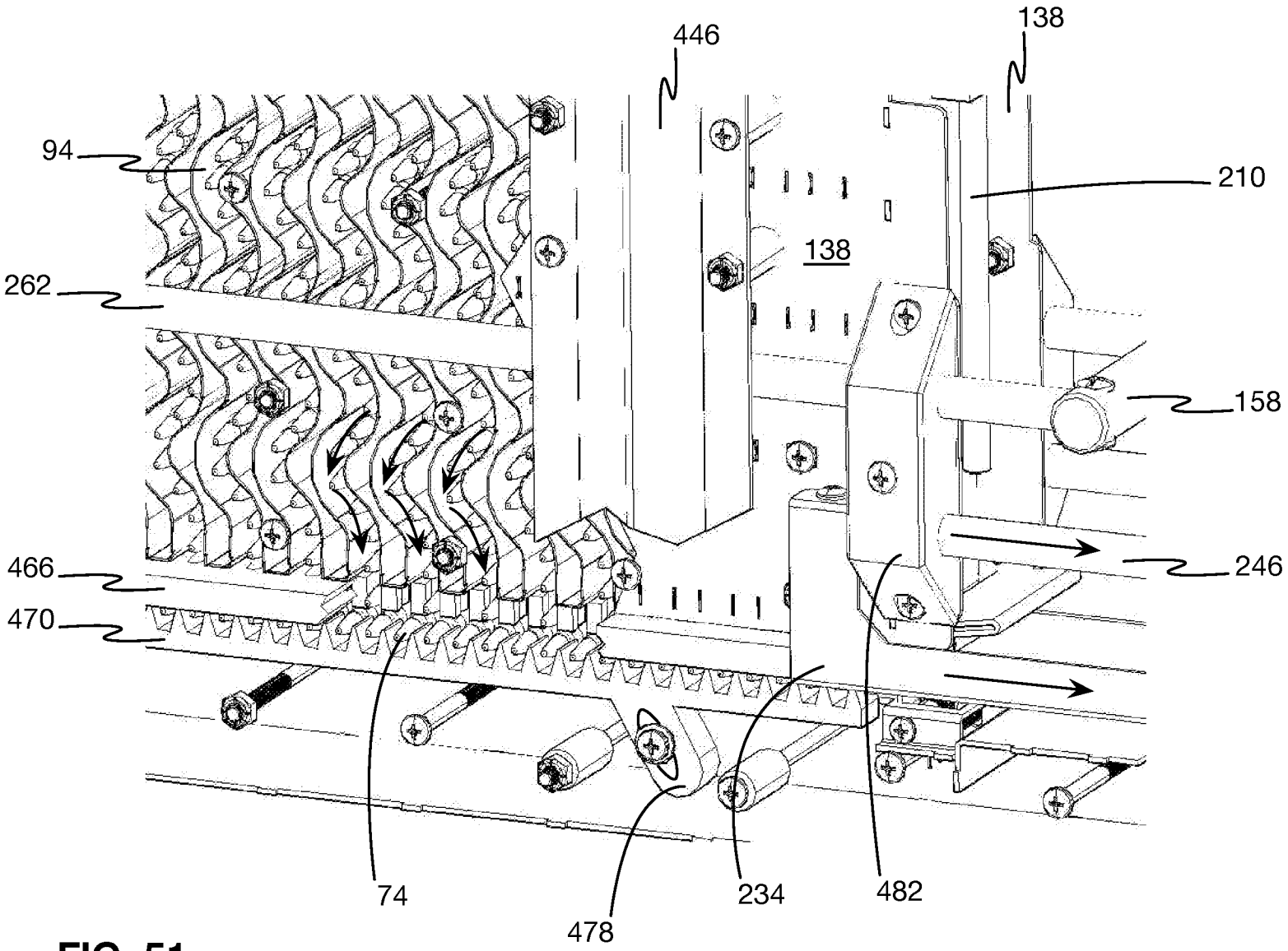
FIG. 51 is a partial isometric view of the magazine loader, in accordance with an embodiment thereof.
Figure 52:
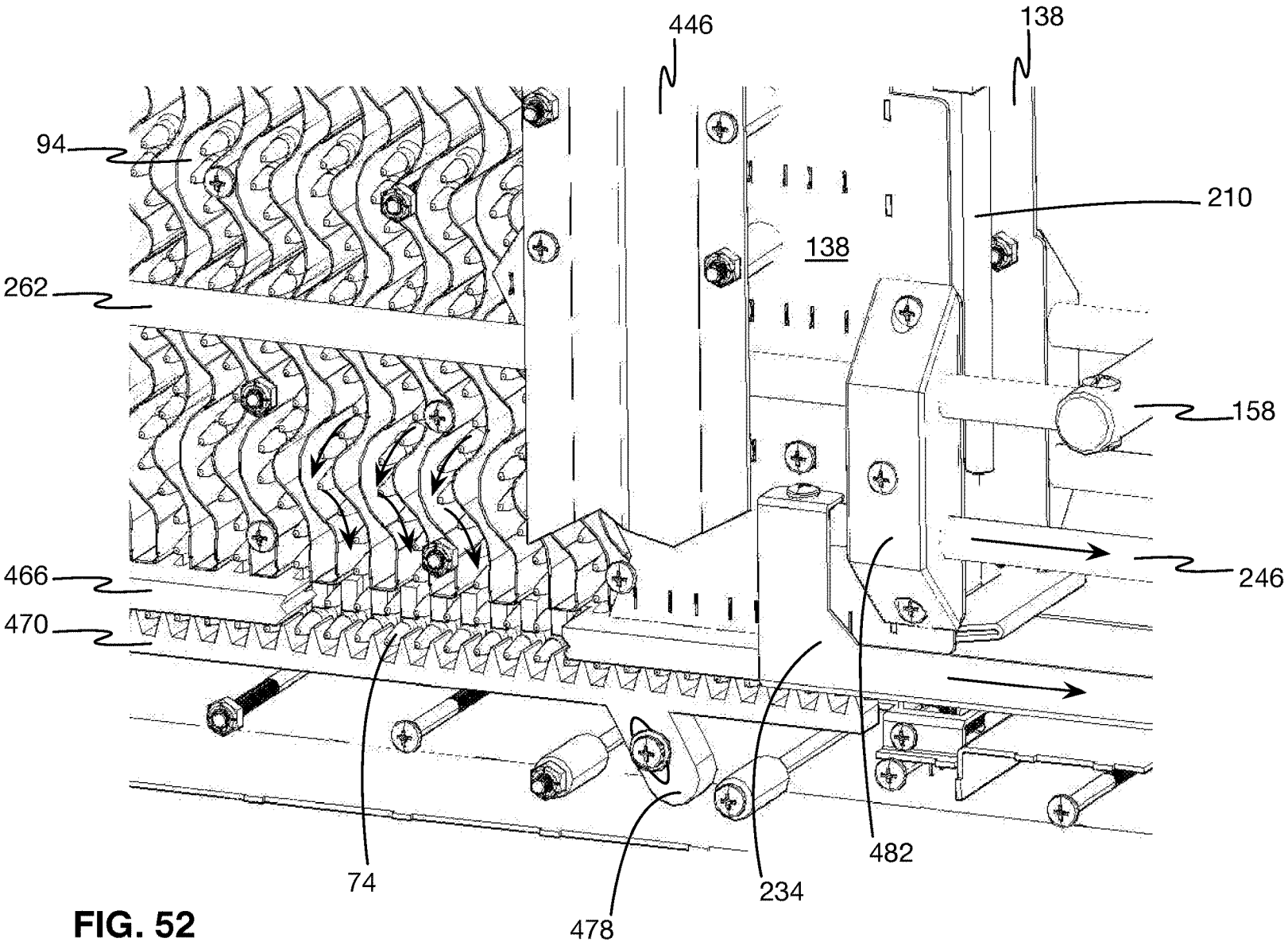
FIG. 52 is a partial isometric view of the magazine loader, in accordance with an embodiment thereof.
Figure 53:
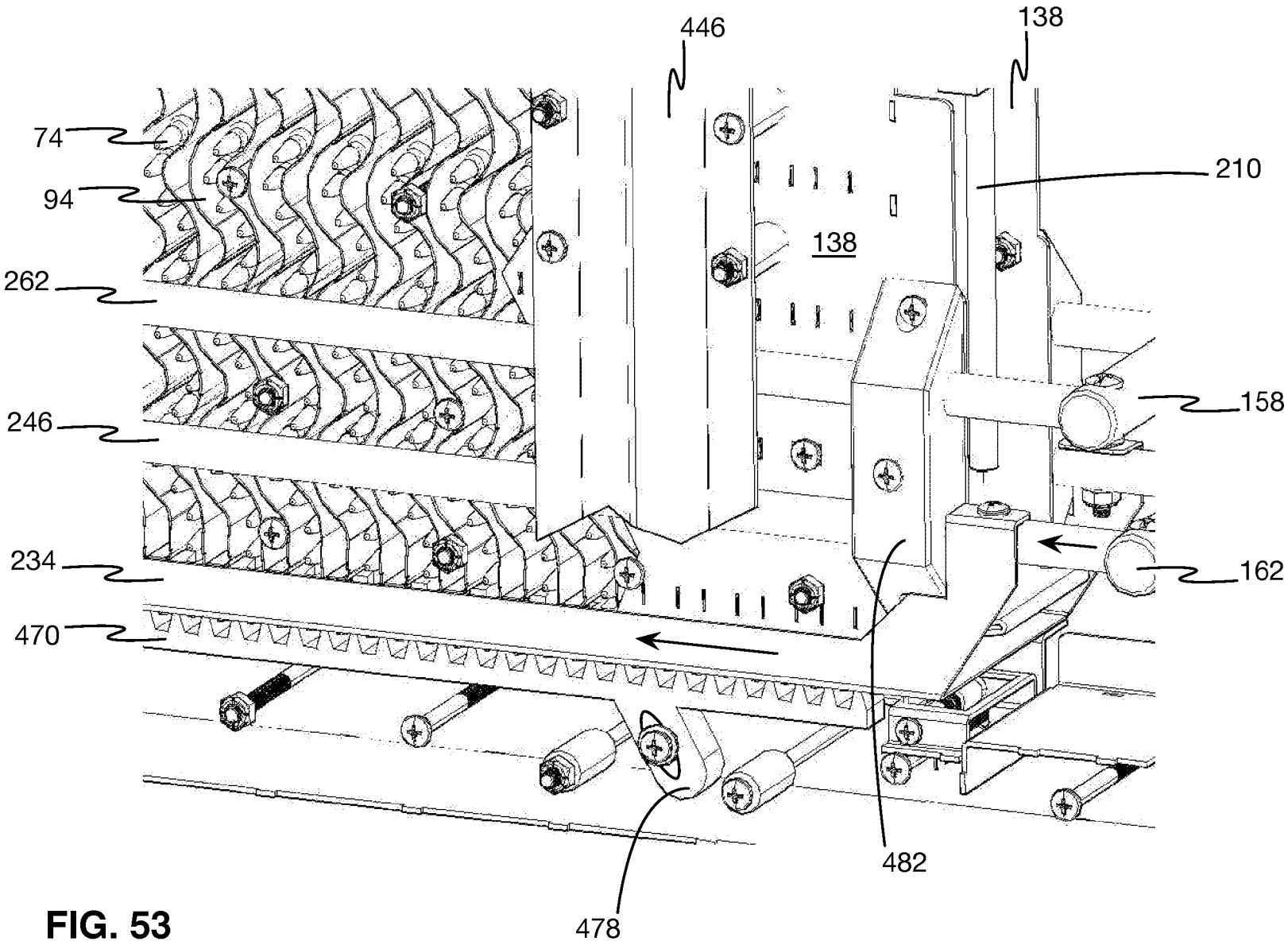
FIG. 53 is a partial isometric view of the magazine loader, in accordance with an embodiment thereof.
Figure 54:
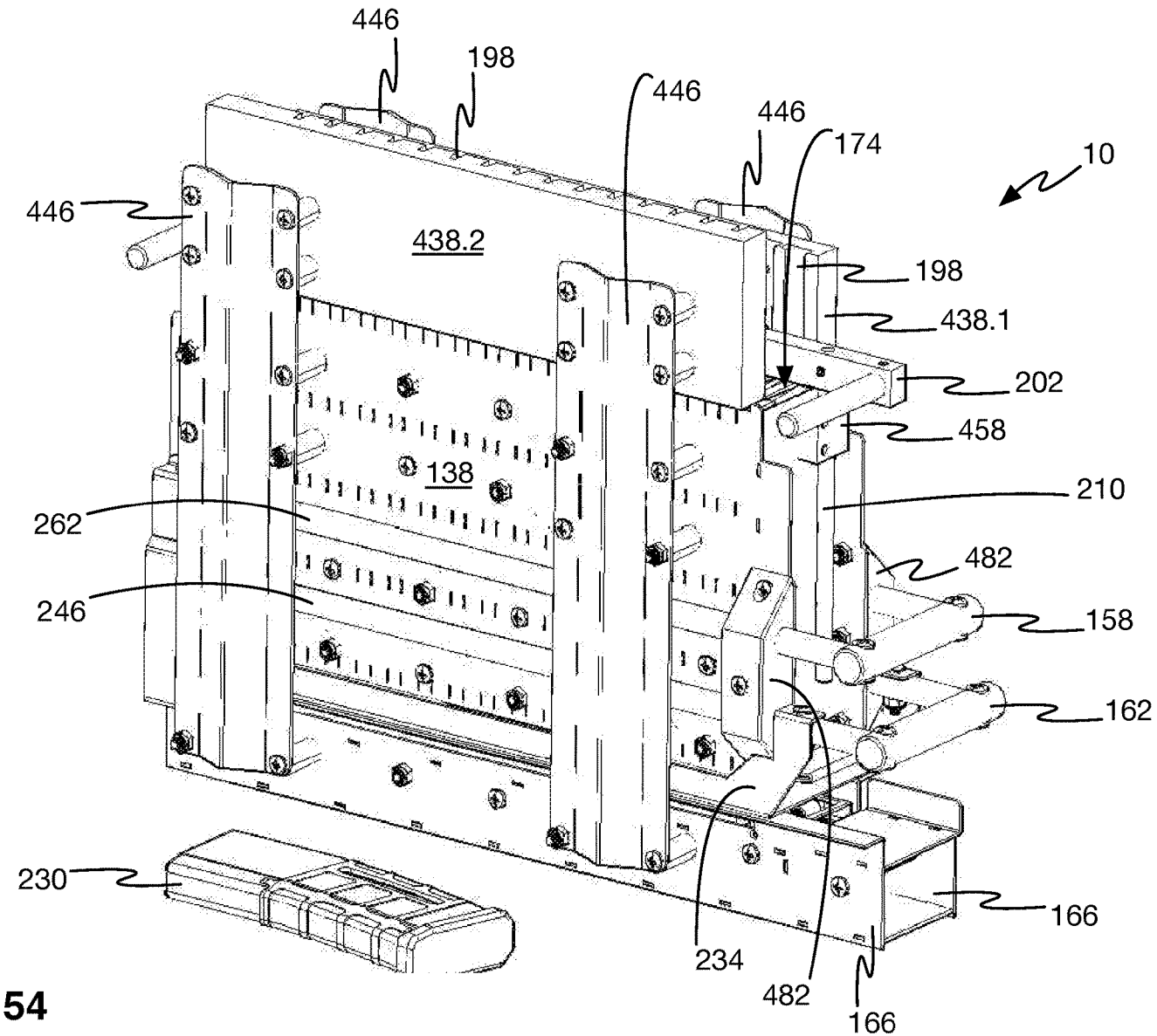
FIG. 54 is an isometric view of the magazine loader, in accordance with an embodiment thereof.
Figure 55:
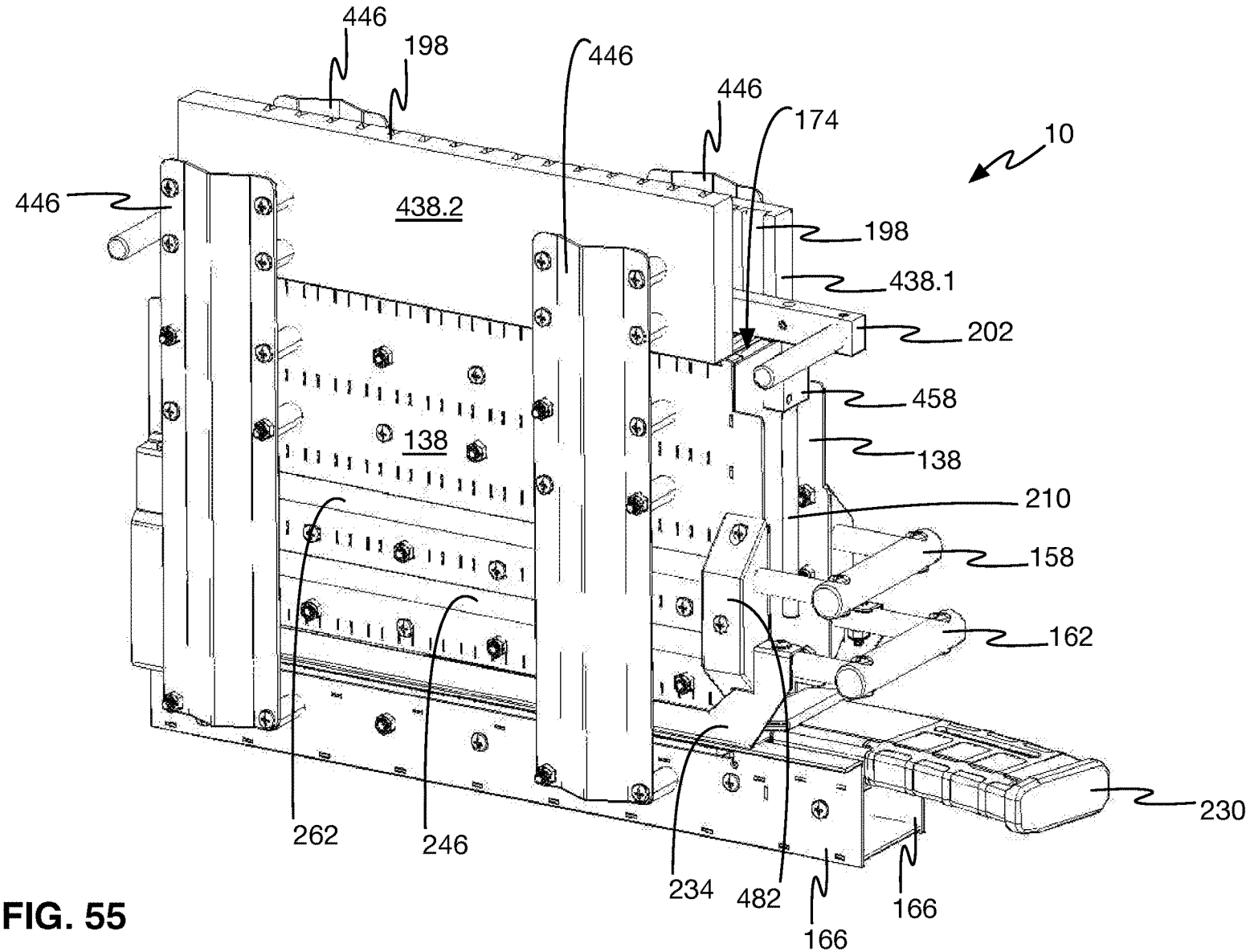
FIG. 55 is an isometric view of the magazine loader, in accordance with an embodiment thereof.
Figure 56:
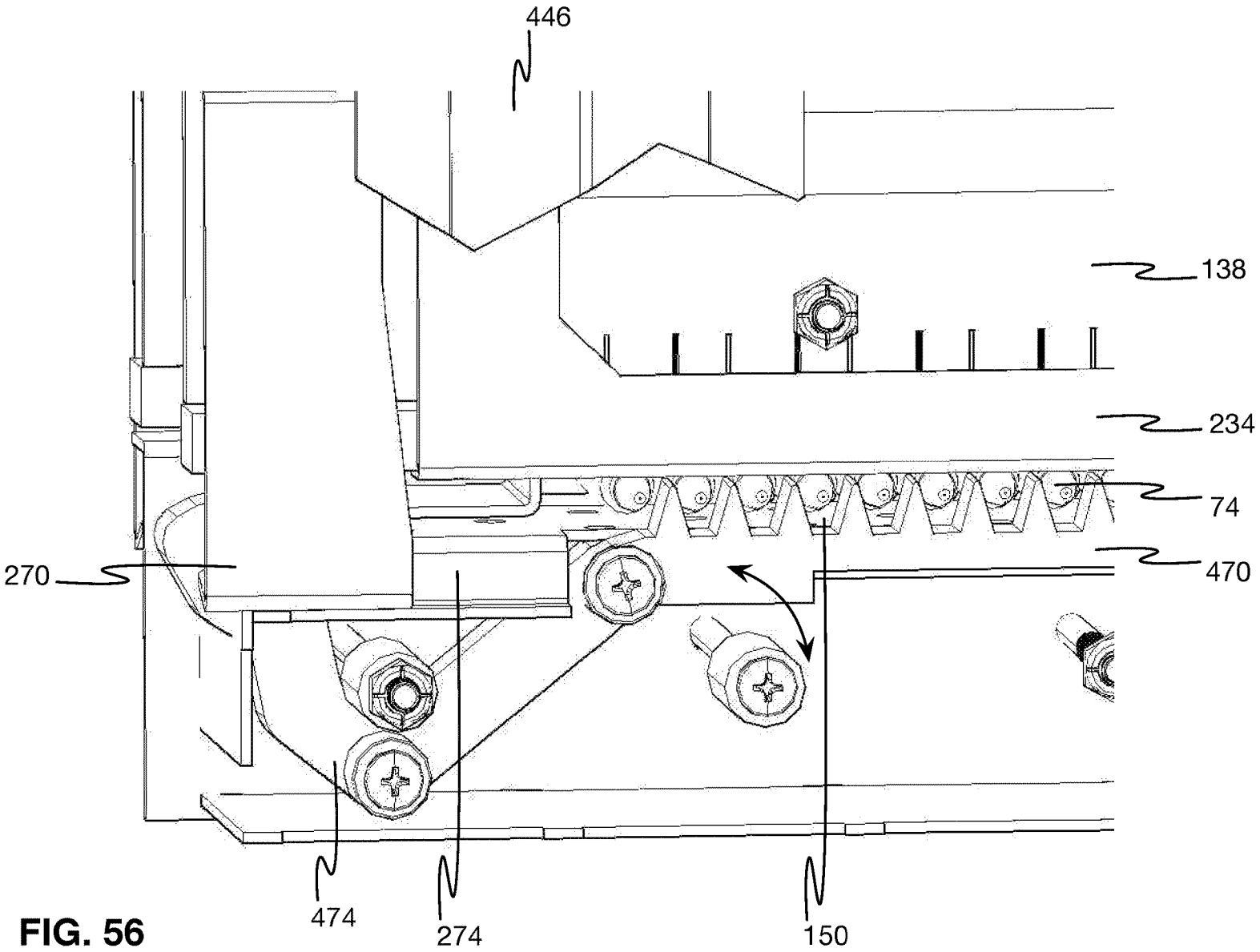
FIG. 56 is a partial isometric view of the magazine loader, in accordance with an embodiment thereof.
Figure 57:
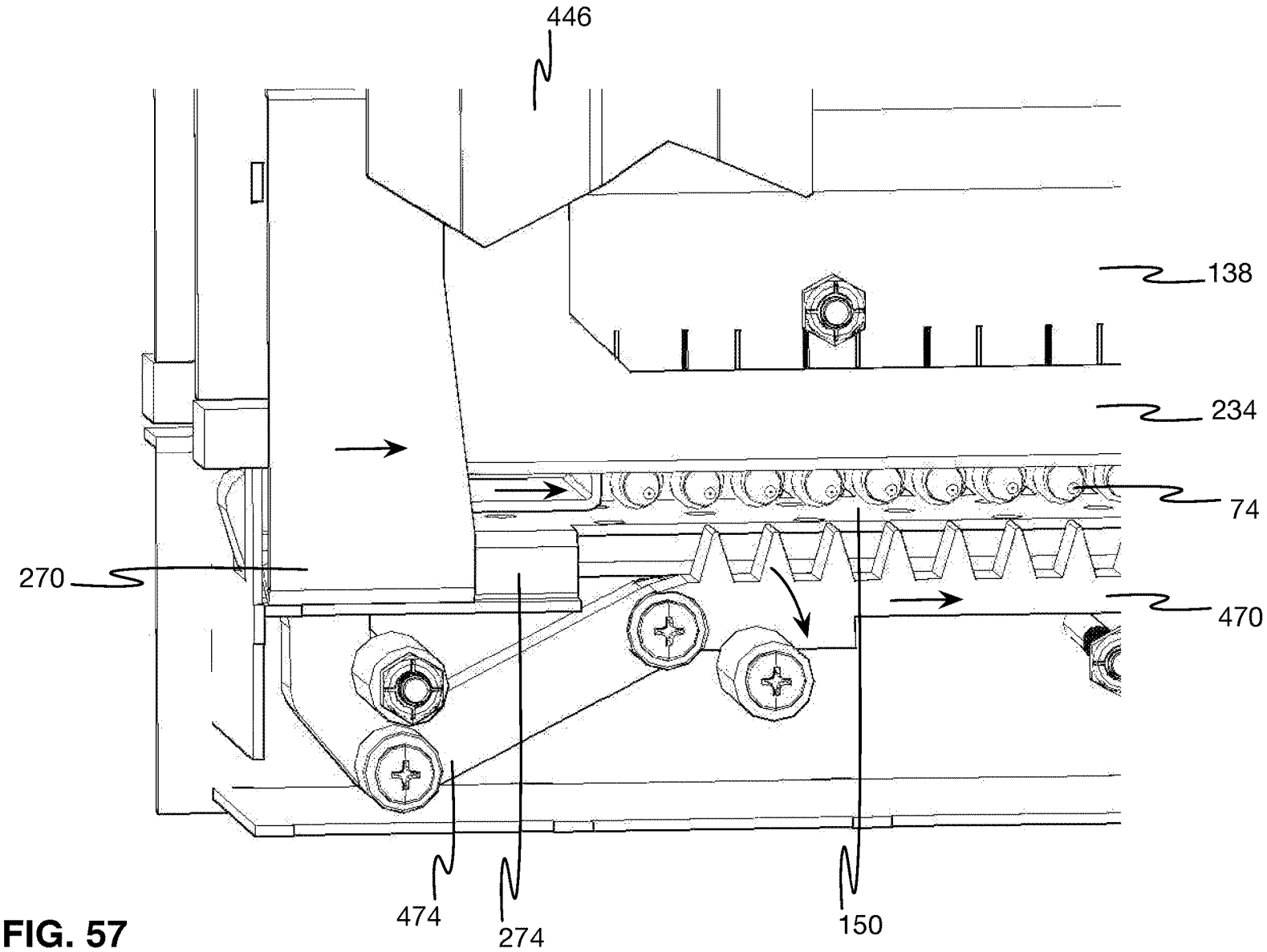
FIG. 57 is a partial isometric view of the magazine loader, in accordance with an embodiment thereof.
Figure 58:
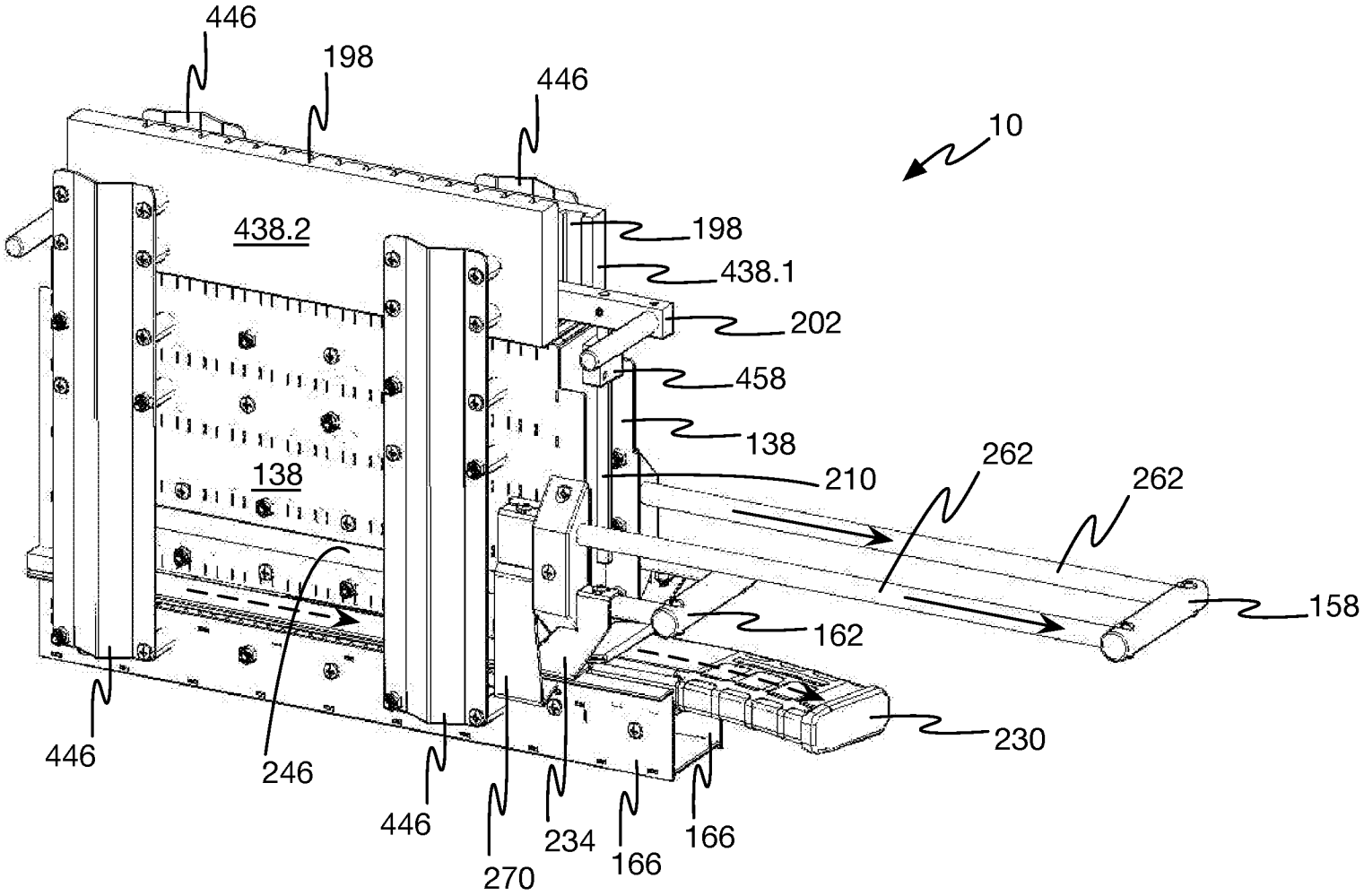
FIG. 58 is an isometric view of the magazine loader, in accordance with an embodiment thereof.
Figure 59:
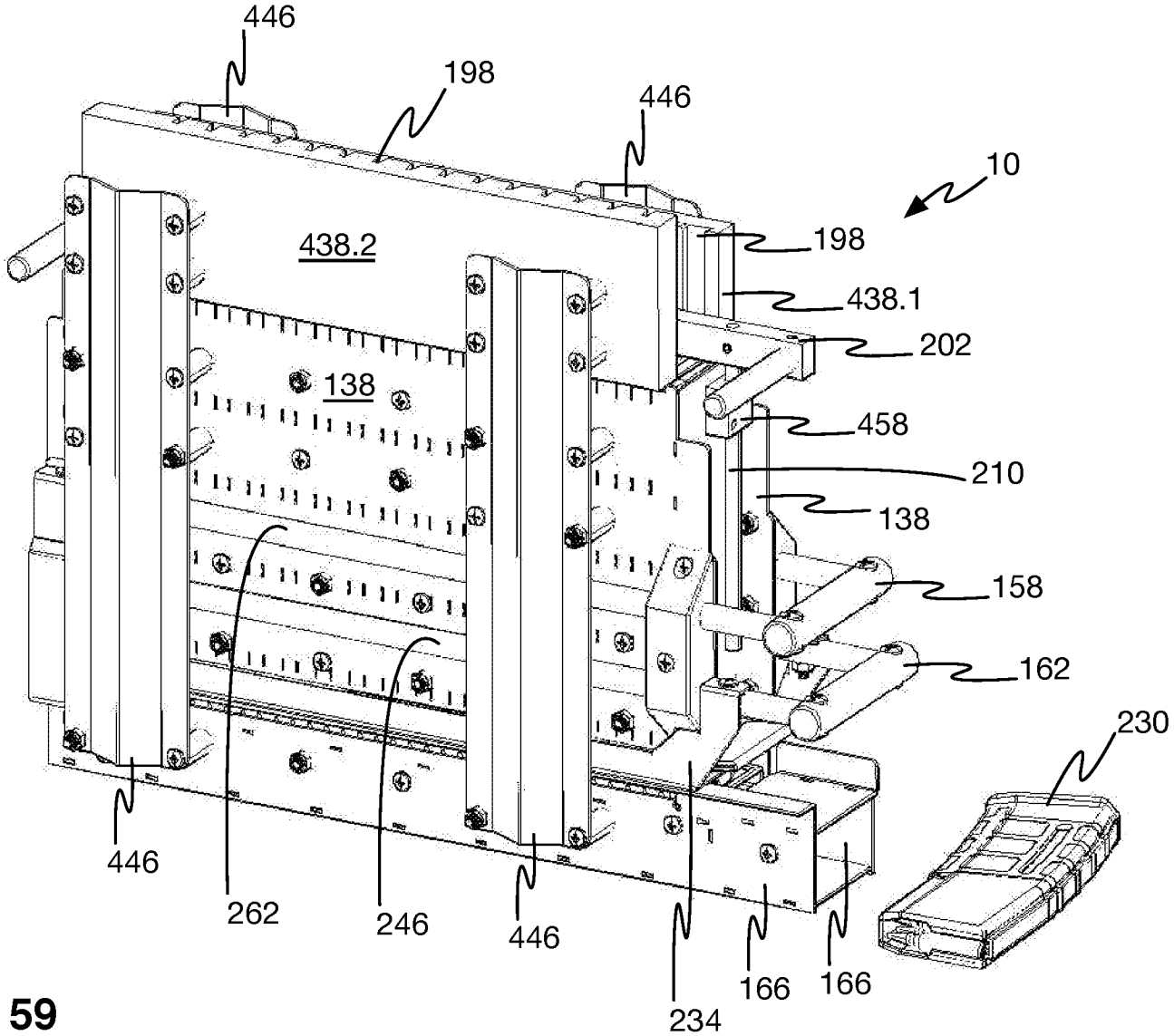
FIG. 59 is an isometric view of the magazine loader, in accordance with an embodiment thereof.

A dented member 470 is also used to ensure proper alignment and distance between the bullets 74 once they reached the lower row 242. The bullet distancing member 466 and the dented member 470 are desirable to prevent any movements of the bullets 74 when actuating the retaining floor 234. The dented member 470 is configured to move upward, to secure the bullets 74, and downward to allow movement of the bullets 74 toward the magazine 230. The upward and downward movement of the dented member 470 is provided by a pivot member 474 and a slot portion 478. The dented member 470 is operatively actuated by the movement of the first drawer 158 when inserting the bullets 74 in the magazine 230, moving downward when the first drawer 158 is pulled and vice-versa. One can appreciate that, in the present configuration, the drawers 158, 162 are slidably maintained by supports 482. Steps 486 throughout 514 in FIG. 48 illustrate the process of loading the magazine loader 10 with ten-rounds clips of bullets 74 using the handle portion 202 as a ram. The following steps can be exemplary performed as follows: Stacking bullet clips 190 inside the slots 462 of guide plates 438 in step 486 followed by positioning the handle portion 202 vertically above the bullet clips 190 in step 490, then pushing downward the handle portion 202 to push the bullets 74 inside the slots 462 of the guide plates 438 in step 494 ramming, with the handle portion 202 the first load of bullets 74 into the magazine loader 10 in step 498 and repeating the process throughout steps 502, 506, 510 and 514 to load the magazine loader 10.

Figure 60:
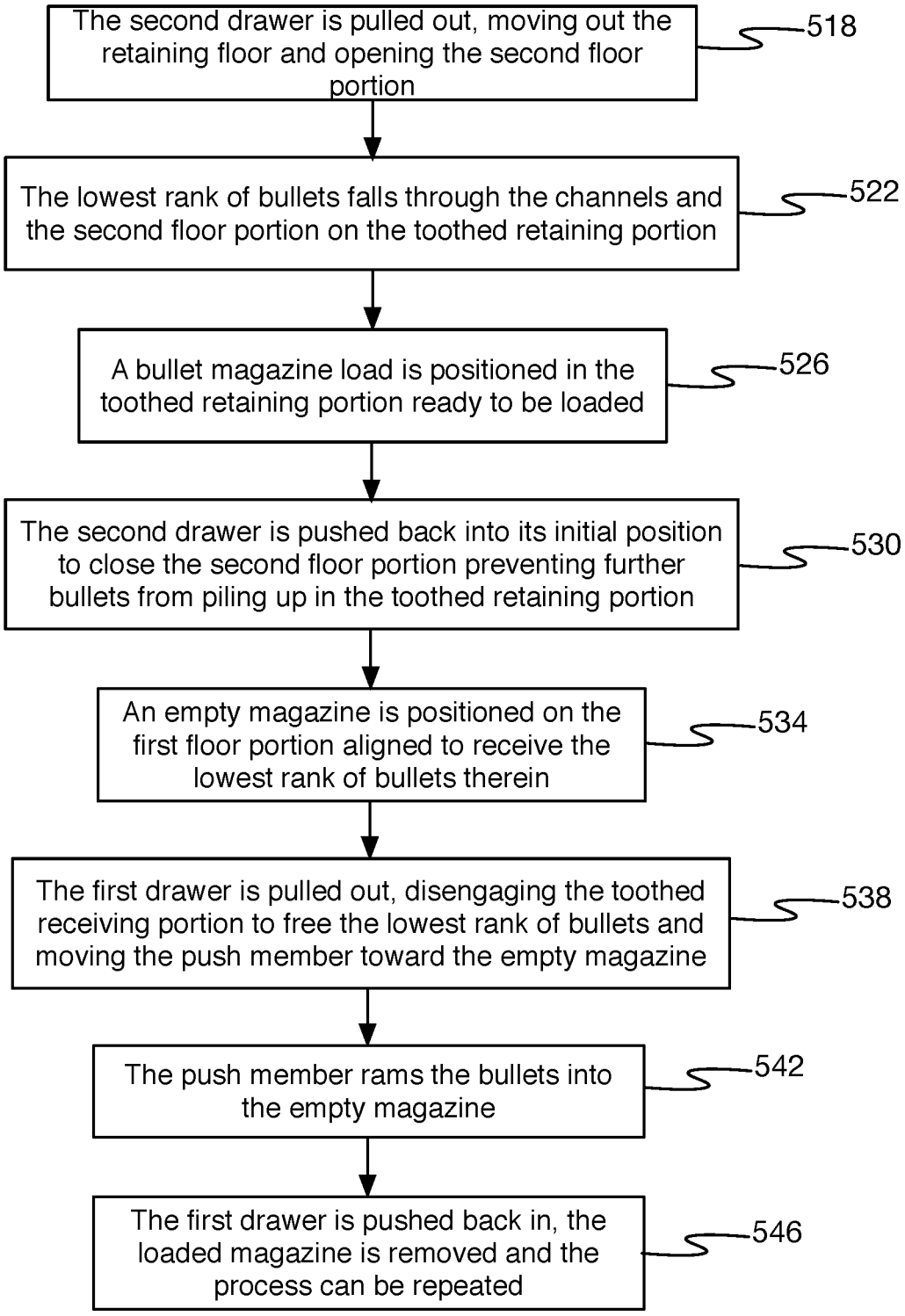
FIG. 60 is a flow chart illustrating a possible method of use of the magazine loader, in accordance with an embodiment thereof.

Steps 518 throughout 546 in FIG. 60 illustrate the process of loading a magazine 230 with the magazine loader 10 through the use of drawers 162 and 158. Step 518 pulls second drawer 162 removing retaining floor 234, the lowest rank of bullets 74 falls to the second floor portion 154 in step 522, the bullets are maintained in the proper position by bullet distancing member 466 and dented member 470 in step 526, in step 530 the second drawer 162 is pushed back into its initial position repositioning the retaining floor 234 to prevent further bullets 74 from reaching the second floor portion 154. In step 534 a magazine 230 is positioned on the first floor portion 150 and aligned to receive the lowest rank of bullets 74 therein. In step 538 the first drawer 158 is pulled out disengaging the dented member 470 freeing the lowest rank of bullets 74 and moving the push member 274 toward the empty magazine 230 ramming the bullets 74 in the empty magazine 230 in step 542. In step 546, the first drawer 158 is pushed back in, and the loaded magazine 230 is removed allowing the process to be repeated.

Figure 68:
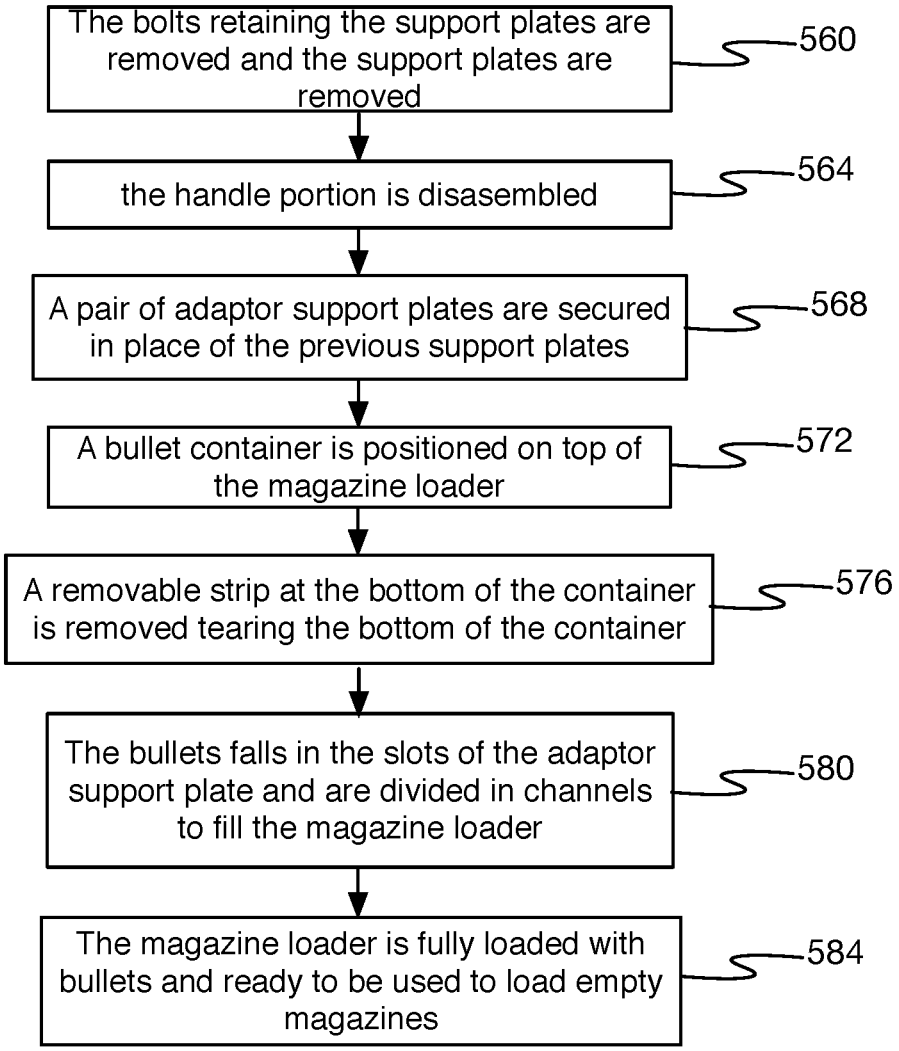
FIG. 68 is a flow chart illustrating a possible method of use of the magazine loader, in accordance with an embodiment thereof.

Steps 560 throughout 584 in FIG. 68 illustrate the process of switching guide plates 438 with adaptor plates 442 and loading the magazine 10 with ammunition container 50 or alternative bullet container 430. The following steps can be exemplary performed as follows in this embodiment with an alternative bullet container 430: Removing the fasteners 454 to remove the guide plates 438 in step 560 followed by disassembling the handle portion 202 in step 564 then the adaptor supports plate 442 are positioned to replace the guide plates 438 and secured with fasteners 454 in step 568, the bullet container 430 is positioned atop the magazine loader 10 in step 572 and the bottom portion 434 of the container is removed in step 576, the bullets 74 are free to fall in the slots 98 of the adaptor plates 442 and then in rails 94 into the magazine loader 10 in step 580 leaving the magazine loader 10 fully loaded with bullets in step 584

While the invention has been described in connection with what is presently considered to be the most practical and preferred embodiments, it is to be understood that the invention is not to be limited to the disclosed embodiments and elements, but, to the contrary, is intended to cover various modifications, combinations of features, equivalent arrangements, and equivalent elements included within the spirit and scope of the appended claims. Furthermore, the dimensions of features of various components that may appear on the drawings are not meant to be limiting, and the size of the components therein can vary from the size that may be portrayed in the figures herein. Thus, it is intended that the present invention covers the modifications and variations of the invention, provided they come within the scope of the appended claims and their equivalents.

What is claimed is:

1. A magazine loader for loading a plurality of individual bullets in a magazine, the magazine loader comprising:

a body including a top portion, a bottom portion, a front portion, a rear portion, a first side portion and a second side portion, the body further comprising a first opening disposed in the top portion for inserting the plurality of individual bullets in the magazine loader and a second opening disposed in the front portion for unloading bullets from the magazine loader in a magazine, when the magazine loader is used in conjunction with the magazine;

a plurality of channels inside the body, the plurality of channels being generally disposed vertically in communication between the top portion and a lower row of bullets for slidably receiving individual bullets therein when the magazine loader is used in conjunction with a plurality of bullets, the lower bullets in respective channels forming the lower row of bullets;

a dented member disposed at a bottom portion of the plurality of channels, the dented member including a series of raised portions that are sized and designed for selectively locating and aligning the bullets of the lower row of bullets in a loadable row of bullets by preventing the bullets in the loadable row of bullets to move upon vertical pressure of additional bullets located in the plurality of channels, the dented member being movable between a bullets-engaging position, for locating and aligning the loadable row of bullets in an alignment with the magazine receptacle, and a bullet disengaging position freeing the loadable row of bullets for allowing actuation of the loadable row of bullets in the magazine; and an actuator for moving the loadable row of bullets out of the magazine loader through a magazine receptacle.

2. The magazine loader of claim 1, wherein the bullets in the loadable row of bullets are maintained in substantial vertical alignment with the plurality of channels when the dented member is in the bullet-engaging position.

3. The magazine loader of claim 1, wherein each of the bullet includes a longitudinal axis and all the longitudinal axes of the bullets are substantially parallel to one another when the dented member is in the bullet-engaging position.

4. The magazine loader of claim 1, wherein the raised portions are self-aligning the bullets.

5. The magazine loader of claim 4, wherein the raised portions include a taper portion.

6. The magazine loader of claim 1, wherein the dented member is movable upward in the bullets-engaging position and movable downward in the bullet disengaging position.

7. The magazine loader of claim 1, wherein the dented member is operatively connected to the actuator.

8. The magazine loader of claim 1, wherein the dented member includes a pivot member.

9. The magazine loader of claim 1, wherein the dented member includes a slot portion.

10. The magazine loader of claim 1, wherein the raised portions of the dented members are adjacent to a tip of the bullets.

11. The magazine loader of claim 1, wherein the actuator is adapted to be pulled from outside the to insert the loadable row of bullets in the magazine.

12. The magazine loader of claim 1, wherein the channels include a sinusoidal shape.

13. The magazine loader of claim 1, wherein the channels are separated by a plurality of rails, at least some of the rails including variable width.

14. The magazine loader of claim 1, wherein the bullets in the channels are gravity fed toward a lower portion of the plurality of the channels.

15. The magazine loader of claim 1, wherein the magazine loader further includes a retaining floor for separating the lower row of bullets and the loadable row of bullets.

16. A magazine loader kit for loading a plurality of individual bullets in a magazine, the magazine loader kit comprising:

a body including a top portion, a bottom portion, a front portion, a rear portion, a first side portion and a second side portion, the body further comprising a first opening disposed in the top portion for inserting the plurality of individual bullets in the magazine loader and a second opening disposed in the front portion for unloading bullets from the magazine loader in a magazine, when the magazine loader is used in conjunction with the magazine;

a plurality of channels to be disposed inside the body, the plurality of channels being generally adapted to be disposed vertically in communication between the top portion and a lower row of bullets for slidably receiving individual bullets therein when the magazine loader is used in conjunction with a plurality of bullets, the lower bullets in respective channels forming the lower row of bullets;

a dented member adapted to be disposed at a bottom portion of the plurality of channels, the dented member including a series of raised portions that are sized and designed for selectively locating and aligning the bullets of the lower row of bullets in a loadable row of bullets by preventing the bullets in the loadable row of bullets to move upon vertical pressure of additional bullets located in the plurality of channels, the dented member, when assembled, being movable between a bullets-engaging position, for locating and aligning the loadable row of bullets in an alignment with the magazine, and a bullet disengaging position freeing the loadable row of bullets for allowing actuation of the loadable row of bullets in the magazine; and an actuator adapted to be operatively assembled with the body for moving the loadable row of bullets out of the magazine loader through a magazine receptacle.

* * * * *